US009200494B2

(12) United States Patent
Bakken

(10) Patent No.: US 9,200,494 B2
(45) Date of Patent: Dec. 1, 2015

(54) VIBRATION TOOL

(76) Inventor: Gary James Bakken, Edmonton (CA)

( * ) Notice: Subject to any disclaimer, the term of this patent is extended or adjusted under 35 U.S.C. 154(b) by 0 days.

(21) Appl. No.: 13/993,956

(22) PCT Filed: Sep. 29, 2011

(86) PCT No.: PCT/CA2011/001092

§ 371 (c)(1),
(2), (4) Date: Jul. 15, 2013

(87) PCT Pub. No.: WO2012/083413

PCT Pub. Date: Jun. 28, 2012

(65) Prior Publication Data

US 2013/0306305 A1 Nov. 21, 2013

Related U.S. Application Data

(63) Continuation-in-part of application No. 12/975,480, filed on Dec. 22, 2010, now abandoned.

(51) Int. Cl.
*E21B 28/00* (2006.01)
*E21B 31/00* (2006.01)

(52) U.S. Cl.
CPC ..... *E21B 31/005* (2013.01)

(58) Field of Classification Search
CPC ..... E21B 28/00; E21B 31/005; E21B 7/24; E21B 31/1135; E21B 4/02; E21B 43/003
USPC ..... 166/177.1, 177.2, 177.6, 177.7, 286; 175/56
See application file for complete search history.

(56) References Cited

U.S. PATENT DOCUMENTS

| | | | | |
|---|---|---|---|---|
| 2,744,721 | A * | 5/1956 | Hatch | 415/121.2 |
| 3,532,174 | A * | 10/1970 | Hinks et al. | 175/56 |
| 3,807,512 | A | 4/1974 | Pogonowski et al. | |
| 4,384,625 | A | 5/1983 | Roper et al. | |
| 4,667,742 | A | 5/1987 | Bodine | |
| 4,830,122 | A | 5/1989 | Walter | |
| 4,890,682 | A | 1/1990 | Worrall et al. | |
| 5,234,056 | A | 8/1993 | Bodine | |
| 6,152,222 | A | 11/2000 | Kyllingstad | |
| 6,446,725 | B2 | 9/2002 | Cabot | |
| 6,502,638 | B1 | 1/2003 | Stoesz | |
| 6,571,870 | B2 | 6/2003 | Zheng et al. | |
| 6,736,209 | B2 | 5/2004 | Ivannikov et al. | |
| 6,763,899 | B1 | 7/2004 | Ossia et al. | |
| 7,011,156 | B2 | 3/2006 | VonGynz-Rekowski | |
| 7,191,852 | B2 | 3/2007 | Clayton | |

(Continued)

FOREIGN PATENT DOCUMENTS

| | | |
|---|---|---|
| CA | 2780885 | 1/2011 |
| GB | 2261238 A | 5/1993 |

(Continued)

*Primary Examiner* — Kenneth L Thompson
*Assistant Examiner* — Michael Wills, III
(74) *Attorney, Agent, or Firm* — Terrence N. Kuharchuk; Rodman & Rodman

(57) ABSTRACT

A downhole vibration tool for connection with a pipe string, including a housing, an unbalanced turbine assembly contained within the housing, an inlet for introducing a fluid into the unbalanced turbine assembly, and an outlet for discharging the fluid from the unbalanced turbine assembly. The unbalanced turbine assembly includes a sleeve and at least one annular turbine which is located in an annular bore defined between the housing and the sleeve.

77 Claims, 17 Drawing Sheets

(56) References Cited

U.S. PATENT DOCUMENTS

| | | | | |
|---|---|---|---|---|
| 7,434,623 | B2 * | 10/2008 | von Gynz-Rekowski | .... 166/286 |
| 7,708,088 | B2 | 5/2010 | Allahar et al. | |
| 7,748,474 | B2 | 7/2010 | Watkins et al. | |
| 8,162,078 | B2 | 4/2012 | Anderson | |
| 8,181,719 | B2 | 5/2012 | Bunney et al. | |
| 2002/0148606 | A1 | 10/2002 | Zheng et al. | |
| 2002/0157871 | A1 | 10/2002 | Tulloch | |
| 2005/0284624 | A1 | 12/2005 | Libby et al. | |
| 2007/0187112 | A1 | 8/2007 | Eddison et al. | |
| 2008/0251254 | A1 | 10/2008 | Lynde et al. | |
| 2009/0173542 | A1 | 7/2009 | Ibrahim et al. | |
| 2009/0266612 | A1 | 10/2009 | Allahar et al. | |
| 2010/0212901 | A1 | 8/2010 | Buytaert | |
| 2010/0212965 | A1 | 8/2010 | Hall et al. | |
| 2010/0212966 | A1 | 8/2010 | Hall et al. | |
| 2010/0224412 | A1 | 9/2010 | Allahar | |
| 2010/0326733 | A1 | 12/2010 | Anderson | |
| 2011/0073374 | A1 | 3/2011 | Bunney et al. | |
| 2012/0193145 | A1 | 8/2012 | Anderson | |

FOREIGN PATENT DOCUMENTS

| | | | |
|---|---|---|---|
| GB | 2343465 | A | 5/2000 |
| GB | 2470762 | A | 12/2010 |
| RU | 2139403 | | 10/1999 |
| SU | 1633087 | | 3/1991 |

* cited by examiner

VIBRATION TOOL

TECHNICAL FIELD

A downhole tool for creating vibration and for vibrating a pipe string which is connected with the tool.

BACKGROUND OF THE INVENTION

A pipe string may be placed in a borehole during drilling, completion and/or servicing operations involving the borehole. One or more components may be connected together to form a pipe string. These components may include drill pipe, drill collars, drilling motors, drill bits, stabilizers, telemetry tools, steering tools, logging tools, completion tools, servicing tools, casing, tubing, coiled tubing, and/or other equipment.

During such drilling, completion and/or servicing operations, the pipe string or components of the pipe string may become stuck in the borehole. The risk of sticking is increased in "extended reach" boreholes, which may include lengthy non-vertical or horizontal sections.

Sticking of a pipe string may sometimes be prevented, and freeing of a stuck pipe string may sometimes be accomplished by vibrating the pipe string axially, torsionally and/or laterally.

Vibrating a pipe string may involve operating one or more vibration tools which may be incorporated into the pipe string. Examples of vibration tools in the prior art include UK Patent Application No. 2 261 238 A (Reiley), Russian Patent Publication No. RU2139403 C1 (Panfilov), Soviet Union Patent Publication No. SU1633087 A1 (Lyakh et al), U.S. Pat. No. 4,384,625 (Roper et al), U.S. Pat. No. 4,667,742 (Bodine), U.S. Pat. No. 4,830,122 (Walter), U.S. Pat. No. 7,191,852 (Clayton), U.S. Pat. No. 7,708,088 (Allahar et al), U.S. Patent Application Publication No. US 2002/0157871 A1 (Tulloch), U.S. Patent Application Publication No. US 2009/0173542 A1 (Ibrahim et al), U.S. Patent Application Publication No. US 2010/0212965 A1 (Hall et al), U.S. Patent Application Publication No. US 2010/0212966 A1 (Hall et al), and U.S. Patent Application Publication No. US 2010/0224412 A1 (Allahar).

There remains a need for a relatively simple and robust vibration tool which may be connected with a pipe string in order to vibrate the pipe string.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention is directed at a downhole vibration tool for connection with a pipe string. The vibration tool is comprised of an unbalanced turbine assembly which is unbalanced relative to a longitudinal axis of the vibration tool. The unbalanced turbine assembly is comprised of at least one turbine. Rotation of the turbine results in vibration of the vibration tool due to the unbalancing of the unbalanced turbine assembly. Rotation of the turbine may be caused by a fluid passing through or by the turbine.

In some embodiments, the unbalanced turbine assembly may be comprised of at least one turbine which is unbalanced. In some embodiments, the unbalanced turbine assembly may be comprised of an unbalanced component which is rotated as a result of rotation of at least one turbine. In some embodiments, the unbalanced component may be comprised of an unbalanced weight. In some embodiments, the unbalanced turbine assembly may be comprised of one or more unbalanced turbines and/or one or more unbalanced components.

In some embodiments, the vibration tool may be comprised of a housing and an unbalanced turbine assembly contained within the housing. In some embodiments, the unbalanced turbine assembly may be comprised of a sleeve and at least one annular turbine which is contained within an annular bore defined between the housing and the sleeve, so that a fluid passing through the annular bore rotates the annular turbine, resulting in vibration of the vibration tool.

As used herein, "proximal" means located relatively toward an intended "uphole" end, "upper" end and/or "surface" end of the vibration tool and/or a pipe string as a point of origin.

As used herein, "distal" means located relatively away from an intended "uphole" end, "upper" end and/or "surface" end of the vibration tool and/or a pipe string as a point of origin.

As used herein, "fluid" means drilling fluid, water or any other type of fluid which may be circulated through a pipe string.

In one exemplary embodiment, the invention is a downhole vibration tool for connection with a pipe string, comprising:

(a) a housing, the housing having an inner housing surface;
(b) an unbalanced turbine assembly contained within the housing, wherein the vibration tool has a longitudinal tool axis, wherein the unbalanced turbine assembly is unbalanced relative to the longitudinal tool axis, and wherein the unbalanced turbine assembly comprises:
  (i) a sleeve, the sleeve having an outer sleeve surface, wherein the inner housing surface and the outer sleeve surface define an annular bore extending through the housing;
  (ii) a first annular turbine rotatably contained within the annular bore,
(c) an inlet for introducing a fluid into the annular bore; and
(d) an outlet for discharging the fluid from the annular bore.

The unbalanced turbine assembly is unbalanced relative to the longitudinal tool axis so that rotation of the first annular turbine results in a tendency of the vibration tool to vibrate laterally.

The unbalanced turbine assembly may be configured to be unbalanced relative to the longitudinal tool axis in any manner which will result in a tendency of the vibration tool to vibrate laterally.

The housing may be comprised of any pipe, conduit or similar structure which provides the inner housing surface and which is suitable for facilitating containment of the unbalanced turbine assembly therein while providing for the annular bore to extend therethrough.

The housing may be comprised of a single housing part or may be comprised of a plurality of housing parts which are connected together either permanently or temporarily. A plurality of housing parts may be permanently connected together by welds or in some other manner, or may be temporarily connected together by threaded connections or in some other manner.

In some embodiments, the vibration tool may be comprised of one or more subs for facilitating connecting the vibration tool with a pipe string. The subs may be considered to be part of the housing, or the subs may be considered to be separate from the housing. In some embodiments, the housing may be considered to be comprised of a main housing and one or more subs which are permanently or temporarily connected with the main housing.

In some embodiments, the vibration tool may be comprised of a proximal sub having a proximal threaded connector for connecting the vibration tool with a pipe string. In some embodiments, the proximal threaded connector may be a box connector. In some embodiments, the proximal threaded connector may be a pin connector.

In some embodiments, the vibration tool may be comprised of a distal sub having a distal threaded connector for connecting the vibration tool with a pipe string. In some embodiments, the distal threaded connector may be a box connector. In some embodiments, the distal threaded connector may be a pin connector.

In some embodiments, the proximal sub may be connected with a main housing with a threaded connection. In some embodiments, the distal sub may be connected with a main housing with a threaded connection.

In some embodiments, the threaded connection between the main housing and the proximal sub may be comprised of a box connector on the main housing and a pin connector on the proximal sub. In some embodiments, the threaded connection between the main housing and the proximal sub may be comprised of a pin connector on the main housing and a box connector on the proximal sub. In some embodiments, the threaded connection between the main housing and the distal sub may be comprised of a box connector on the main housing and a pin connector on the distal sub. In some embodiments, the threaded connection between the main housing and the distal sub may be comprised of a pin connector on the main housing and a box connector on the distal sub.

The sleeve may be comprised of any structure which is suitable to be contained within the housing such that the annular bore is defined between the inner housing surface and the outer sleeve surface.

In some embodiments, the sleeve may have an inner sleeve surface and the inner sleeve surface may define a sleeve bore extending through the sleeve and thus through the housing. In such embodiments, the sleeve may be comprised of any pipe, conduit or similar structure.

In some embodiments, the sleeve may consist of, may consist essentially of, or may be comprised of a solid structure or a substantially solid structure such as a rod. In some such embodiments, the sleeve may not have an inner sleeve surface or the sleeve may not have an inner sleeve surface which defines a sleeve bore extending through the sleeve.

The sleeve has a proximal sleeve end and a distal sleeve end.

The sleeve may be comprised of a single sleeve part or may be comprised of a plurality of sleeve parts which are connected together either permanently or temporarily. A plurality of sleeve parts may be permanently connected together by welds or in some other manner, or may be temporarily connected together by threaded connections or in some other manner.

The first annular turbine may be comprised of any annular structure or device which is suitable to be rotatably contained within the annular bore. The first annular turbine is rotatable about a first turbine rotation axis. In some embodiments, the first turbine rotation axis may be substantially coincident with the longitudinal tool axis. In some embodiments, the first turbine rotation axis may be offset from the longitudinal tool axis.

The first annular turbine is comprised of one or more first turbine vanes which are impacted as the fluid passes through the annular bore so that the fluid energy imparts rotational energy to the first annular turbine.

The first turbine vanes may be comprised of any surfaces which are suitable for being impacted by the fluid and may be arranged on the first annular turbine in any manner which is suitable for facilitating conversion of the fluid energy to the rotational energy. As non-limiting examples, the first turbine vanes may be comprised of blades, grooves, or bucket structures, or may be defined as suitable passages through the first annular turbine.

In some embodiments, the first annular turbine may be comprised of an outer surface which is located adjacent to the inner housing surface and an inner surface which is located adjacent to the outer sleeve surface.

In some embodiments, the first turbine vanes may be comprised of surfaces located on the outer surface of the first annular turbine. In some embodiments, the first turbine vanes may be comprised of surfaces located on the inner surface of the first annular turbine. In some embodiments, the first turbine vanes may be comprised of surfaces which are defined as passages through the first annular turbine.

In some embodiments, the first turbine vanes may be comprised of blades which extend along all or a portion of a first turbine length of the first annular turbine. In some embodiments, the blades are located on the outer surface of the first annular turbine so that the blades are adjacent to the inner housing surface. The blades are arranged at an angle relative to the longitudinal tool axis so that the first annular turbine has a first turbine vane angle.

In some embodiments, the first annular turbine may be unbalanced relative to the longitudinal tool axis. In such embodiments, the first annular turbine may be configured to be unbalanced relative to the longitudinal tool axis in any manner which will result in a tendency of the vibration tool to vibrate laterally.

In some embodiments in which the first annular turbine is unbalanced, the first annular turbine may be configured to be unbalanced relative to the longitudinal tool axis by configuring the mass of the first annular turbine so that the center of mass is offset from the first turbine rotation axis and/or by offsetting the first turbine rotation axis from the longitudinal tool axis.

The mass of the first annular turbine may be configured so that the center of mass is offset from the first turbine rotation axis in any suitable manner. In some embodiments, the first annular turbine may be fabricated to provide an offset center of mass. In some embodiments, the first annular turbine may be initially fabricated so that the center of mass is substantially coincident with the first turbine rotation axis and may subsequently be modified by adding or removing mass asymmetrically from the first annular turbine.

The first turbine rotation axis may be offset from the longitudinal tool axis in any suitable manner. In some embodiments, the first turbine rotation axis may be offset from the longitudinal tool axis by configuring the housing asymmetrically.

The inlet may be comprised of any structure or device which is capable of introducing a fluid into the annular bore. In some embodiments, the inlet may be comprised of a portion of the housing adjacent to the proximal sleeve end which is in fluid communication with the annular bore.

In some embodiments in which the sleeve has an inner sleeve surface which defines a sleeve bore, the inlet may be comprised of a flow control device for selectively controlling a flow of fluid into the sleeve bore and/or the annular bore. The flow control device may be comprised of any structure, device or apparatus which is capable of selectively controlling a flow of fluid into the sleeve bore and/or the annular bore.

In some embodiments, the flow control device may be comprised of a valve. In some embodiments the valve may be adjustable. In some embodiments, the valve may be remotely actuatable.

In some embodiments, the flow control device may be comprised of a seat which is configured to receive a plug which may be transported to the inlet by a flow of fluid through the pipe string. In some embodiments, the plug may be comprised of a ball.

In some particular embodiments, the flow control device may be comprised of a plug which may be connected with a seat in order to control a flow of fluid into the sleeve bore and thereby divert fluid into the annular bore. In some particular embodiments, the plug may be removably connected with the seat. In some particular embodiments, the plug may be a retrievable plug. In some particular embodiments, the plug may be removably connected with the seat using a frangible mechanism, such as one or more shear pins. In some particular embodiments, the plug may be comprised of a structure for facilitating retrieval of the plug, such as a fishing neck.

In some particular embodiments, the plug may be comprised of a nose cone which is configured to be removably connected with the proximal sleeve end with one or more shear pins in order to block the sleeve bore and which includes a fishing neck for facilitating retrieval of the nose cone.

The outlet may be comprised of any structure or device which is capable of discharging fluid from the annular bore so that the fluid may be communicated back to the pipe string from the vibration tool. In some embodiments, the outlet may be comprised of a portion of the housing adjacent to the distal sleeve end which is in fluid communication with the annular bore.

In some embodiments in which the sleeve has an inner sleeve surface which defines a sleeve bore, the outlet may be comprised of any structure or device which is capable of discharging fluid from the sleeve bore and the annular bore, and may be comprised of a portion of the housing adjacent to the distal sleeve end which is in fluid communication with the sleeve bore and the annular bore.

In some embodiments, the vibration tool may be adapted to be connected with a pipe string having a nominal inner diameter.

In embodiments in which the sleeve has an inner sleeve surface which defines a sleeve bore, the sleeve bore has a sleeve bore diameter. In some embodiments, the sleeve bore diameter may be maximized in order to enable fluid and tools to pass through the vibration tool without significant restriction. In some embodiments, a ratio of the sleeve bore diameter to the nominal inner diameter of the pipe string may be at least about 0.5:1. In some embodiments, a ratio of the sleeve bore diameter to the nominal inner diameter of the pipe string may be at least about 0.6:1. In some embodiments, a ratio of the sleeve bore diameter to the nominal inner diameter of the pipe string may be at least about 0.7:1. In some embodiments, a ratio of the sleeve bore diameter to the nominal inner diameter of the pipe string may be at least about 0.8:1. In some embodiments, a ratio of the sleeve bore diameter to the nominal inner diameter of the pipe string may be at least about 0.9:1. In some embodiments, the sleeve bore diameter may be substantially identical to the nominal inner diameter.

The first annular turbine has a proximal first turbine end and a distal first turbine end. In some embodiments, the unbalanced turbine assembly may further comprise a first proximal support ring contained within the annular bore adjacent to the proximal first turbine end. In some embodiments, the unbalanced turbine assembly may further comprise a first distal support ring contained within the annular bore adjacent to the distal first turbine end.

In some embodiments, the unbalanced turbine assembly may further comprise a proximal first turbine bearing located between the first proximal support ring and the proximal first turbine end. In some embodiments, the unbalanced turbine assembly may further comprise a distal first turbine bearing located between the distal first turbine end and the first distal support ring. The proximal first turbine bearing and the distal first turbine bearing may be comprised of any suitable type of bearing, including but not limited to a rolling element bearing, a plain bearing or a bushing. In some embodiments, one or both of the proximal first turbine bearing and the distal first turbine bearing may be omitted.

In some embodiments, the first proximal support ring may be fixedly connected with the housing. In some embodiments, the first proximal support ring may be fixedly connected with the housing with one or more dowels. In some embodiments, the first distal support ring may be fixedly connected with the housing. In some embodiments, the first distal support ring may be fixedly connected with the housing with one or more dowels.

In some embodiments, the unbalanced turbine assembly may further comprise one or more annular turbines in addition to the first annular turbine.

In some embodiments, the unbalanced turbine assembly may further comprise a second annular turbine rotatably contained within the annular bore.

The second annular turbine may be comprised of any annular structure or device which is suitable to be rotatably contained within the annular bore. The second annular turbine is rotatable about a second turbine rotation axis. In some embodiments, the second turbine rotation axis may be substantially coincident with the longitudinal tool axis. In some embodiments, the second turbine rotation axis may be offset from the longitudinal tool axis.

The second annular turbine is comprised of one or more second turbine vanes which are impacted as the fluid passes through the annular bore so that the fluid energy imparts rotational energy to the second annular turbine.

The second turbine vanes may be comprised of any surfaces which are suitable for being impacted by the fluid and may be arranged on the second annular turbine in any manner which is suitable for facilitating conversion of the fluid energy to the rotational energy. As non-limiting examples, the second turbine vanes may be comprised of blades, grooves, or bucket structures, or may be defined as suitable passages through the second annular turbine.

In some embodiments, the second annular turbine may be comprised of an outer surface which is located adjacent to the inner housing surface and an inner surface which is located adjacent to the outer sleeve surface.

In some embodiments, the second turbine vanes may be comprised of surfaces located on the outer surface of the second annular turbine. In some embodiments, the second turbine vanes may be comprised of surfaces located on the inner surface of the second annular turbine. In some embodiments, the second turbine vanes may be comprised of surfaces which are defined as passages through the second annular turbine.

In some embodiments, the second turbine vanes may be comprised of blades which extend along all or a portion of a second turbine length of the second annular turbine. In some embodiments, the blades are located on the outer surface of the second annular turbine so that the blades are adjacent to the inner housing surface. The blades are arranged at an angle relative to the longitudinal tool axis so that the second annular turbine has a second turbine vane angle.

In some embodiments, the second annular turbine may be unbalanced relative to the longitudinal tool axis. In such embodiments, the second annular turbine may be configured to be unbalanced relative to the longitudinal tool axis in any manner which will result in a tendency of the vibration tool to vibrate laterally.

In some embodiments in which the second annular turbine is unbalanced, the second annular turbine may be configured to be unbalanced relative to the longitudinal tool axis by configuring the mass of the second annular turbine so that the center of mass is offset from the second turbine rotation axis and/or by offsetting the second turbine rotation axis from the longitudinal tool axis.

The mass of the second annular turbine may be configured so that the center of mass is offset from the second turbine rotation axis in any suitable manner. In some embodiments, the second annular turbine may be fabricated to provide an offset center of mass. In some embodiments, the second annular turbine may be initially fabricated so that the center of mass is substantially coincident with the second turbine rotation axis and may subsequently be modified by adding or removing mass asymmetrically from the second annular turbine.

The second turbine rotation axis may be offset from the longitudinal tool axis in any suitable manner. In some embodiments, the second turbine rotation axis may be offset from the longitudinal tool axis by configuring the housing asymmetrically.

The second annular turbine has a proximal second turbine end and a distal second turbine end. In some embodiments, the unbalanced turbine assembly may further comprise a second proximal support ring contained within the annular bore adjacent to the proximal second turbine end. In some embodiments, the unbalanced turbine assembly may further comprise a second distal support ring contained within the annular bore adjacent to the distal second turbine end.

In some embodiments, the unbalanced turbine assembly may further comprise a proximal second turbine bearing located between the second proximal support ring and the proximal second turbine end. In some embodiments, the unbalanced turbine assembly may further comprise a distal second turbine bearing located between the distal second turbine end and the second distal support ring. The proximal second turbine bearing and the distal second turbine bearing may be comprised of any suitable type of bearing, including but not limited to a rolling element bearing, a plain bearing or a bushing. In some embodiments, one or both of the proximal second turbine bearing and the distal second turbine bearing may be omitted.

In some embodiments, the second proximal support ring may be fixedly connected with the housing. In some embodiments, the second proximal support ring may be fixedly connected with the housing with one or more dowels. In some embodiments, the second distal support ring may be fixedly connected with the housing. In some embodiments, the second distal support ring may be fixedly connected with the housing with one or more dowels.

In some embodiments, the unbalanced turbine assembly may further comprise a third annular turbine rotatably contained within the annular bore.

The third annular turbine may be comprised of any annular structure or device which is suitable to be rotatably contained within the annular bore. The third annular turbine is rotatable about a third turbine rotation axis. In some embodiments, the third turbine rotation axis may be substantially coincident with the longitudinal tool axis. In some embodiments, the third turbine rotation axis may be offset from the longitudinal tool axis.

The third annular turbine is comprised of one or more third turbine vanes which are impacted as the fluid passes through the annular bore so that the fluid energy imparts rotational energy to the third annular turbine.

The third turbine vanes may be comprised of any surfaces which are suitable for being impacted by the fluid and may be arranged on the third annular turbine in any manner which is suitable for facilitating conversion of the fluid energy to the rotational energy. As non-limiting examples, the third turbine vanes may be comprised of blades, grooves, or bucket structures, or may be defined as suitable passages through the third annular turbine.

In some embodiments, the third annular turbine may be comprised of an outer surface which is located adjacent to the inner housing surface and an inner surface which is located adjacent to the outer sleeve surface.

In some embodiments, the third turbine vanes may be comprised of surfaces located on the outer surface of the third annular turbine. In some embodiments, the third turbine vanes may be comprised of surfaces located on the inner surface of the third annular turbine. In some embodiments, the third turbine vanes may be comprised of surfaces which are defined as passages through the third annular turbine.

In some embodiments, the third turbine vanes may be comprised of blades which extend along all or a portion of a third turbine length of the third annular turbine. In some embodiments, the blades are located on the outer surface of the third annular turbine so that the blades are adjacent to the inner housing surface. The blades are arranged at an angle relative to the longitudinal tool axis so that the third annular turbine has a third turbine vane angle.

In some embodiments, the third annular turbine may be unbalanced relative to the longitudinal tool axis. In such embodiments, the third annular turbine may be configured to be unbalanced relative to the longitudinal tool axis in any manner which will result in a tendency of the vibration tool to vibrate laterally.

In some embodiments in which the third annular turbine is unbalanced, the third annular turbine may be configured to be unbalanced relative to the longitudinal tool axis by configuring the mass of the third annular turbine so that the center of mass is offset from the third turbine rotation axis and/or by offsetting the third turbine rotation axis from the longitudinal tool axis.

The mass of the third annular turbine may be configured so that the center of mass is offset from the third turbine rotation axis in any suitable manner. In some embodiments, the third annular turbine may be fabricated to provide an offset center of mass. In some embodiments, the third annular turbine may be initially fabricated so that the center of mass is substantially coincident with the third turbine rotation axis and may subsequently be modified by adding or removing mass asymmetrically from the third annular turbine.

The third turbine rotation axis may be offset from the longitudinal tool axis in any suitable manner. In some embodiments, the third turbine rotation axis may be offset from the longitudinal tool axis by configuring the housing asymmetrically.

The third annular turbine has a proximal third turbine end and a distal third turbine end. In some embodiments, the unbalanced turbine assembly may further comprise a third proximal support ring contained within the annular bore adjacent to the proximal third turbine end. In some embodiments, the unbalanced turbine assembly may further comprise a third distal support ring contained within the annular bore adjacent to the distal third turbine end.

In some embodiments, the unbalanced turbine assembly may further comprise a proximal third turbine bearing located between the third proximal support ring and the proximal third turbine end. In some embodiments, the unbalanced turbine assembly may further comprise a distal third turbine bearing located between the distal third turbine end and the third distal support ring. The proximal third turbine bearing and the distal third turbine bearing may be comprised of any suitable type of bearing, including but not limited to a rolling element bearing, a plain bearing or a bushing. In some embodiments, one or both of the proximal third turbine bearing and the distal third turbine bearing may be omitted.

In some embodiments, the third proximal support ring may be fixedly connected with the housing. In some embodiments, the third proximal support ring may be fixedly connected with the housing with one or more dowels. In some embodiments, the third distal support ring may be fixedly connected with the housing. In some embodiments, the third distal support ring may be fixedly connected with the housing with one or more dowels.

The sleeve may be supported within the housing in any suitable manner. In some embodiments, the sleeve may be fixedly supported within the housing so that the sleeve is not capable of rotating relative to the housing. In some embodiments, the sleeve may be rotatably supported within the housing so that the sleeve is capable of rotating relative to the housing.

In some embodiments, the sleeve may be supported within the housing by one or more of the support rings. In some embodiments, the sleeve may be supported within the housing by the first proximal support ring. In some embodiments, the sleeve may be supported within the housing by the first proximal support ring and one or more of the other support rings.

In some embodiments, the sleeve may be fixedly supported by one or more of the support rings so that the sleeve is not capable of rotating relative to the support rings. In some embodiments, the sleeve may be rotatably supported by one or more of the support rings so that the sleeve is capable of rotating relative to the support rings.

In some embodiments, the sleeve may be fixedly supported by the first proximal support ring and/or with one or more of the other support rings by an interference fit between the first proximal support ring and the outer sleeve surface. In some embodiments, the sleeve may be fixedly connected with one or more of the support rings in some other manner.

In some embodiments, the sleeve may be rotatably supported by one or more of the support rings by one or more bearings.

In some embodiments, the proximal sleeve end may be comprised of a projection for engaging with the first proximal support ring in order to limit the movement of the sleeve relative to the first proximal support ring. In some embodiments, the third distal support ring may be comprised of a projection for engaging with the distal sleeve end in order to limit the movement of the sleeve relative to the third distal support ring. In some embodiments, the proximal sleeve end may be comprised of the projection and the projection may be comprised of a lip or rim extending radially from the proximal sleeve end.

In some embodiments, the first distal support ring and the second proximal support ring may be comprised of separate parts. In some embodiments, the first distal support ring and the second proximal support ring may be comprised of a combined first intermediate support ring.

In some embodiments, the second distal support ring and the third proximal support ring may be comprised of separate parts. In some embodiments, the second distal support ring and the third proximal support ring may be comprised of a combined second intermediate support ring.

In some embodiments, the annular turbines may be substantially identical to each other. In some embodiments, the annular turbines may be configured so that the annular turbines are different from each other in some respects.

In some embodiments, each of the annular turbines may have the same number of turbine vanes. In some embodiments, the number of first turbine vanes, the number of second turbine vanes and/or the number of third turbine vanes may be different from each other.

In some embodiments, some or all of the first turbine vane angle, the second turbine vane angle and the third turbine vane angle may be the same. In some embodiments, some or all of the first turbine vane angle, the second turbine vane angle and the third turbine vane angle may be different from each other.

The first annular turbine has a first turbine length. The second annular turbine has a second turbine length. The third annular turbine has a third turbine length. In some embodiments, some or all of the first turbine length, the second turbine length and the third turbine length may be the same. In some embodiments, some or all of the first turbine length, the second turbine length and the third turbine length may be different from each other.

The first annular turbine may be configured to rotate at a first turbine rotation rate at a design fluid energy. The second annular turbine may be configured to rotate at a second turbine rotation rate at the design fluid energy. The third annular turbine may be configured to rotate at a third turbine rotation rate at the design fluid energy. In some embodiments, some or all of the first turbine rotation rate, the second turbine rotation rate and the third turbine rotation rate may be the same. In some embodiments, some or all of the first turbine rotation rate, the second turbine rotation rate and the third turbine rotation rate may be different from each other.

The first annular turbine may be configured to generate a first turbine torque at a design fluid energy. The second annular turbine may be configured to generate a second turbine torque at the design fluid energy. The third annular turbine may be configured to generate a third turbine torque at the design fluid energy. In some embodiments, some or all of the first turbine torque, the second turbine torque and the third turbine torque may be the same. In some embodiments, some or all of the first turbine torque, the second turbine torque and the third turbine torque may be different from each other.

The first proximal support ring may be comprised of one or more first diverter vanes for directing a fluid through the first proximal support ring. In some embodiments, the first diverter vanes may be arranged to have a first diverter vane angle relative to the longitudinal tool axis. In some embodiments, the first diverter vane angle may be in a direction relative to the longitudinal tool axis which is opposite to the first turbine vane angle. In some embodiments, the first diverter vane angle may be substantially zero, so that the first diverter vanes are substantially parallel with the longitudinal tool axis and thus direct the fluid through the first proximal support ring in a direction which is substantially parallel to the longitudinal tool axis.

The first distal support ring may be comprised of one or more distal diverter vanes for directing a fluid through the first distal support ring. In some embodiments, the distal diverter vanes may be arranged to have a distal diverter vane angle relative to the longitudinal tool axis. In some embodiments, the distal diverter vane angle may be in a direction relative to the longitudinal tool axis which is opposite to the first turbine vane angle. In some embodiments, the distal diverter vane angle may be substantially zero, so that the distal diverter vanes are substantially parallel with the longitudinal tool axis and thus direct the fluid through the first distal support ring in a direction which is substantially parallel to the longitudinal tool axis.

The second proximal support ring may be comprised of one or more second diverter vanes for directing a fluid through the second proximal support ring. In some embodiments, the second diverter vanes may be arranged to have a second diverter vane angle relative to the longitudinal tool axis. In some embodiments, the second diverter vane angle may be in a direction relative to the longitudinal tool axis which is opposite to the second turbine vane angle. In some embodiments, the second diverter vane angle may be substantially zero, so that the second diverter vanes are substantially parallel with the longitudinal tool axis and thus direct the fluid through the second proximal support ring in a direction which is substantially parallel to the longitudinal tool axis.

The second distal support ring may be comprised of one or more distal diverter vanes for directing a fluid through the second distal support ring. In some embodiments, the distal diverter vanes may be arranged to have a distal diverter vane angle relative to the longitudinal tool axis. In some embodiments, the distal diverter vane angle may be in a direction relative to the longitudinal tool axis which is opposite to the second turbine vane angle. In some embodiments, the distal diverter vane angle may be substantially zero, so that the distal diverter vanes are substantially parallel with the longitudinal tool axis and thus direct the fluid through the second distal support ring in a direction which is substantially parallel to the longitudinal tool axis.

The third proximal support ring may be comprised of one or more third diverter vanes for directing a fluid through the third proximal support ring. In some embodiments, the third diverter vanes may be arranged to have a third diverter vane angle relative to the longitudinal tool axis. In some embodiments, the third diverter vane angle may be in a direction relative to the longitudinal tool axis which is opposite to the third turbine vane angle. In some embodiments, the third diverter vane angle may be substantially zero, so that the third diverter vanes are substantially parallel with the longitudinal tool axis and thus direct the fluid through the third proximal support ring in a direction which is substantially parallel to the longitudinal tool axis.

The third distal support ring may be comprised of one or more distal diverter vanes for directing a fluid through the third distal support ring. In some embodiments, the distal diverter vanes may be arranged to have a distal diverter vane angle relative to the longitudinal tool axis. In some embodiments, the distal diverter vane angle may be in a direction relative to the longitudinal tool axis which is opposite to the third turbine vane angle. In some embodiments, the distal diverter vane angle may be substantially zero, so that the distal diverter vanes are substantially parallel with the longitudinal tool axis and thus direct the fluid through the third distal support ring in a direction which is substantially parallel to the longitudinal tool axis.

In some embodiments, each of the support rings may have the same number of diverter vanes, the same vane angles and/or the same direction for the vane angles. In some embodiments, the number of first diverter vanes, the number of second diverter vanes, the number of third diverter vanes and/or the number of distal diverter vanes may be different from each other, and/or some or all of the vane angles may be different from each other, and/or some or all of the directions of the vane angles may be different from each other.

In some embodiments, the second diverter vane angle and the distal diverter vane angle of the first distal support ring may be the same angle and may be in the same direction. In some embodiments, the second diverter vane angle and the distal diverter vane angle of the first distal support ring may be different angles and/or may be in a different direction.

In some embodiments in which the first distal support ring and the second proximal support ring are comprised of a combined first intermediate support ring, the second diverter vane angle may be provided along substantially the entire length of the first intermediate support ring.

In some embodiments, the third diverter vane angle and the distal diverter vane angle of the second distal support ring may be the same angle and may be in the same direction. In some embodiments, the second diverter vane angle and the distal diverter vane angle of the second distal support ring may be different angles and/or may be in a different direction.

In some embodiments in which the second distal support ring and the third proximal support ring are comprised of a combined second intermediate support ring, the third diverter vane angle may be provided along substantially the entire length of the second intermediate support ring.

In some embodiments, the unbalanced turbine assembly may further comprise one or more unbalanced components which may be rotated by one or more turbines. In some particular embodiments, the unbalanced turbine assembly may further comprise an unbalanced component which may be rotated by one or more turbines.

In some embodiments, the unbalanced turbine assembly may comprise one or more unbalanced turbines and one or more unbalanced components which are rotated by one or more turbines so that the unbalanced turbine assembly is unbalanced by one or more unbalanced turbines and by one or more unbalanced components.

In some embodiments, the unbalanced component may be comprised of an unbalanced weight. In some embodiments, the unbalanced weight may be comprised of an annular unbalanced weight which is contained in the annular bore and which may be rotated by one or more annular turbines.

In such embodiments, the unbalanced weight may be comprised of any annular structure or device which is suitable to be rotatably contained within the annular bore. The unbalanced weight is rotatable about an unbalanced weight rotation axis. In some embodiments, the unbalanced weight rotation axis may be substantially coincident with the longitudinal tool axis. In some embodiments, the unbalanced weight rotation axis may be offset from the longitudinal tool axis.

In embodiments in which the unbalanced turbine assembly further comprises an unbalanced weight, the unbalanced weight may be configured to be unbalanced relative to the longitudinal tool axis in any manner which will result in a tendency of the vibration tool to vibrate laterally.

In some embodiments in which the unbalanced turbine assembly further comprises an unbalanced weight, the unbalanced weight may be configured to be unbalanced relative to the longitudinal tool axis by configuring the mass of the unbalanced weight so that the center of mass is offset from the unbalanced weight rotation axis and/or by offsetting the unbalanced weight rotation axis from the longitudinal tool axis.

In some embodiments in which the unbalanced turbine assembly further comprises an unbalanced weight, the unbalanced weight may be configured to be unbalanced relative to the longitudinal tool axis by configuring the mass of the unbalanced weight so that the center of mass is offset from the unbalanced weight rotation axis and/or by offsetting the unbalanced weight rotation axis from the longitudinal tool axis.

The mass of the unbalanced weight may be configured so that the center of mass is offset from the unbalanced weight rotation axis in any suitable manner. In some embodiments, the unbalanced weight may be fabricated to provide an offset center of mass. In some embodiments, the unbalanced weight may be initially fabricated so that the center of mass is substantially coincident with the unbalanced weight rotation axis and may subsequently be modified by adding or removing mass asymmetrically from the unbalanced weight.

The unbalanced weight rotation axis may be offset from the longitudinal tool axis in any suitable manner. In some embodiments, the unbalanced weight rotation axis may be offset from the longitudinal tool axis by configuring the housing asymmetrically.

In some embodiments in which the unbalanced turbine assembly further comprises an unbalanced weight, the unbalanced weight may be rotatably connected with the first annular turbine so that rotation of the first annular turbine results in rotation of the unbalanced weight.

In some such embodiments, the first annular turbine and the unbalanced weight may both be fixedly connected with the sleeve so that rotation of the first annular turbine results in rotation of both the sleeve and the unbalanced weight.

The first annular turbine and the unbalanced weight may be fixedly connected with the sleeve in any suitable manner. In some embodiments, the first annular turbine and/or the unbalanced weight may be fixedly connected with the sleeve by an interference fit between the first annular turbine and the sleeve and/or an interference fit between the unbalanced weight and the sleeve. In some embodiments, the first annular turbine and/or the unbalanced weight may be fixedly connected with the sleeve in some other manner. In some embodiments, the first annular turbine and/or the unbalanced weight may be formed integrally with the sleeve.

In some embodiments in which the unbalanced turbine assembly further comprises an unbalanced weight, the unbalanced turbine assembly may further comprise one or more bearings between the inner housing surface and the outer sleeve surface, for rotatably supporting the sleeve in the housing. The one or more bearings may be comprised of any suitable structure, device or apparatus which is capable of rotatably supporting the sleeve in the housing.

In some embodiments, the one or more bearings may be comprised of one or more bushings. In some embodiments, the one or more bearings may be comprised of one or more rolling element bearings. In some embodiments, the one or more bearings may be comprised of one or more plain bearings.

In some such embodiments, the one or more bearings may be comprised of a proximal sleeve bearing and/or a distal sleeve bearing. In some such embodiments, the one or more bearings may be comprised of one or more intermediate sleeve bearings in addition to the proximal sleeve bearing and/or the distal sleeve bearing. In some such embodiments, the one or more bearings may be associated with support rings so that the sleeve is rotatably supported in the housing by support rings.

In some embodiments in which the unbalanced turbine assembly further comprises an unbalanced weight, the unbalanced turbine assembly may further comprise a second annular turbine rotatably contained within the annular bore. In some such embodiments, the unbalanced weight may be rotatably connected with the second annular turbine so that rotation of the second annular turbine results in rotation of the unbalanced weight. In some such embodiments, the second annular turbine may be fixedly connected with the sleeve so that rotation of the second annular turbine results in rotation of both the sleeve and the unbalanced weight.

The second annular turbine may be fixedly connected with the sleeve in any suitable manner. In some embodiments, the second annular turbine may be fixedly connected with the sleeve by an interference fit between the second annular turbine and the sleeve. In some embodiments, the second annular turbine may be fixedly connected with the sleeve in some other manner. In some embodiments, the second annular turbine may be formed integrally with the sleeve.

In some embodiments in which the unbalanced turbine assembly further comprises an unbalanced weight, the unbalanced turbine assembly may further comprise a third annular turbine rotatably contained within the annular bore. In some such embodiments, the unbalanced weight may be rotatably connected with the third annular turbine so that rotation of the third annular turbine results in rotation of the unbalanced weight. In some such embodiments, the third annular turbine may be fixedly connected with the sleeve so that rotation of the third annular turbine results in rotation of both the sleeve and the unbalanced weight.

The third annular turbine may be fixedly connected with the sleeve in any suitable manner. In some embodiments, the third annular turbine may be fixedly connected with the sleeve by an interference fit between the third annular turbine and the sleeve. In some embodiments, the third annular turbine may be fixedly connected with the sleeve in some other manner. In some embodiments, the third annular turbine may be formed integrally with the sleeve.

In some embodiments in which the unbalanced turbine assembly further comprises an unbalanced weight, the first annular turbine, the second annular turbine and the third annular turbine may each be rotatably connected with the unbalanced weight. In some such embodiments, the first annular turbine, the second annular turbine and the third annular turbine may each be fixedly connected with the sleeve. In some such embodiments, the turbines which are rotatably connected with the unbalanced weight may not be unbalanced.

In some embodiments in which each of the turbines is connected with the unbalanced weight, each of the turbines may have the same turbine vane angle. In some embodiments in which each of the turbines is connected with the unbalanced weight, each of the turbines may have the same turbine length.

In embodiments in which the unbalanced turbine assembly further comprises an unbalanced weight, the unbalanced weight may be located at any suitable location within the annular bore. In some such embodiments, the unbalanced weight may be located adjacent to one of the turbines. In some such embodiments, the unbalanced weight may be located adjacent to one of the turbines and between the proximal and distal support rings for the turbine.

In some embodiments in which the unbalanced turbine assembly further comprises an unbalanced weight which is rotated by one or more turbines, the unbalanced turbine assembly may further comprise an auxiliary annular turbine rotatably contained within the annular bore. In some embodiments, the auxiliary annular turbine may be unbalanced relative to the longitudinal tool axis. In some embodiments, the auxiliary annular turbine may be rotatable independently of the first annular turbine, the second annular turbine, the third annular turbine, and the sleeve. In some embodiments, the unbalanced turbine assembly may further comprise more than one auxiliary annular turbine.

The auxiliary annular turbine may be comprised of any annular structure or device which is suitable to be rotatably contained within the annular bore. The auxiliary annular turbine is rotatable about an auxiliary turbine rotation axis. In some embodiments, the auxiliary turbine rotation axis may be substantially coincident with the longitudinal tool axis. In some embodiments, the auxiliary turbine rotation axis may be offset from the longitudinal tool axis.

In some embodiments, the unbalanced turbine assembly may further comprise one or more bearings between the inner housing surface and the outer sleeve surface for rotatably supporting the auxiliary annular turbine between the housing and the sleeve.

In some embodiments, the one or more bearings may be comprised of one or more bushings. In some embodiments, the one or more bearings may be comprised of one or more rolling element bearings. In some embodiments, the one or more bearings may be comprised of one or more plain bearings.

In some such embodiments, the one or more bearings may be comprised of an auxiliary turbine sleeve bearing. In some such embodiments, the auxiliary turbine sleeve bearing may be between the auxiliary turbine and the sleeve. In some such embodiments, the auxiliary turbine sleeve bearing may be associated with the auxiliary turbine.

The auxiliary annular turbine is comprised of one or more auxiliary turbine vanes which are impacted as the fluid passes through the annular bore so that the fluid energy imparts rotational energy to the auxiliary annular turbine.

The auxiliary turbine vanes may be comprised of any surfaces which are suitable for being impacted by the fluid and may be arranged on the auxiliary annular turbine in any manner which is suitable for facilitating conversion of the fluid energy to the rotational energy. As non-limiting examples, the auxiliary turbine vanes may be comprised of blades, grooves, or bucket structures, or may be defined as suitable passages through the auxiliary annular turbine.

In some embodiments, the auxiliary annular turbine may be comprised of an outer surface which is located adjacent to the inner housing surface and an inner surface which is located adjacent to the outer sleeve surface.

In some embodiments, the auxiliary turbine vanes may be comprised of surfaces located on the outer surface of the auxiliary annular turbine. In some embodiments, the auxiliary turbine vanes may be comprised of surfaces located on the inner surface of the auxiliary annular turbine. In some embodiments, the auxiliary turbine vanes may be comprised of surfaces which are defined as passages through the auxiliary annular turbine.

In some embodiments, the auxiliary turbine vanes may be comprised of blades which extend along all or a portion of an auxiliary turbine length of the auxiliary annular turbine. In some embodiments, the blades are located on the outer surface of the auxiliary annular turbine so that the blades are adjacent to the inner housing surface. The blades are arranged at an angle relative to the longitudinal tool axis so that the auxiliary annular turbine has an auxiliary turbine vane angle.

In some embodiments, the auxiliary annular turbine may be unbalanced relative to the longitudinal tool axis. In such embodiments, the auxiliary annular turbine may be configured to be unbalanced relative to the longitudinal tool axis in any manner which will result in a tendency of the vibration tool to vibrate laterally.

In some embodiments in which the auxiliary annular turbine is unbalanced, the auxiliary annular turbine may be configured to be unbalanced relative to the longitudinal tool axis by configuring the mass of the auxiliary annular turbine so that the center of mass is offset from the auxiliary turbine rotation axis and/or by offsetting the auxiliary turbine rotation axis from the longitudinal tool axis.

The mass of the auxiliary annular turbine may be configured so that the center of mass is offset from the auxiliary turbine rotation axis in any suitable manner. In some embodiments, the auxiliary annular turbine may be fabricated to provide an offset center of mass. In some embodiments, the auxiliary annular turbine may be initially fabricated so that the center of mass is substantially coincident with the auxiliary turbine rotation axis and may subsequently be modified by adding or removing mass asymmetrically from the auxiliary annular turbine.

The auxiliary turbine rotation axis may be offset from the longitudinal tool axis in any suitable manner. In some embodiments, the auxiliary turbine rotation axis may be offset from the longitudinal tool axis by configuring the housing asymmetrically.

The auxiliary annular turbine has a proximal auxiliary turbine end and a distal auxiliary turbine end. In some embodiments, the unbalanced turbine assembly may further comprise an auxiliary proximal support ring contained within the annular bore adjacent to the proximal auxiliary turbine end. In some embodiments, the unbalanced turbine assembly may further comprise an auxiliary distal support ring contained within the annular bore adjacent to the distal auxiliary turbine end.

In some embodiments, the unbalanced turbine assembly may further comprise a proximal auxiliary turbine bearing located between the auxiliary proximal support ring and the proximal auxiliary turbine end. In some embodiments, the unbalanced turbine assembly may further comprise a distal auxiliary turbine bearing located between the distal auxiliary turbine end and the auxiliary distal support ring. The proximal auxiliary turbine bearing and the distal auxiliary turbine bearing may be comprised of any suitable type of bearing, including but not limited to a rolling element bearing, a plain bearing or a bushing. In some embodiments, one or both of the proximal auxiliary turbine bearing and the distal auxiliary turbine bearing may be omitted.

In some embodiments, the auxiliary proximal support ring may be fixedly connected with the housing. In some embodiments, the auxiliary proximal support ring may be fixedly connected with the housing with one or more dowels. In some embodiments, the auxiliary distal support ring may be fixedly connected with the housing. In some embodiments, the auxiliary distal support ring may be fixedly connected with the housing with one or more dowels.

In some embodiments, the one or more bearings between the inner housing surface and the outer sleeve surface for rotatably supporting the sleeve in the housing may be further comprised of one or more bearings which are associated with the auxiliary proximal support ring and/or the auxiliary distal support ring.

The auxiliary proximal support ring may be comprised of one or more auxiliary diverter vanes for directing a fluid through the auxiliary proximal support ring. In some embodiments, the auxiliary diverter vanes may be arranged to have an auxiliary diverter vane angle relative to the longitudinal tool axis. In some embodiments, the auxiliary diverter vane angle may be in a direction relative to the longitudinal tool axis which is opposite to the auxiliary turbine vane angle. In some embodiments, the auxiliary diverter vane angle may be substantially zero, so that the auxiliary diverter vanes are substantially parallel with the longitudinal tool axis and thus direct the fluid through the auxiliary proximal support ring in a direction which is substantially parallel to the longitudinal tool axis.

The auxiliary distal support ring may be comprised of one or more distal diverter vanes for directing a fluid through the auxiliary distal support ring. In some embodiments, the distal diverter vanes may be arranged to have a distal diverter vane angle relative to the longitudinal tool axis. In some embodiments, the distal diverter vane angle may be in a direction relative to the longitudinal tool axis which is opposite to the auxiliary turbine vane angle. In some embodiments, the distal diverter vane angle may be substantially zero, so that the distal diverter vanes are substantially parallel with the longitudinal tool axis and thus direct the fluid through the auxiliary distal support ring in a direction which is substantially parallel to the longitudinal tool axis.

In some embodiments, the auxiliary turbine vane angle may be in the same direction as the vane angles for the other turbine or turbines relative to the longitudinal tool axis so that the auxiliary annular turbine and the other turbine or turbines are configured to rotate in the same direction. In some embodiments, the auxiliary turbine vane angle may be in a direction opposite to the vane angles for the other turbine or turbines relative to the longitudinal tool axis so that the auxiliary annular turbine and the other turbine or turbines are configured to rotate in opposite directions.

The auxiliary turbine length may be less than, equal to, or greater than the turbine lengths of the other turbine or turbines. In some embodiments, the auxiliary turbine length is greater than the turbine lengths of the other turbine or turbines.

In embodiments in which the unbalanced turbine assembly is comprised of an auxiliary annular turbine, the auxiliary annular turbine may be located at any suitable location within the annular bore. In some such embodiments, the auxiliary annular turbine may be located toward the proximal sleeve end relative to the other turbine or turbines. In some such embodiments, the auxiliary annular turbine may be located toward the distal sleeve end relative to the other turbine or turbines. In some such embodiments, the auxiliary annular turbine may be located between two of the other turbines.

In some particular embodiments in which the unbalanced turbine assembly comprises a first annular turbine, a second annular turbine, a third annular turbine and an auxiliary turbine, the auxiliary annular turbine may be located toward the proximal sleeve end relative to the other turbines. In some such particular embodiments, the auxiliary distal support ring and the first proximal support ring may be comprised of a combined auxiliary intermediate support ring. In some such embodiments, the proximal sleeve bearing may be associated with the auxiliary proximal support ring. In some such embodiments, the distal sleeve bearing may be associated with the third distal support ring.

BRIEF DESCRIPTION OF DRAWINGS

Embodiments of the invention will now be described with reference to the accompanying drawings, in which:

FIG. 1A-1D is a complete longitudinal section assembly drawing of a vibration tool according to a first exemplary embodiment of the invention, wherein FIG. 1B is a continuation of FIG. 1A, FIG. 1C is a continuation of FIG. 1B, and FIG. 1D is a continuation of FIG. 1C.

FIG. 3A-3E is a complete longitudinal section assembly drawing of a vibration tool according to a second exemplary embodiment of the invention, in which FIG. 3B is a continuation of FIG. 3A, FIG. 3C is a continuation of FIG. 3B, FIG. 3D is a continuation of FIG. 3C, and FIG. 3E is a continuation of FIG. 3D.

FIG. 7A-7E is a complete longitudinal partial section assembly drawing of a vibration tool according to a third exemplary embodiment of the invention, in which FIG. 7B is a continuation of FIG. 7A, FIG. 7C is a continuation of FIG. 7B, FIG. 7D is a continuation of FIG. 7C, and FIG. 7E is a continuation of FIG. 7D.

DETAILED DESCRIPTION

The present invention is a downhole vibration tool for connection with a pipe string.

Figure 1A:
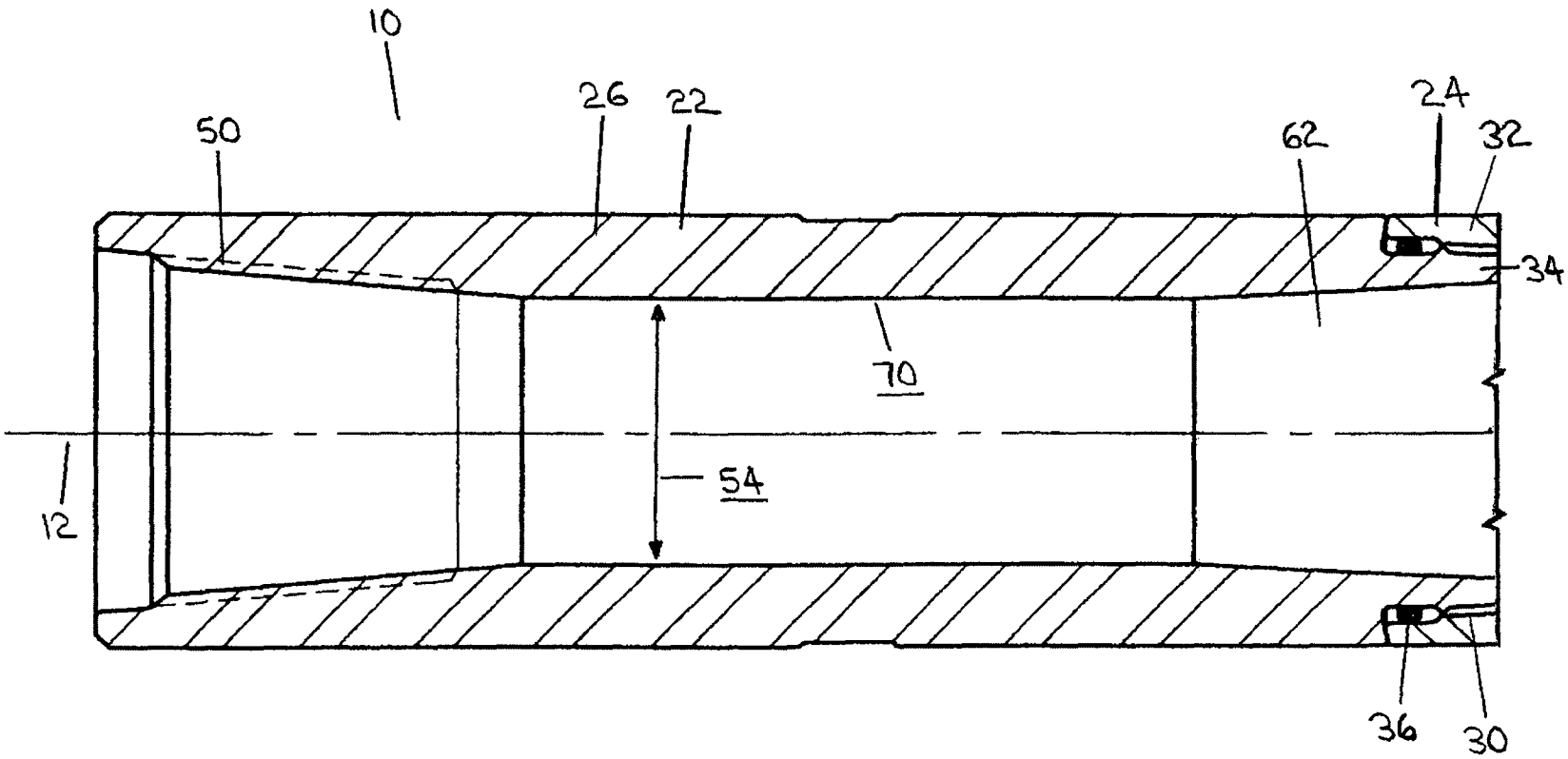
Figure 18:
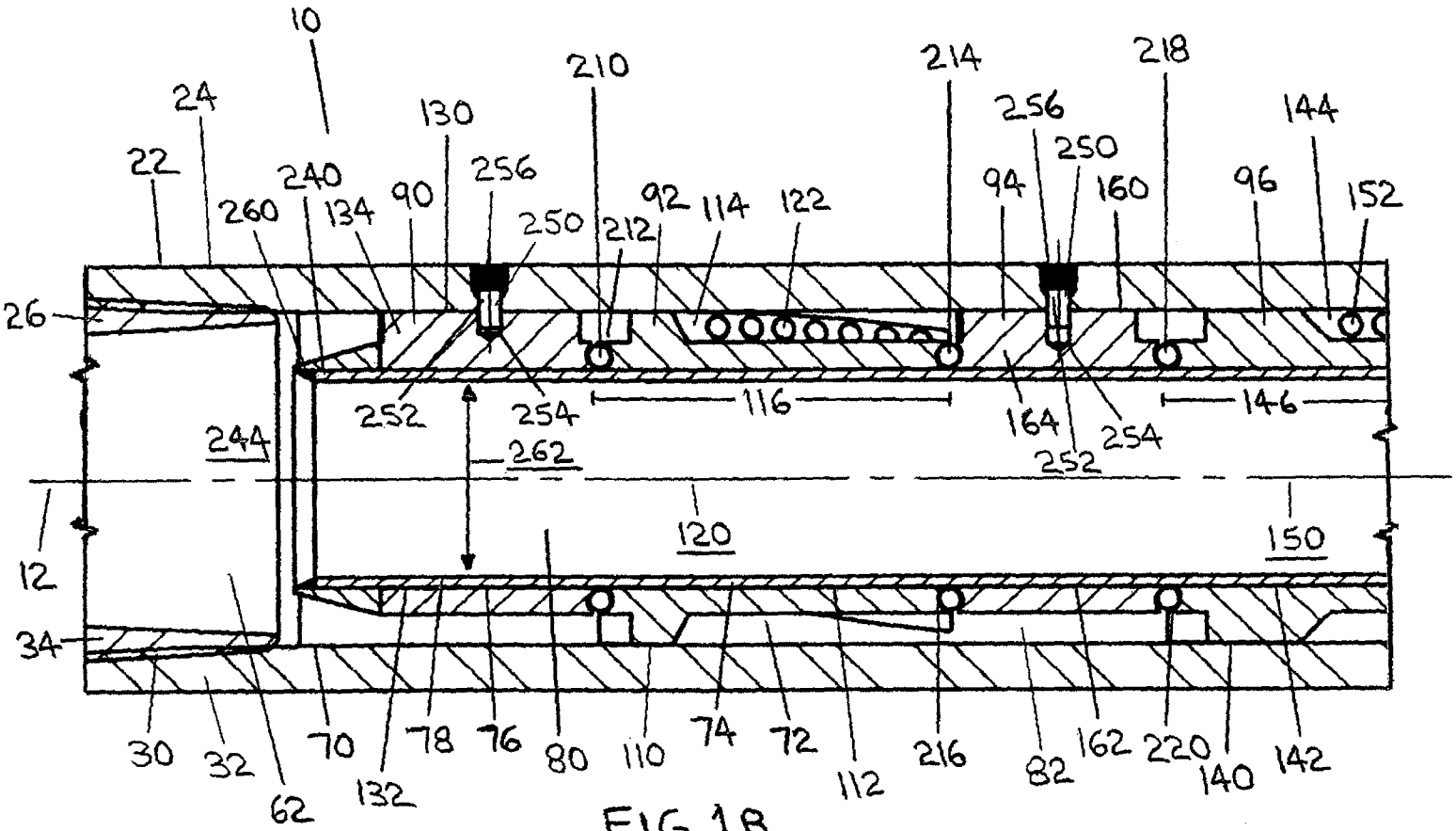
Figure 1C:
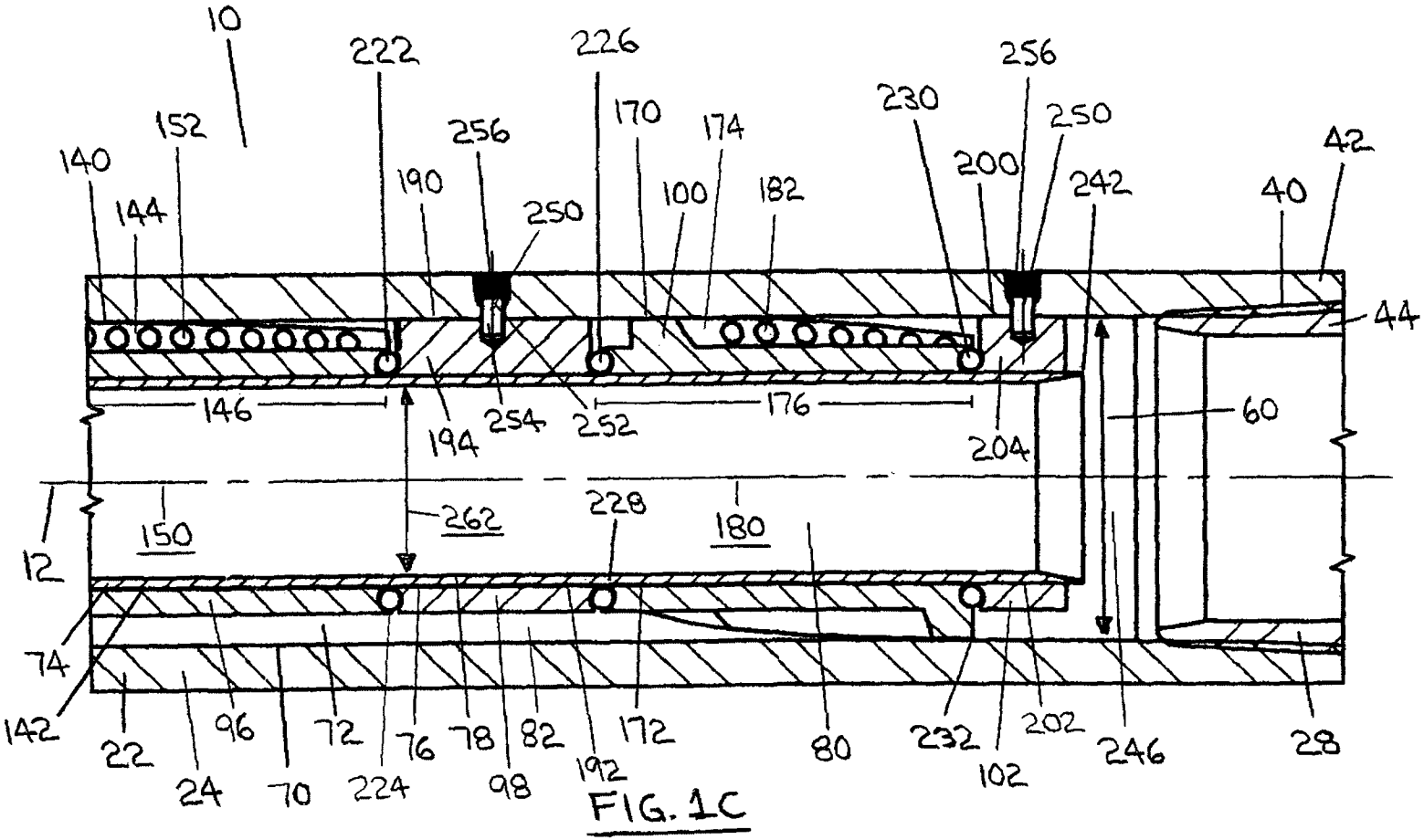
Figure 1D:
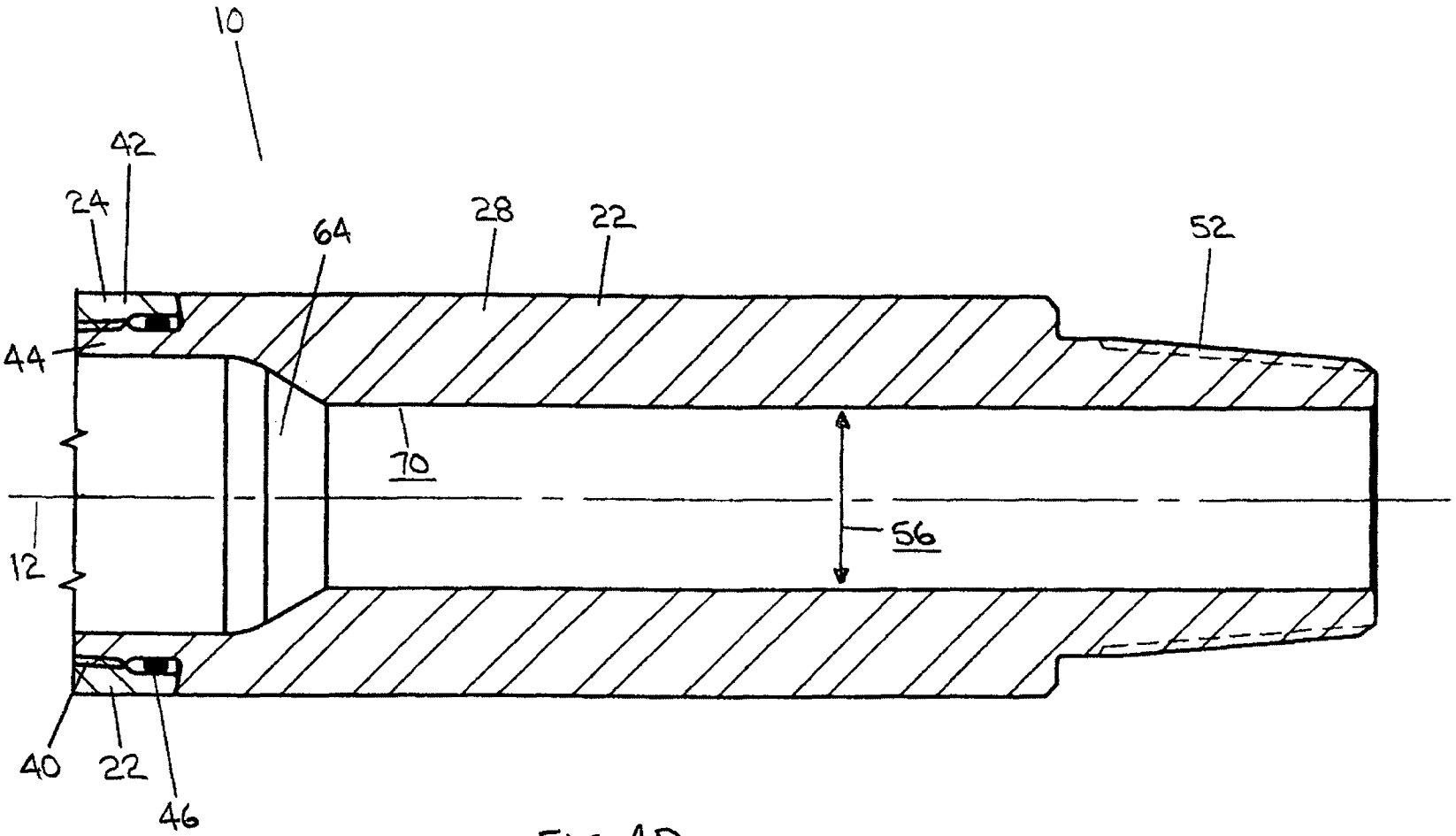
Figure 2:
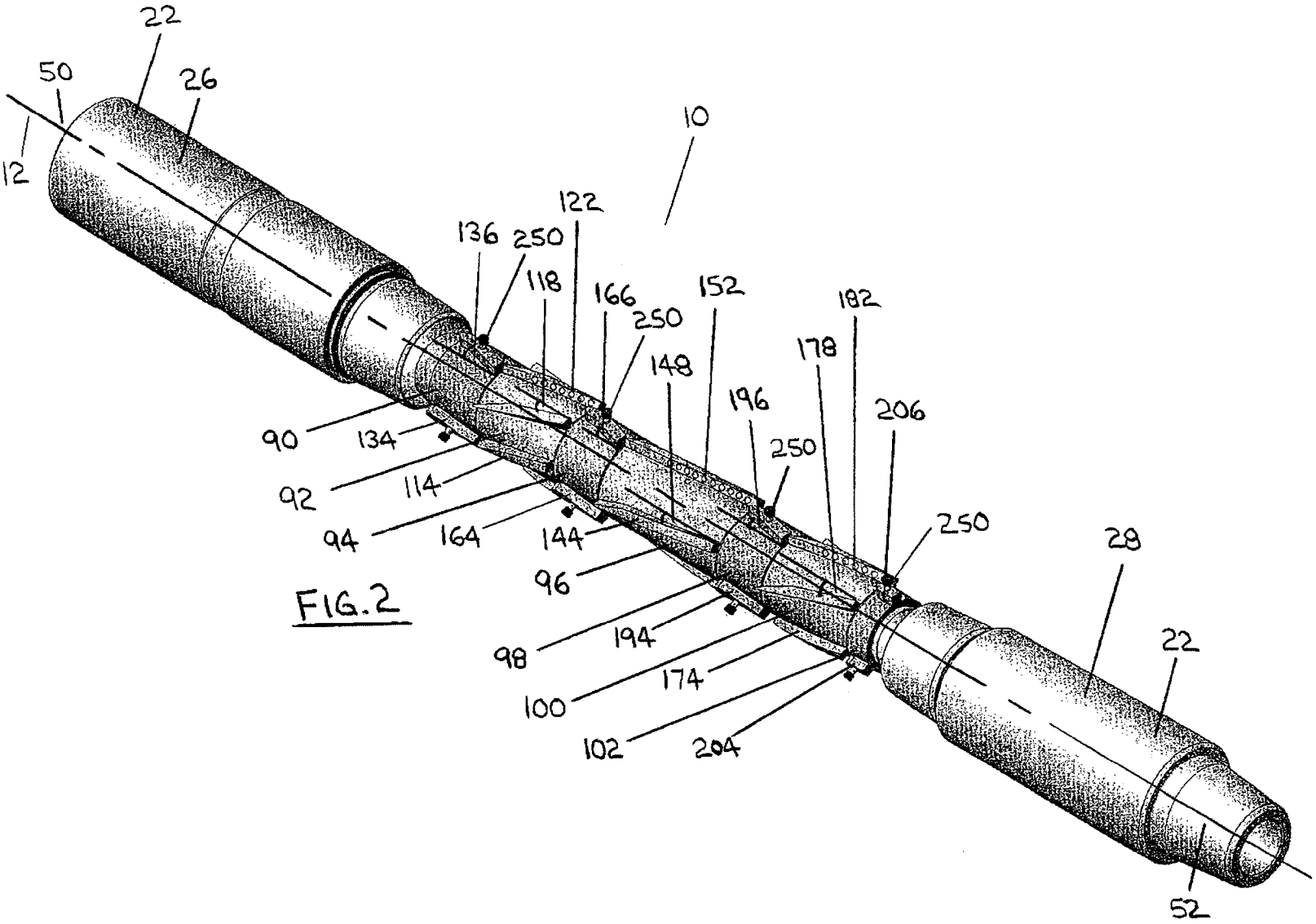
FIG. 2 is a partial cutaway complete pictorial view of the first exemplary embodiment of the vibration tool depicted in FIG. 1, in which the main housing has been removed to more clearly show components of the unbalanced turbine assembly.
Figure 3A:
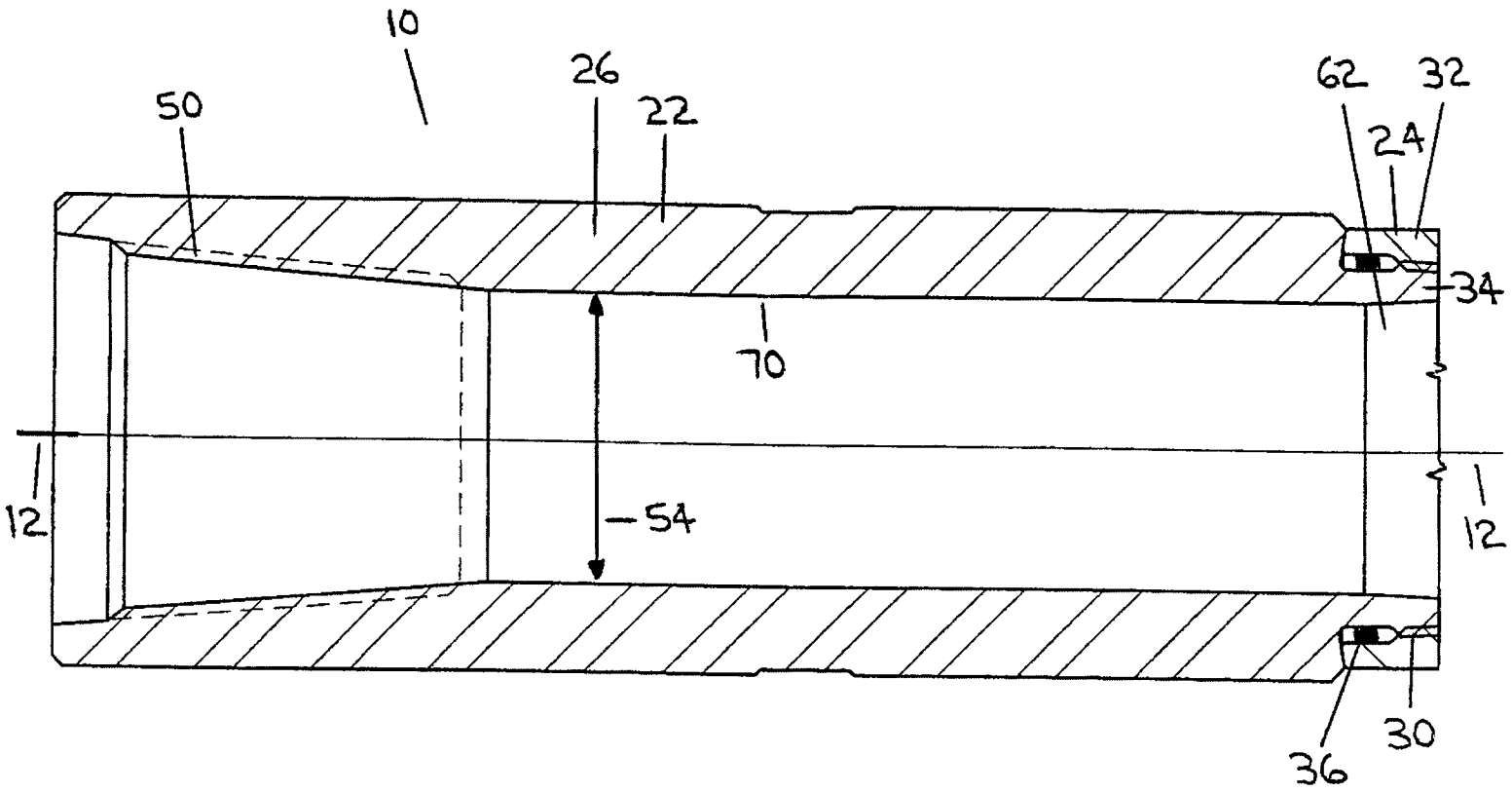
Figure 3B:
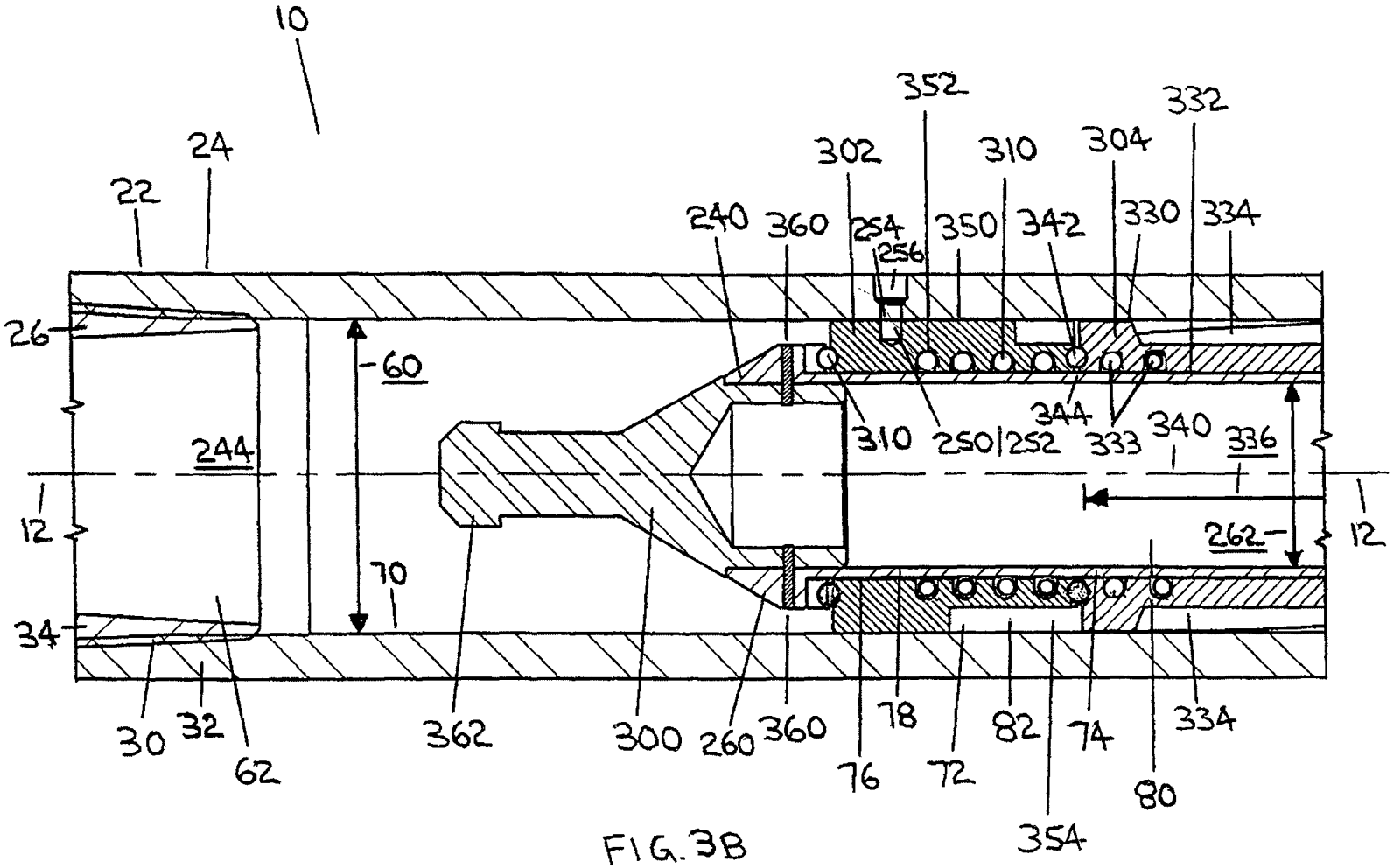
Figure 3C:
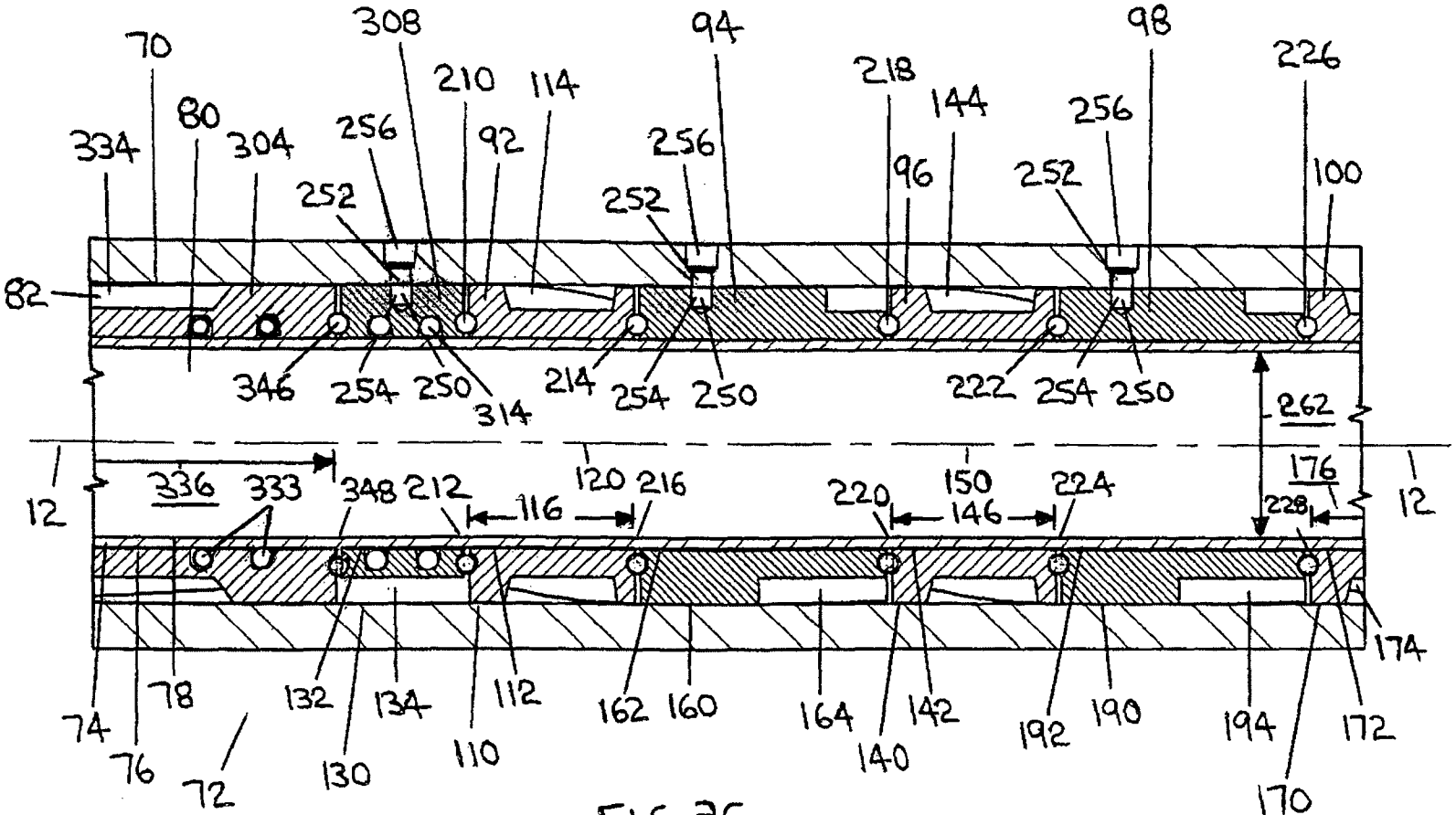
Figure 3D:
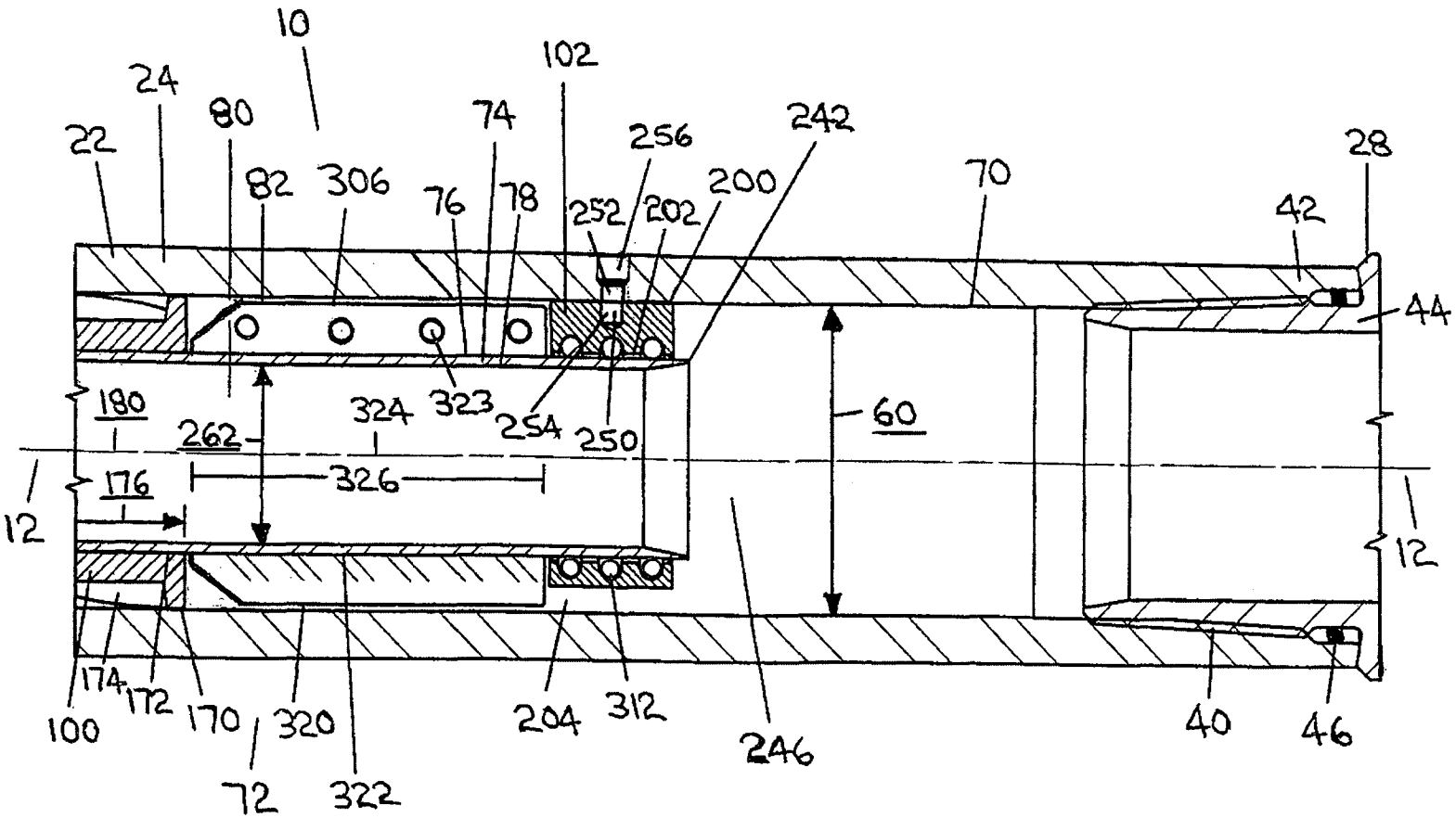
Figure 3E:
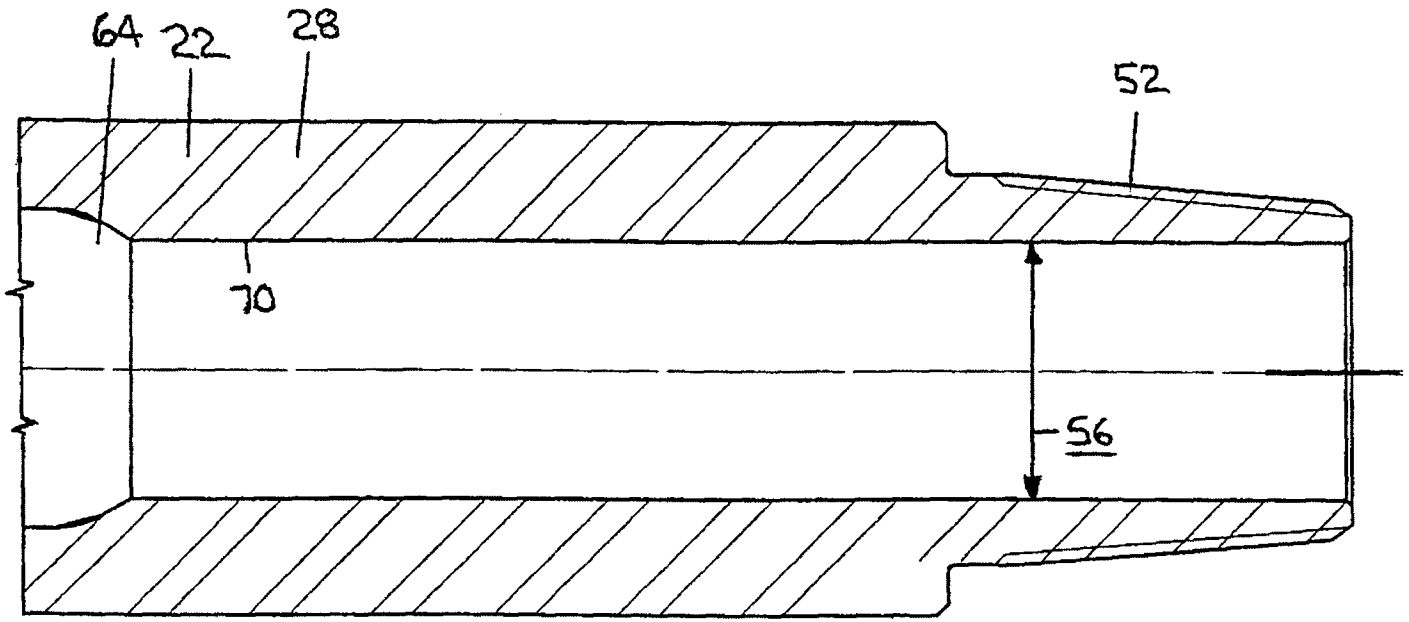

Referring to FIGS. 1-2, a first exemplary embodiment of the downhole vibration tool is depicted. FIG. 1 is a complete longitudinal section assembly drawing of the first exemplary embodiment. FIG. 2 is a partial cutaway complete pictorial view of the first exemplary embodiment.

Figure 4:
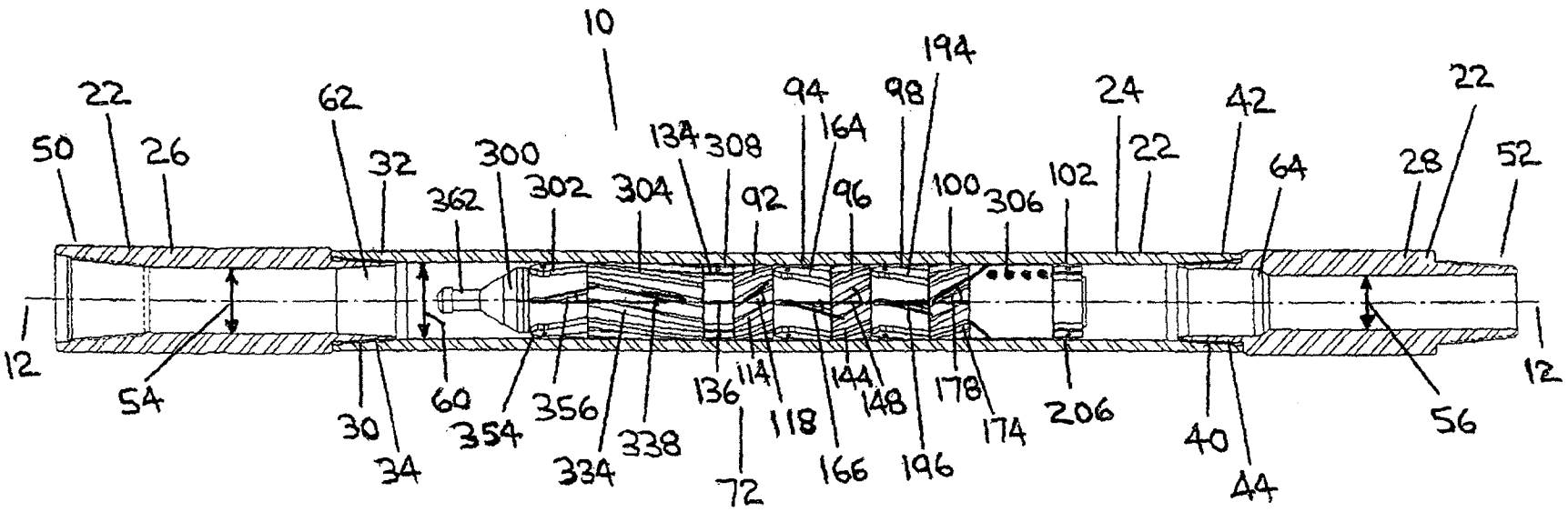
FIG. 4 is a partial cutaway elevation view of the second exemplary embodiment of the vibration tool depicted in FIG. 3, in which the main housing has been removed to more clearly show components of the unbalanced turbine assembly.
Figure 5:
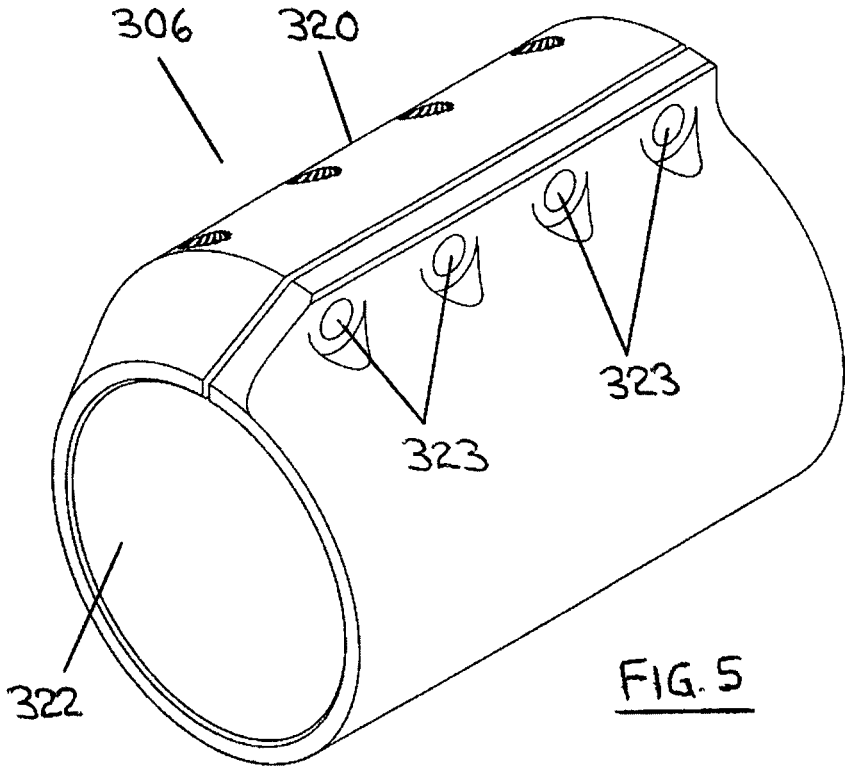
FIG. 5 is a pictorial view of an unbalanced weight which is suitable for use in the second exemplary embodiment of the vibration tool depicted in FIG. 3.
Figure 6:
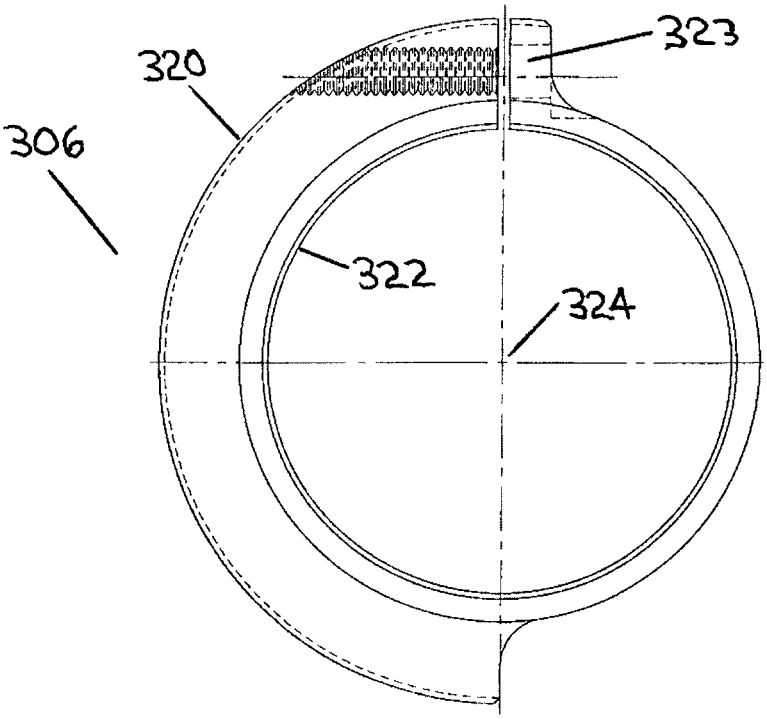
FIG. 6 is a transverse section view of the unbalanced weight depicted in FIG. 5.
Figure 7A:
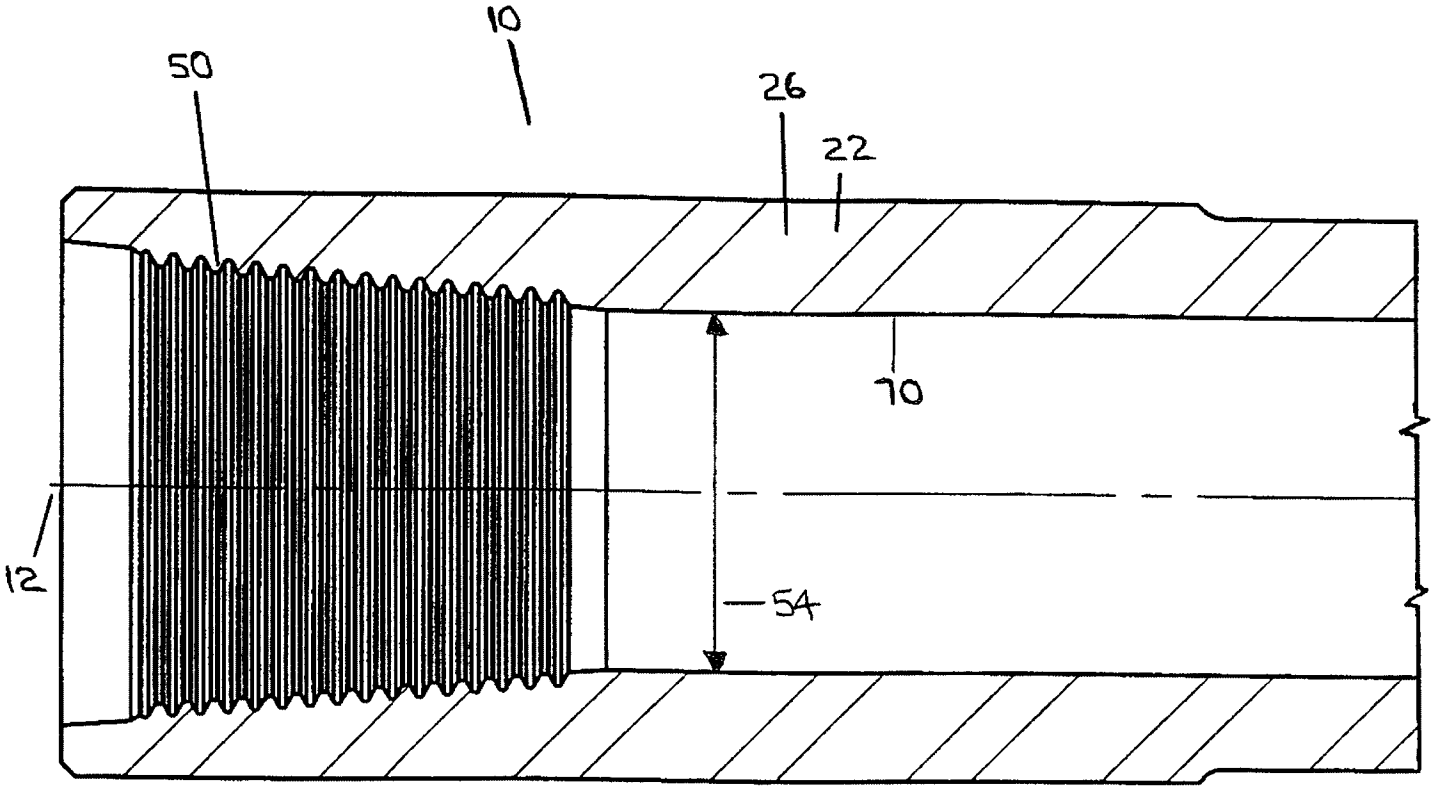
Figure 7B:
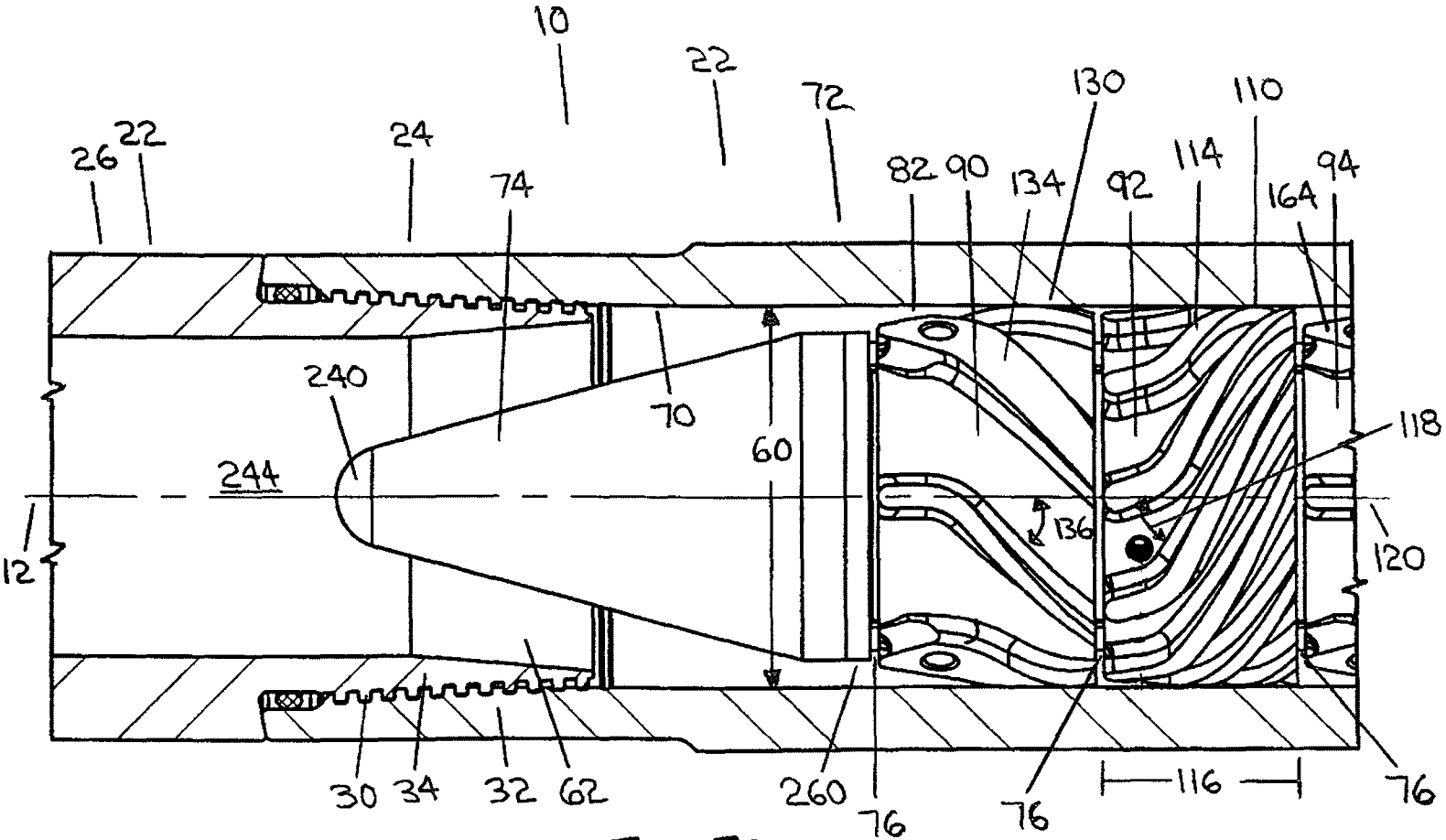
Figure 7C:
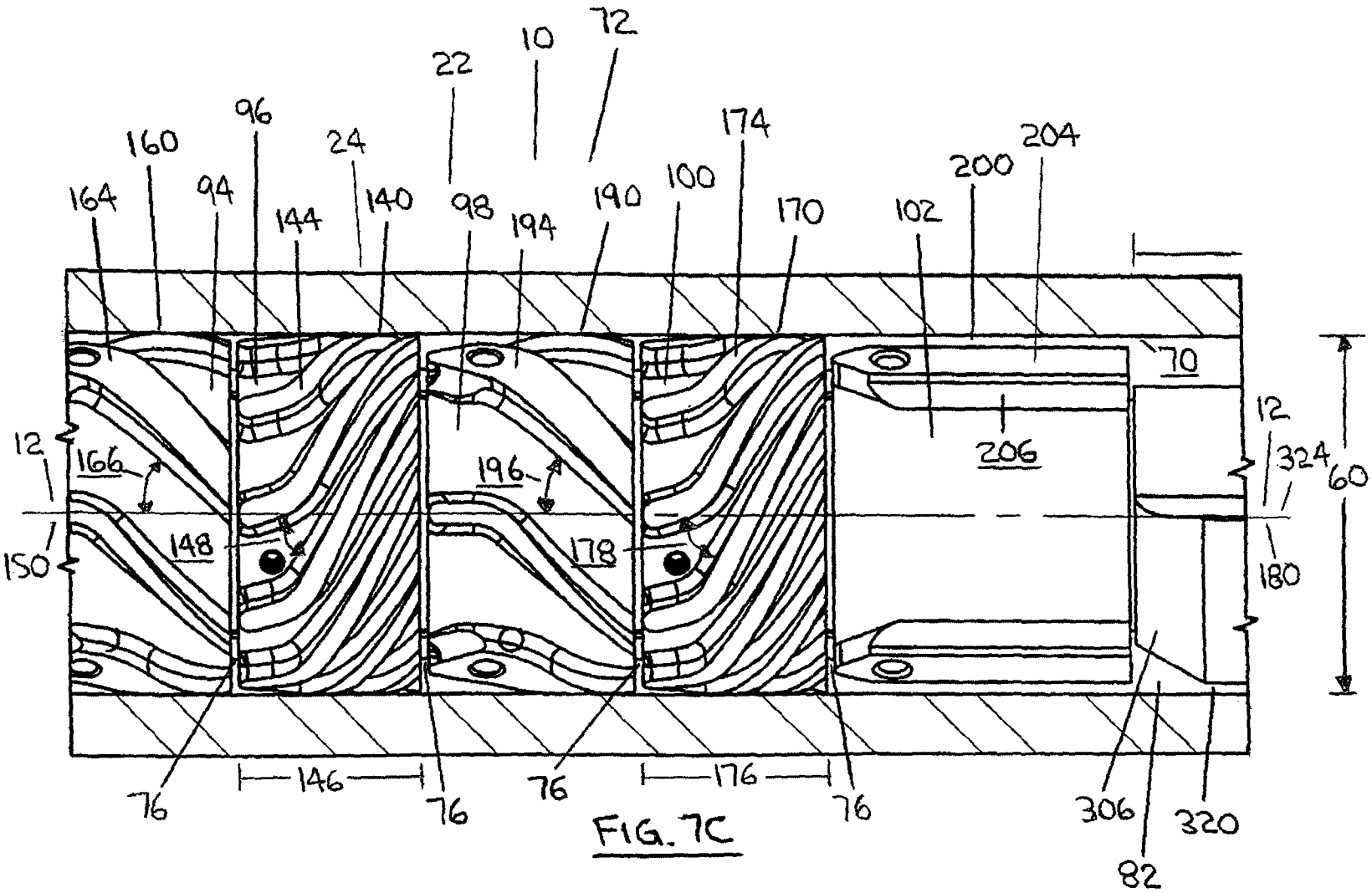
Figure 7D:
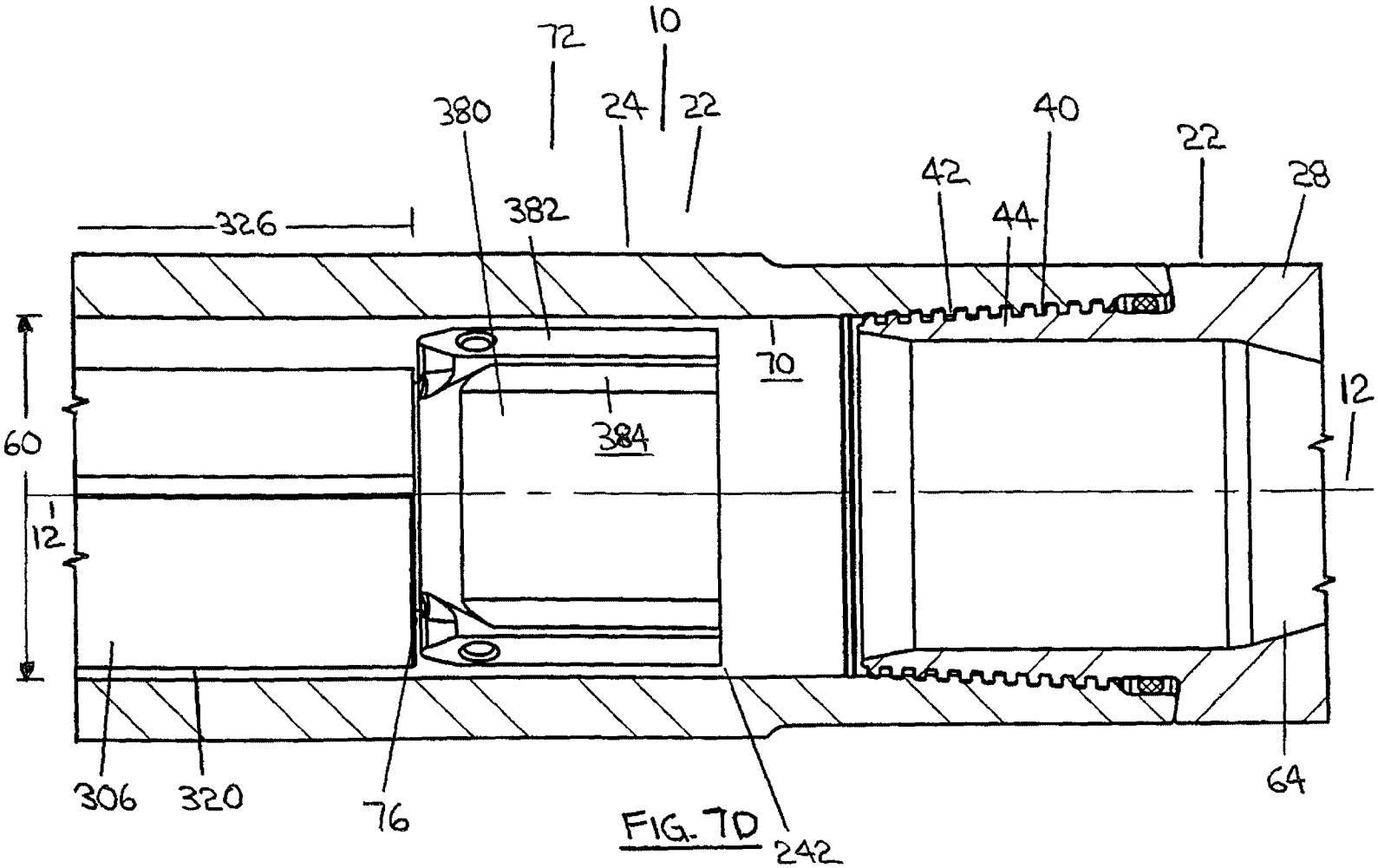
Figure 7E:
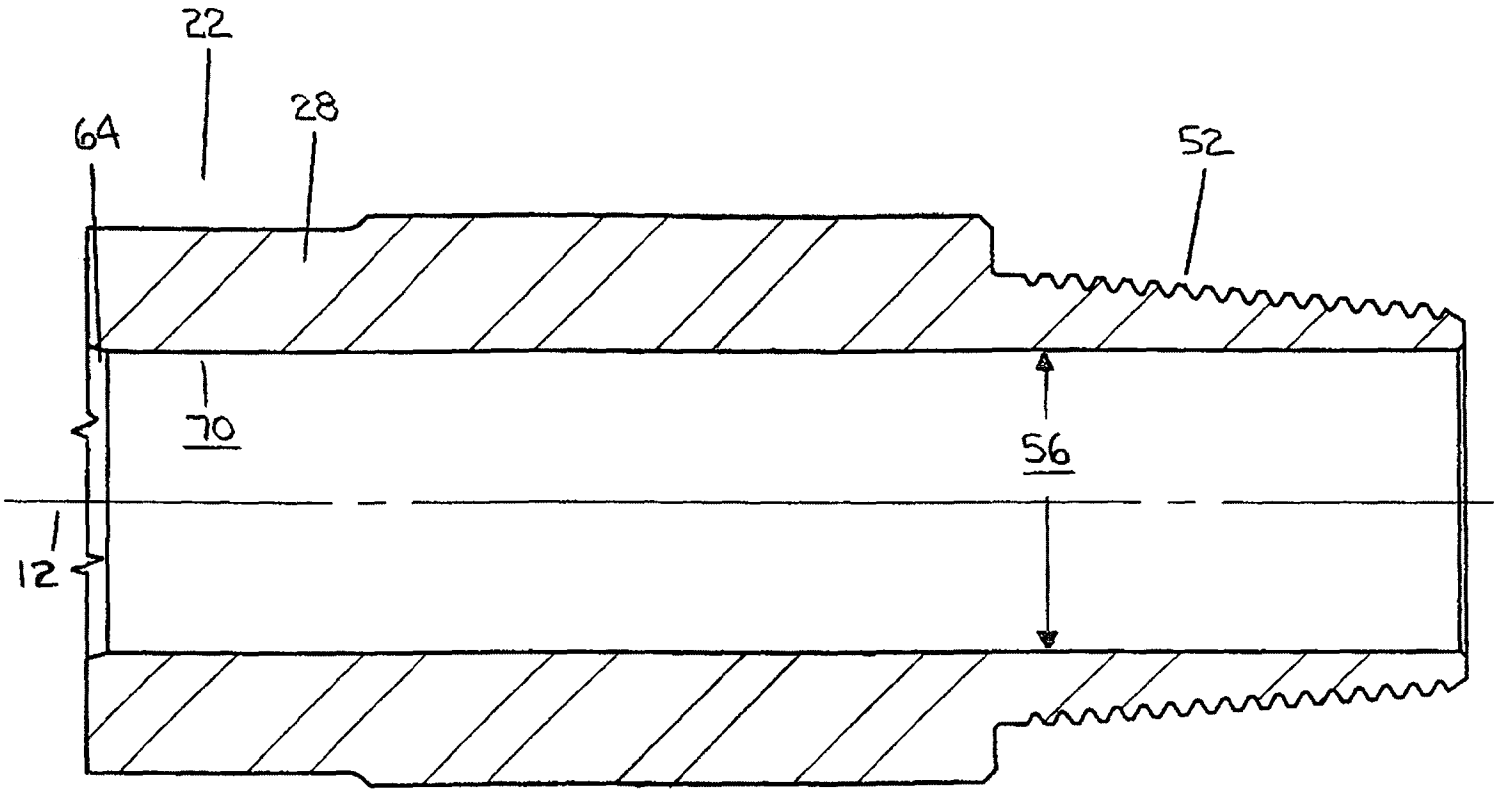

Referring to FIGS. 3-6, a second exemplary embodiment of the downhole vibration tool is depicted. FIG. 3 is a complete longitudinal section assembly drawing of the second exemplary embodiment. FIG. 4 is a partial cutaway complete pictorial view of the second exemplary embodiment. FIG. 5 is a pictorial view of an unbalanced weight which is suitable for use in the second exemplary embodiment. FIG. 6 is a transverse section view of the unbalanced weight depicted in FIG. 5.

Referring to FIG. 7, a third exemplary embodiment of the downhole vibration tool is depicted. FIG. 7 is a complete longitudinal partial section assembly drawing of the third exemplary embodiment.

The first exemplary embodiment of the downhole vibration tool is now described with reference to FIGS. 1-2.

Referring to FIG. 1, a downhole vibration tool (10) has a longitudinal tool axis (12). The vibration tool (10) is comprised of a housing (22). In the first exemplary embodiment of FIGS. 1-2, the housing (22) is comprised of a main housing (24), a proximal sub (26), and a distal sub (28).

The proximal sub (26) is connected with the main housing (24) with a threaded connection (30). In the first exemplary embodiment of FIGS. 1-2, the threaded connection (30) is comprised of a box connector (32) on the main housing (24) and a pin connector (34) on the proximal sub (26). An O-ring (36) is positioned between the box connector (32) and the pin connector (34) to provide a seal between the main housing (24) and the proximal sub (26).

The distal sub (28) is connected with the main housing (24) with a threaded connection (40). In the first exemplary embodiment of FIGS. 1-2, the threaded connection (40) is comprised of a box connector (42) on the main housing (24)

and a pin connector (44) on the distal sub (28). An O-ring (46) is positioned between the box connector (42) and the pin connector (44) to provide a seal between the main housing (24) and the distal sub (28).

The proximal sub (26) is comprised of a proximal threaded connector (50) for connecting the vibration tool (10) with a pipe string (not shown). In the first exemplary embodiment of FIGS. 1-2, the proximal threaded connector (50) is a box connector.

The distal sub (28) is comprised of a distal threaded connector (52) for connecting the vibration tool (10) with a pipe string (not shown). In the first exemplary embodiment of FIGS. 1-2, the distal threaded connector (52) is a pin connector.

The drill string (not shown) has a nominal inner diameter. The proximal sub (26) has a nominal inner diameter (54). The distal sub (28) has a nominal inner diameter (56). The proximal sub (26) and the distal sub (28) are configured so that the nominal inner diameter (54) of the proximal sub (26) and the nominal inner diameter (56) of the distal sub (28) are substantially similar to the nominal inner diameter of the drill string (not shown) with which the vibration tool (10) will be connected.

The main housing (24) has an inner diameter (60). The inner diameter (60) of the main housing (24) is larger than the nominal inner diameter (54) of the proximal sub (26) and the nominal inner diameter (56) of the distal sub (28). The proximal sub (26) is comprised of a proximal inner diameter transition (62) which provides a transition between the nominal inner diameter (54) of the proximal sub (26) and the inner diameter (60) of the main housing (24). The distal sub (28) is comprised of a distal inner diameter transition (64) which provides a transition between the nominal inner diameter (56) of the distal sub (28) and the inner diameter of the main housing (24).

The housing (22) has an inner housing surface (70). The housing (22) contains an unbalanced turbine assembly (72). The unbalanced turbine assembly (72) is comprised of a sleeve (74) which has an outer sleeve surface (76) and an inner sleeve surface (78). The inner sleeve surface (78) defines a sleeve bore (80) extending through the housing (22). The inner housing surface (70) and the outer sleeve surface (76) define an annular bore (82) extending through the housing (22).

The unbalanced turbine assembly (72) further comprises at least one annular turbine which is rotatably contained within the annular bore (82) and which is unbalanced relative to the longitudinal tool axis (12).

In the first exemplary embodiment of FIGS. 1-2, the unbalanced turbine assembly (72) is comprised of the sleeve (74), a first proximal support ring (90), a first annular turbine (92), a first intermediate support ring (94), a second annular turbine (96), a second intermediate support ring (98), a third annular turbine (100), and a third distal support ring (102).

The support rings (90, 94, 98, 102) and the annular turbines (92, 96, 100) are configured and arranged in the annular bore (82) so that a fluid (not shown) may pass through the annular bore (82). Stated otherwise, the support rings (90, 94, 98, 102) and the annular turbines (92, 96, 100) do not entirely block the annular bore (82).

The first annular turbine (92) is comprised of an annular structure having an outer surface (110) which is adjacent to the inner housing surface (70) and an inner surface (112) which is adjacent to the outer sleeve surface (76). The first annular turbine (92) is provided with sufficient clearance with respect to the inner housing surface (70) and the outer sleeve surface (76) to permit the first annular turbine (92) to rotate relatively freely within the annular bore (82).

In the first exemplary embodiment of FIGS. 1-2, a plurality of first turbine vanes (114) is located on the outer surface (110) of the first annular turbine (92). In the first exemplary embodiment of FIGS. 1-2, the first turbine vanes (114) are comprised of blades which extend along substantially the entire first turbine length (116) of the first annular turbine (92). The first turbine vanes (114) are arranged at an angle relative to the longitudinal tool axis (12) so that the first annular turbine (92) has a first turbine vane angle (118). The first turbine vanes (114) are tapered adjacent to the first proximal support ring (90) in order to reduce turbulence and energy losses as a fluid (not shown) passes into the first annular turbine (92).

The first annular turbine (92) is rotatable about a first turbine rotation axis (120) and is unbalanced relative to the longitudinal tool axis (12). In the first exemplary embodiment of FIGS. 1-2, the first turbine rotation axis (120) is substantially coincident with the longitudinal tool axis (12) and the first annular turbine (92) is unbalanced by configuring the mass of the first annular turbine (92) so that the center of mass is offset from the first turbine rotation axis (120).

In the first exemplary embodiment of FIGS. 1-2, the first annular turbine (92) is initially fabricated so that the center of mass is substantially coincident with the first turbine rotation axis (120) and is subsequently modified by adding and/or removing mass asymmetrically from the first annular turbine (92). As best depicted in FIG. 2, holes (122) are drilled in one of the first turbine vanes (114) so that the center of mass of the first annular turbine (92) is offset. These holes (122) may either be left as voids, or may be filled with a material which has a lesser or greater density than the material from which the first annular turbine (92) is fabricated in order to provide that the first annular turbine (92) is unbalanced.

The first proximal support ring (90) is comprised of an annular structure having an outer surface (130) which is adjacent to the inner housing surface (70) and an inner surface (132) which is adjacent to the outer sleeve surface (76).

In the first exemplary embodiment of FIGS. 1-2, a plurality of first diverter vanes (134) is located on the outer surface (130) of the first proximal support ring (90). In the first exemplary embodiment of FIGS. 1-2, the first diverter vanes (134) are comprised of blades which extend along the length of the first proximal support ring (90). The first diverter vanes (134) are arranged to have a first diverter vane angle (136) relative to the longitudinal tool axis (12).

The first diverter vane angle (136) is in a direction relative to the longitudinal tool axis (12) which is opposite to the first turbine vane angle (118). This configuration of the first diverter vane angle (136) and the first turbine vane angle (118) enables a fluid (not shown) passing through the annular bore (82) to impact the first turbine vanes (114) at a lower angle of incidence than if the first diverter vane angle (136) were parallel to the longitudinal tool axis (12) or in the same direction as the first turbine vane angle (118) relative to the longitudinal tool axis (12), thus potentially increasing the rotational energy which is imparted to the first annular turbine (92) by the fluid (not shown). In the first exemplary embodiment of FIGS. 1-2, the first diverter vane angle (136) may be minimized in order to minimize turbulence at the interface between the first proximal support ring (90) and the first annular turbine (92).

The second annular turbine (96) is comprised of an annular structure having an outer surface (140) which is adjacent to the inner housing surface (70) and an inner surface (142) which is adjacent to the outer sleeve surface (76). The second annular turbine (96) is provided with sufficient clearance with respect to the inner housing surface (70) and the outer sleeve surface (76) to permit the second annular turbine (96) to rotate relatively freely within the annular bore (82).

In the first exemplary embodiment of FIGS. 1-2, a plurality of second turbine vanes (144) is located on the outer surface (140) of the second annular turbine (96). In the first exemplary embodiment of FIGS. 1-2, the second turbine vanes (144) are comprised of blades which extend along substantially the entire second turbine length (146) of the second annular turbine (96). The second turbine vanes (144) are arranged at an angle relative to the longitudinal tool axis (12) so that the second annular turbine (96) has a second turbine vane angle (148). The second turbine vanes (144) are tapered adjacent to the first intermediate support ring (94) in order to reduce turbulence and energy losses as a fluid (not shown) passes into the second annular turbine (96).

The second annular turbine (96) is rotatable about a second turbine rotation axis (150) and is unbalanced relative to the longitudinal tool axis (12). In the first exemplary embodiment of FIGS. 1-2, the second turbine rotation axis (150) is substantially coincident with the longitudinal tool axis (12) and the second annular turbine (96) is unbalanced by configuring the mass of the second annular turbine (96) so that the center of mass is offset from the second turbine rotation axis (150).

In the first exemplary embodiment of FIGS. 1-2, the second annular turbine (96) is initially fabricated so that the center of mass is substantially coincident with the second turbine rotation axis (150) and is subsequently modified by adding and/or removing mass asymmetrically from the second annular turbine (96). As best depicted in FIG. 2, holes (152) are drilled in one of the second turbine vanes (144) so that the center of mass of the second annular turbine (96) is offset. These holes (152) may either be left as voids, or may be filled with a material which has a lesser or greater density than the material from which the second annular turbine (96) is fabricated in order to provide that the second annular turbine (96) is unbalanced.

The first intermediate support ring (94) is comprised of an annular structure having an outer surface (160) which is adjacent to the inner housing surface (70) and an inner surface (162) which is adjacent to the outer sleeve surface (76).

In the first exemplary embodiment of FIGS. 1-2, a plurality of second diverter vanes (164) is located on the outer surface (160) of the first intermediate support ring (94). In the first exemplary embodiment of FIGS. 1-2, the second diverter vanes (164) are comprised of blades which extend along the length of the first intermediate support ring (94). The second diverter vanes (164) are arranged to have a second diverter vane angle (166) relative to the longitudinal tool axis (12).

The second diverter vane angle (166) is in a direction relative to the longitudinal tool axis (12) which is opposite to the second turbine vane angle (148). This configuration of the second diverter vane angle (166) and the second turbine vane angle (148) enables a fluid (not shown) passing through the annular bore (82) to impact the second turbine vanes (144) at a lower angle of incidence than if the second diverter vane angle (166) were parallel to the longitudinal tool axis (12) or in the same direction as the second turbine vane angle (148) relative to the longitudinal tool axis (12), thus potentially increasing the rotational energy which is imparted to the second annular turbine (96) by the fluid (not shown). In the first exemplary embodiment of FIGS. 1-2, the second diverter vane angle (166) may be minimized in order to minimize turbulence at the interfaces between the first intermediate support ring (94) and the first annular turbine (92) and the second annular turbine (96).

The third annular turbine (100) is comprised of an annular structure having an outer surface (170) which is adjacent to the inner housing surface (70) and an inner surface (172) which is adjacent to the outer sleeve surface (76). The third annular turbine (100) is provided with sufficient clearance with respect to the inner housing surface (70) and the outer sleeve surface (76) to permit the third annular turbine (100) to rotate relatively freely within the annular bore (82).

In the first exemplary embodiment of FIGS. 1-2, a plurality of third turbine vanes (174) is located on the outer surface (170) of the third annular turbine (100). In the first exemplary embodiment of FIGS. 1-2, the third turbine vanes (174) are comprised of blades which extend along substantially the entire third turbine length (176) of the third annular turbine (100). The third turbine vanes (174) are arranged at an angle relative to the longitudinal tool axis (12) so that the third annular turbine (100) has a third turbine vane angle (178). The third turbine vanes (174) are tapered adjacent to the second intermediate support ring (98) in order to reduce turbulence and energy losses as a fluid (not shown) passes into the third annular turbine (100).

The third annular turbine (100) is rotatable about a third turbine rotation axis (180) and is unbalanced relative to the longitudinal tool axis (12). In the first exemplary embodiment of FIGS. 1-2, the third turbine rotation axis (180) is substantially coincident with the longitudinal tool axis (12) and the third annular turbine (100) is unbalanced by configuring the mass of the third annular turbine (100) so that the center of mass is offset from the third turbine rotation axis (180).

In the first exemplary embodiment of FIGS. 1-2, the third annular turbine (100) is initially fabricated so that the center of mass is substantially coincident with the third turbine rotation axis (180) and is subsequently modified by adding and/or removing mass asymmetrically from the third annular turbine (100). As best depicted in FIG. 2, holes (182) are drilled in one of the third turbine vanes (174) so that the center of mass of the third annular turbine (100) is offset. These holes (182) may either be left as voids, or may be filled with a material which has a lesser or greater density than the material from which the third annular turbine (100) is fabricated in order to provide that the third annular turbine (100) is unbalanced.

The second intermediate support ring (98) is comprised of an annular structure having an outer surface (190) which is adjacent to the inner housing surface (70) and an inner surface (192) which is adjacent to the outer sleeve surface (76).

In the first exemplary embodiment of FIGS. 1-2, a plurality of third diverter vanes (194) is located on the outer surface (190) of the second intermediate support ring (98). In the first exemplary embodiment of FIGS. 1-2, the third diverter vanes (194) are comprised of blades which extend along the length of the second intermediate support ring (98). The third diverter vanes (194) are arranged to have a third diverter vane angle (196) relative to the longitudinal tool axis (12).

The third diverter vane angle (196) is in a direction relative to the longitudinal tool axis (12) which is opposite to the third turbine vane angle (178). This configuration of the third diverter vane angle (196) and the third turbine vane angle (178) enables a fluid (not shown) passing through the annular bore (82) to impact the third turbine vanes (174) at a lower angle of incidence than if the third diverter vane angle (196) were parallel to the longitudinal tool axis (12) or in the same direction as the third turbine vane angle (178) relative to the longitudinal tool axis (12), thus potentially increasing the rotational energy which is imparted to the third annular turbine (100) by the fluid (not shown). In the first exemplary embodiment of FIGS. 1-2, the third diverter vane angle (196)

may be minimized in order to minimize turbulence at the interfaces between the second intermediate support ring (98) and the second annular turbine (96) and the third annular turbine (100).

The third distal support ring (102) is comprised of an annular structure having an outer surface (200) which is adjacent to the inner housing surface (70) and an inner surface (202) which is adjacent to the outer sleeve surface (76).

In the first exemplary embodiment of FIGS. 1-2, a plurality of distal diverter vanes (204) is located on the outer surface (200) of the third distal support ring (102). In the first exemplary embodiment of FIGS. 1-2, the distal diverter vanes (204) are comprised of blades which extend along the length of the third distal support ring (102). The distal diverter vanes (204) are arranged to be substantially parallel with the longitudinal tool axis (12) in order to direct a fluid (not shown) passing through the annular bore (82) in a direction which is substantially parallel with the longitudinal tool axis (12), so that a distal diverter vane angle (206) is substantially zero.

In the first exemplary embodiment of FIGS. 1-2, the first intermediate support ring (94) provides a combined first distal support ring and second proximal support ring, and the second intermediate support ring (98) provides a combined second distal support ring and third proximal support ring.

In the first exemplary embodiment of FIGS. 1-2, a proximal first turbine bearing (210) is located between the first proximal support ring (90) and a proximal first turbine end (212) of the first annular turbine (92), a distal first turbine bearing (214) is located between a distal first turbine end (216) of the first annular turbine (92) and the first intermediate support ring (94), a proximal second turbine bearing (218) is located between the first intermediate support ring (94) and a proximal second turbine end (220) of the second annular turbine (96), a distal second turbine bearing (222) is located between a distal second turbine end (224) of the second annular turbine (96) and the second intermediate support ring (98), a proximal third turbine bearing (226) is located between the second intermediate support ring (98) and a proximal third turbine end (228) of the third annular turbine (100), and a distal third turbine bearing (230) is located between a distal third turbine end (232) of the third annular turbine (100) and the third distal support ring (102).

Referring to FIGS. 1-2, the sleeve (74) has a proximal sleeve end (240) and a distal sleeve end (242).

In the first exemplary embodiment of FIGS. 1-2, an inlet (244) is defined by the proximal sleeve end (240), the first proximal support ring (90) and the proximal inner diameter transition (62), so that a fluid (not shown) passing through the proximal sub (26) can be introduced into the sleeve bore (80) and the annular bore (82). As depicted in FIGS. 1-2, the proximal sleeve end (240) and the first proximal support ring (90) are tapered adjacent to the inlet (244) in order to reduce turbulence and energy losses at the inlet (244).

In some embodiments, a flow control device (not shown in FIGS. 1-2) may be associated with the inlet (244) so that a fluid (not shown) may be selectively directed through the sleeve bore (80) and/or the annular bore (82).

In the first exemplary embodiment of FIGS. 1-2, an outlet (246) is defined by the distal sleeve end (242), the third distal support ring (102) and the distal inner diameter transition (64), so that a fluid (not shown) passing through the sleeve bore (80) and the annular bore (82) can be discharged into the distal sub (28).

As previously indicated, in the first exemplary embodiment of FIGS. 1-2, the unbalanced turbine assembly (72) is comprised of the sleeve (74), the first proximal support ring (90), the first annular turbine (92), the first intermediate support ring (94), the second annular turbine (96), the second intermediate support ring (98), the third annular turbine (100), and the third distal support ring (102).

In the first exemplary embodiment of FIGS. 1-2, the unbalanced turbine assembly (72) is configured so that it may be inserted into the main housing (24) and removed from the main housing (24) fully assembled.

In the first exemplary embodiment of FIGS. 1-2, the sleeve (74) is connected with the first proximal support ring (90) by an interference fit between the inner surface (132) of the first proximal support ring (90) and the outer sleeve surface (76). Optionally, the sleeve may also be connected by interference fits between the outer sleeve surface (76) and the first intermediate support ring (94), the second intermediate support ring (98) and/or the third distal support ring (102).

Alternatively, the sleeve (74) may be fixedly connected with one or more of the first proximal support ring (90), the first intermediate support ring (94), the second intermediate support ring (98) and/or the third distal support ring (102). The sleeve (74) may be fixedly connected with one or more of the support rings (90, 94, 98, 102) in any suitable manner.

The unbalanced turbine assembly (72) may be connected with the housing (22) by connecting the first proximal support ring (90), the first intermediate support ring (94), the second intermediate support ring (98) and/or the third distal support ring (102) with the main housing (24). For example, the unbalanced turbine assembly (72) may be fixedly connected with one or more of the support rings (90, 94, 98, 102) in any suitable manner.

In the first exemplary embodiment of FIGS. 1-2, each of the first proximal support ring (90), the first intermediate support ring (94), the second intermediate support ring (98) and the third distal support ring (102) are fixedly connected with the main housing (24) with one or more dowels (250) which extend through dowel bores (252) in the main housing (24) and into corresponding dowel bores (254) in the support rings (90, 94, 98, 102). Following installation of the dowels (250), pipe plugs (256) may be inserted into the dowel bores (252) to seal the dowel bores (252).

In the first exemplary embodiment of FIGS. 1-2, the proximal sleeve end (240) is comprised of a projection (260) for engaging with the first proximal support ring (90) in order to limit the movement of the sleeve (74) relative to the first proximal support ring (90). In the first exemplary embodiment of FIGS. 1-2, the projection (260) is comprised of a radially extending lip or rim at the proximal sleeve end (240).

As a result, in the first exemplary embodiment of FIGS. 1-2, the unbalanced turbine assembly (72) may be assembled by sliding the annular turbines (92, 96, 100) and the support rings (90, 94, 98, 102) onto the sleeve (74) from the distal sleeve end (242) in sequence, beginning with the first proximal support ring (90).

In order to complete the assembly of the vibration tool (10), the unbalanced turbine assembly (72) may be inserted into the main housing (24) from either end and may be secured to the main housing (24) with the dowels (250) and pipe plugs (256). One of the proximal sub (26) and the distal sub (28) may be threaded onto the main housing (24) before the unbalanced turbine assembly (72) is inserted into the main housing (24), but the other of the subs (26, 28) is threaded onto the main housing (24) after the unbalanced turbine assembly (72) is inserted into the main housing (24).

In order to disassemble the vibration tool (10), one of the proximal sub (26) and the distal sub (28) may be unthreaded from the main housing (24), the pipe plugs (256) and dowels (250) may be removed from the main housing (24), and the unbalanced turbine assembly (72) may be removed from the main housing (24). In the event that the unbalanced turbine assembly (72) becomes stuck in the main housing (24), the sleeve (74) may be removed from the main housing (24) separately from the other components of the unbalanced turbine assembly (72) by pulling on the proximal sleeve end (240) after unthreading the proximal sub (26) from the main housing (24).

The ease of assembly and disassembly of the vibration tool (10) facilitates servicing the vibration tool (10) and/or replacing or substituting parts of the vibration tool (10).

The configuration of the unbalanced turbine assembly (72) supports the ease of assembly and disassembly of the vibration tool (10), enables the annular turbines (92, 96, 100) to be supported within the main housing (24) by the main housing (24), the sleeve (74) and the support rings (90, 94, 98, 102), and may assist in transmitting vibration produced by the annular turbines (92, 96, 100) to the main housing (24).

The sleeve (74) as a component of the unbalanced turbine assembly (72) provides several purposes. First, the sleeve (74) facilitates the assembly and disassembly of the vibration tool (10) by providing a structure upon which to assemble the components of the unbalanced turbine assembly (72). Second, the sleeve (74) serves as a barrier between the sleeve bore (80) and the inner surfaces (112, 142, 172) of the annular turbines (92, 96, 100) and thus prevents fluid (not shown) passing through the sleeve bore (80) from interfering with the rotation of the annular turbines (92, 96, 100). Third, the sleeve (74) may assist in protecting the turbine bearings (210, 214, 218, 222, 226, 230) by reducing fluid flow through the bearings (210, 214, 218, 222, 226, 230) from the inner surfaces (112, 142, 172) of the annular turbines and/or the inner surfaces (132, 162, 192, 202) of the support rings (90, 94, 98, 102). Fourth, the tapered proximal sleeve end (240) may assist in directing fluid (not shown) into the annular bore (82) at the inlet (244).

The sleeve (74) has a sleeve bore diameter (262). In the first exemplary embodiment of FIGS. 1-2, the sleeve bore diameter (262) is maximized in order to enable fluid (not shown) and tools (not shown) to pass through the sleeve bore (80) and the vibration tool (10) without significant restriction.

In the first exemplary embodiment of FIGS. 1-2, the sleeve bore diameter (262) may be configured to be substantially identical to or within a desired ratio to the nominal inner diameter (54) of the proximal sub (26) and/or the nominal inner diameter (56) of the distal sub (28).

This configuration may be achieved by providing the main housing (24) with a larger outer dimension than the proximal sub (26) and/or the distal sub (28), and/or by providing the main housing (24) with an increased inner diameter (60) in order to accommodate the unbalanced turbine assembly (72) therein.

In achieving this configuration, a balance must be sought between providing an acceptable sleeve bore diameter (262) and providing a suitable ratio between the cross-sectional area of the sleeve bore (80) and the cross-sectional area of the annular bore (82), since a suitable amount of fluid (not shown) must pass through the annular bore (82) in order to drive the annular turbines (92, 96, 100).

In the first exemplary embodiment of FIGS. 1-2, a goal in configuring the vibration tool (10) is to provide that at least about 25 percent of the fluid (not shown) which passes through the vibration tool (10) passes through the annular bore (82), so that no greater than about 75 percent of the fluid (not shown) which passes through the vibration tool (10) passes through the sleeve bore (80). As a result, in the first exemplary embodiment of FIGS. 1-2, the main housing (24), the sleeve (74), the annular turbines (92, 96, 100) and the support rings (90, 94, 98, 102) are configured to provide that an adequate amount of the fluid (not shown) passes through the annular bore (82).

In the first exemplary embodiment of FIGS. 1-2, the vibration tool (10) is comprised of three annular turbines (92, 96, 100). In other embodiments, the vibration tool (10) may be comprised of one annular turbine, two annular turbines, or more than three annular turbines. Each of the annular turbines which may be included in the vibration tool (10) may be configured to provide a desired vibration frequency and a desired vibration amplitude when supplied with a design fluid energy.

The vibration frequency which is provided by an annular turbine is dependent at least in part upon the turbine rotation rate of the annular turbine. The vibration amplitude which is provided by an annular turbine is dependent at least in part upon the turbine torque which is generated by the annular turbine during rotation. The vibration frequency and the vibration amplitude of an annular turbine is dependent at least in part upon the fluid energy which is provided to the annular turbine.

The desired vibration frequencies of the annular turbines may be the same or may be different from each other. The desired vibration frequencies of the annular turbines may be selected to cancel unwanted vibration frequencies in the pipe string (not shown) and/or to impart one or more vibration frequencies to the pipe string (not shown) to reduce the likelihood of the pipe string (not shown) becoming stuck in a borehole (not shown).

In the first exemplary embodiment of FIGS. 1-2, the first annular turbine (92) is configured to rotate at a first turbine rotation rate at a design fluid energy in order to provide a desired vibration frequency, the second annular turbine (96) is configured to rotate at a second turbine rotation rate at the desired fluid energy in order to provide a desired vibration frequency, and the third annular turbine (100) is configured to rotate at a third turbine rotation rate at the desired fluid energy in order to provide a desired vibration frequency.

In the first exemplary embodiment of FIGS. 1-2, the first turbine rotation rate, the second turbine rotation rate and the third turbine rotation rate are preferably different from each other. For example, it is believed that a vibration frequency of about 19.2 Hz (about 1150 rpm) which is imparted to a pipe string (not shown) may not significantly interfere with telemetry systems which may be used with the pipe string (not shown), but vibration frequencies above and below about 19.2 Hz (about 1150 rpm) may significantly interfere with telemetry systems and may thus be considered to be unwanted vibration frequencies.

As a result, in the first exemplary embodiment of FIGS. 1-2, one of the annular turbines (92, 96, 100) may be configured to rotate at a turbine rotation rate which will produce a desired vibration frequency in the pipe string (not shown) which is greater than 19.2 Hz (about 1150 rpm), one of the annular turbines (92, 96, 100) may be configured to rotate at a turbine rotation rate which will produce a desired vibration frequency in the pipe string (not shown) which is less than 19.2 Hz (about 1150 rpm), and one of the annular turbines (92, 96, 100) may be configured to rotate at a turbine rotation rate which will produce a desired vibration frequency in the pipe string (not shown) which is about equal to about 19.2 Hz (about 1150 rpm).

More particularly, in the first exemplary embodiment of FIGS. 1-2, the first annular turbine (92) may be configured to rotate at a first turbine rotation rate which will produce a desired vibration frequency in the pipe string (not shown) which is greater than 19.2 Hz (about 1150 rpm), the third annular turbine (100) may be configured to rotate at a third turbine rotation rate which will produce a desired vibration frequency in the pipe string (not shown) which is less than 19.2 Hz (about 1150 rpm), and the second annular turbine (96) may be configured to rotate at a second turbine rotation rate which will produce a desired vibration frequency in the pipe string (not shown) which is about equal to about 19.2 Hz (about 1150 rpm).

The turbine rotation rate is dependent at least in part upon both the turbine vane angle and the associated diverter vane angle. For example, the first turbine rotation rate is dependent at least in part upon the first turbine vane angle (118) and the first diverter vane angle (136), the second turbine rotation rate is dependent at least in part upon the second turbine vane angle (148) and the second diverter vane angle (166), and the third turbine rotation rate is dependent at least in part upon the third turbine vane angle (178) and the third diverter vane angle (196).

In general, the lower the angle of incidence between the fluid (not shown) and the turbine vanes when the fluid (not shown) impacts the turbine vanes (and thus the greater the combined turbine vane angle and diverter vane angle), the higher the turbine rotation rate. As a result, the turbine rotation rate of an annular turbine may generally be increased by increasing the turbine vane angle and/or the associated diverter vane angle, and may generally be decreased by decreasing the turbine vane angle and/or the associated diverter vane angle.

The turbine rotation rate of an annular turbine may also be dependent upon other factors, including but not limited to the number of turbine vanes, the length of the turbine vanes, the height of the turbine vanes, and the shape of the turbine vanes, the length of the annular turbine, and the mass of the annular turbine.

In the first exemplary embodiment of FIGS. 1-2, the first annular turbine (92) is configured to generate a first turbine torque at a design fluid energy, the second annular turbine (96) is configured to generate a second turbine torque at the desired fluid energy, and the third annular turbine (100) is configured to generate a third turbine torque at the desired fluid energy.

In the first exemplary embodiment of FIGS. 1-2, the annular turbines (92, 96, 100) may be configured so that the first turbine torque, the second turbine torque and the third turbine torque are either similar to each other or different from each other.

The turbine torque which is generated by an annular turbine during rotation is dependent at least in part upon the turbine length. An annular turbine having a relatively longer turbine length will generally generate more torque than an annular turbine having a relatively shorter turbine length because a longer annular turbine provides greater opportunity for fluid energy to be transferred to the annular turbine as the fluid (not shown) passes around and/or through the annular turbine.

For example, in the first exemplary embodiment of FIGS. 1-2, the second turbine length (146) may be longer than the first turbine length (116) and/or the third turbine length (176) so that the second annular turbine (96) may be configured to generate a second turbine torque which is greater than the first turbine torque and/or the third turbine torque. This configuration may enable the vibration tool (10) to provide a higher vibration energy for vibrating the pipe string (not shown) than is provided for cancelling unwanted vibrations in the pipe string (not shown).

The turbine torque generated by an annular turbine may also be dependent upon other factors, including but not limited to the number of turbine vanes, the length of the turbine vanes, the height of the turbine vanes, the shape of the turbine vanes, and the mass of the annular turbine. The vibration amplitude of an annular turbine may also be dependent upon the magnitude of the imbalance of the annular turbine.

As indicated above, the desired vibration frequency and the desired vibration amplitude of an annular turbine is dependent at least in part upon a design fluid energy. The design fluid energy may be expressed as the amount of fluid energy to which the vibration tool (10) is expected to be exposed during operation. The design fluid energy is dependent upon the fluid energy requirements and/or limits of the operation which is being conducted in the borehole (not shown) and/or of the components which are included in the pipe string (not shown).

For example, a drilling motor (not shown) may be designed to operate at a maximum fluid flowrate through the drilling motor (not shown). This maximum fluid flow rate may provide an indication of the amount of fluid energy to which the vibration tool (10) may be exposed during operation. The actual fluid energy to which the vibration tool (10) may be exposed during operation may, in addition to the flowrate of the fluid, be influenced by other factors including the pressure, density and temperature of the fluid.

Using empirical data, charts or tables which correlate fluid flow rates (or fluid energy) with rotation rates and vane angles, a combination of turbine vane angle and diverter vane angle can be determined which will provide a desired turbine rotation rate and thus vibration frequency. This combination of turbine vane angle and diverter vane angle should take into account the relative amounts of fluid (not shown) which can be expected to pass through the sleeve bore (80) and the annular bore (82) during operation of the vibration tool (10).

In practice, it may be very difficult to attain or maintain a specific design fluid energy during the operation of the vibration tool (10). As a result, the vibration tool (10) may be configured to operate within a range of vibration frequencies which may conceivably be controlled by the operator of the pipe string during operation of the vibration tool (10) by adjusting the fluid flow rate through the vibration tool (10) within a range of fluid flow rates, or by otherwise controlling the components of the pipe string (not shown).

An exemplary configuration for the vibration tool (10) in the first exemplary embodiment of FIGS. 1-2 is as follows.

The nominal outer diameter of the vibration tool (10) may be 4.875 inches (about 12.4 centimeters). The nominal inner diameter of the pipe string (not shown) may be 2.25 inches (about 5.7 centimeters). In the exemplary configuration, the vibration tool (10) may be configured to be used in a pipe string (not shown) which includes a positive displacement drilling motor having a nominal outer diameter of 4.75 inches (about 12.1 centimeters) and which is designed for a maximum fluid flow rate of about 275 U.S. gallons per minute (about 1040 liters per minute).

The nominal inner diameter (54) of the proximal sub (26) may be about 3.0 inches (about 7.6 centimeters). The nominal inner diameter (56) of the distal sub (28) may be about 2.25 inches (about 5.7 centimeters). The inner diameter (60) of the main housing (24) may be about 3.8 inches (about 9.7 centimeters). The sleeve bore diameter (262) may be about 2.25 inches (about 5.7 centimeters). The diameter of the outer sleeve surface (76) may be about 2.50 inches (about 6.4 centimeters).

The vibration tool (10) may have an overall length of about 60 inches (about 150 centimeters). The length of the first proximal support ring (90) may be about 3.5 inches (about 8.9 centimeters). The first turbine length (116) may be about 4 inches (about 10.2 centimeters). The length of the first intermediate support ring (94) may be about 2.5 inches (about 6.4 centimeters). The second turbine length (146) may be about 6 inches (about 15.2 centimeters). The length of the second intermediate support ring (98) may be about 2.5 inches (about 6.4 centimeters). The third turbine length (176) may be about 4 inches (about 10.2 centimeters). The length of the third distal support ring (102) may be about 1 inch (about 2.5 centimeters).

The first proximal support ring (90) may be comprised of three first diverter vanes (134). The first annular turbine (92) may be comprised of four first turbine vanes (114). The first intermediate support ring (94) may be comprised of three second diverter vanes (164). The second annular turbine (96) may be comprised of six second turbine vanes (144). The second intermediate support ring (98) may be comprised of three third diverter vanes (194). The third annular turbine (100) may be comprised of eight third turbine vanes (174). The third distal support ring (102) may be comprised of three distal diverter vanes (204).

The first diverter vane angle (136) may be less than about 5 degrees or about 1 degree. The first turbine vane angle (118) may be about 44 degrees. The second diverter vane angle (166) may be about less than about 5 degrees or about 1 degree. The second turbine vane angle (148) may be about 48 degrees. The third diverter vane angle (196) may be less than about 5 degrees or about 1 degree. The third turbine vane angle (178) may be about 52 degrees. The distal diverter vane angle (206) may be less than about 5 degrees or about 1 degree.

In this exemplary configuration for the vibration tool (10), the annular turbines (92, 96, 100) are configured so that a progressively higher restriction to fluid flow is provided from the first annular turbine (92) to the second annular turbine (96) and from the second annular turbine (96) to the third annular turbine (100). This configuration is achieved by adjusting the number of turbine vanes (114, 144, 174), the turbine vane angles (118, 148, 178), and the turbine lengths (116, 146, 176) amongst the annular turbines (92, 96, 100).

In this exemplary configuration for the vibration tool (10), the diverter vane angles (136, 166, 196, 206) are minimized in order to minimize turbulence at the interfaces between the support rings (90, 94, 98, 102) and the annular turbines (92, 96, 100).

An exemplary procedure for using the vibration tool (10) in the first exemplary embodiment of FIGS. 1-2 is as follows.

First, the vibration tool (10) is assembled. The vibration tool (10) is assembled by assembling the unbalanced turbine assembly (72), inserting the unbalanced turbine assembly (72) into the main housing (24), and securing the unbalanced turbine assembly (72) to the main housing (24) with the dowels (250) and pipe plugs (256). One of the proximal sub (26) and the distal sub (28) may be threaded onto the main housing (24) before the unbalanced turbine assembly (72) is inserted into the main housing (24), or both of the subs (26, 28) may be threaded onto the main housing (24) after the unbalanced turbine assembly (72) is inserted into the main housing (24).

The unbalanced turbine assembly (72) is assembled by sliding the annular turbines (92, 96, 100) and the support rings (90, 94, 98, 102) onto the sleeve (74) from the distal sleeve end (242) in sequence, beginning with the first proximal support ring (90).

In assembling the unbalanced turbine assembly (72), the annular turbines (92, 96, 100) and the support rings (90, 94, 98, 102) may be configured to provide desired vibration frequencies of the annular turbines (92, 96, 100) by selecting annular turbines (92, 96, 100) with appropriate turbine vane angles (118, 148, 178) and by selecting support rings (90, 94, 98) with appropriate diverter vane angles (136, 166, 196).

In assembling the unbalanced turbine assembly (72), the annular turbines (92, 96, 100) may also be configured to provide desired vibration amplitudes of the annular turbines (92, 96, 100) by selecting annular turbines (92, 96, 100) having appropriate turbine lengths (116, 146, 176) and appropriate magnitudes of imbalance. If necessary, spacers (not shown) may be included in the unbalanced turbine assembly (72) to accommodate the selected turbine lengths (116, 146, 176) in order to ensure that the dowels (250) line up with the dowel bores (252) in the main housing (24) and the dowel bores (254) in the support rings (90, 94, 98, 102). Alternatively or additionally, support rings (90, 94, 98, 102) having varying lengths may be provided to accommodate the selected turbine lengths (116, 146, 176) in order to ensure that the dowels (250) line up with the dowel bores (252) in the main housing (24) and the dowel bores (254) in the support rings (90, 94, 98, 102). Alternatively or additionally, the main housing (24) may be provided with extra dowel bores (252) and corresponding pipe plugs (256) to accommodate different turbine lengths (116, 146, 176) which may be selected.

Second, the vibration tool (10) is incorporated into a pipe string (not shown) using the proximal threaded connector (50) on the proximal sub (26) and the distal threaded connector (52) on the distal sub (28).

Third, the pipe string (not shown) is lowered into a borehole (not shown).

Fourth, a fluid (not shown) is circulated through the pipe string (not shown) so that the fluid (not shown) passes through the vibration tool (10). The fluid (not shown) passes through the proximal sub (26) to the inlet (244).

If the vibration tool (10) does not include a flow control device (not shown in FIGS. 1-2), the fluid (not shown) is introduced into both the sleeve bore (80) and the annular bore (82) at the inlet (244). If the vibration tool (10) does include a flow control device (not shown in FIGS. 1-2), the fluid (not shown) is selectively introduced into the sleeve bore (80) and/or the annular bore (82), depending upon the actuation state of the flow control device (not shown in FIGS. 1-2).

Fifth, the fluid (not shown) which is introduced into the annular bore (82) passes through the annular bore (82), impacts upon the turbine vanes (114, 144, 174), and causes the annular turbines (92, 96, 100) to rotate. The imbalance of the annular turbines (92, 96, 100) causes the vibration tool (10) to vibrate as the annular turbines (92, 96, 100) rotate. The vibration of the vibration tool (10) is transmitted to the pipe string (not shown) via the subs (26, 28).

The vibration tool (10) may be configured to provide continuous vibration by continuously permitting some amount of fluid (not shown) to flow through the annular bore (82). Alternatively, if the vibration tool (10) is provided with a flow control device (not shown in FIGS. 1-2), the flow control device (not shown in FIGS. 1-2) may facilitate some control over the flow of fluid (not shown) through the sleeve bore (80) and the annular bore (82) in order to control the vibration of the vibration tool (10).

The vibration frequencies and the vibration amplitudes of the annular turbines (92, 96, 100) will be dependent upon many factors, including the selected configuration of the annular turbines (92, 96, 100) and the support rings (90, 94, 98, 102), the fluid energy which is provided to the vibration tool (10), and the actuation state of any flow control device (not shown in FIGS. 1-2) which is included in the vibration tool (10). The vibrations provided by the vibration tool (10) to the pipe string (not shown) may serve to reduce the likelihood of the pipe string (not shown) becoming stuck in the borehole (not shown), cause the pipe string (not shown) to become unstuck, and/or cancel unwanted vibrations in the pipe string (not shown).

If more than one vibration tool (10) is incorporated into the pipe string (not shown), the vibration tools (10) may be spaced along the pipe string (not shown) to allow for vibration of extended lengths of the pipe string (not shown), and/or may be positioned within the pipe string (not shown) in close proximity to sections of the pipe string (not shown) which may be particularly vulnerable to becoming stuck or which may be particularly prone to experiencing unwanted vibrations.

The second exemplary embodiment of the downhole vibration tool is now described with reference to FIGS. 3-6.

In the description of the second exemplary embodiment, parts, components and features of the second exemplary embodiment which are generally equivalent to parts, components and features of the first exemplary embodiment are assigned the same reference numbers as in the above description of the first exemplary embodiment.

In addition, the differences between the second exemplary embodiment and the first exemplary embodiment consist essentially of differences in the unbalanced turbine assembly (72). As a result, the following description of the second exemplary embodiment is limited to a description of the unbalanced turbine assembly (72) of the second exemplary embodiment, and the description provided above with respect to the first exemplary embodiment is applicable to parts, components and features of the second exemplary embodiment other than the unbalanced turbine assembly (72) and to parts, components and features of the unbalanced turbine assembly (72) which are common to both the first exemplary embodiment and the second exemplary embodiment.

Referring to FIGS. 3-6, the unbalanced turbine assembly (72) of the second exemplary embodiment is comprised of a sleeve (74), a first proximal support ring (90), a first annular turbine (92), a first intermediate support ring (94), a second annular turbine (96), a second intermediate support ring (98), a third annular turbine (100), and a third distal support ring (102), all of which are also included in the unbalanced turbine assembly (72) of the first exemplary embodiment.

The unbalanced turbine assembly (72) of the second exemplary embodiment further comprises a retrievable plug (300), an auxiliary proximal support ring (302), an auxiliary annular turbine (304), and an unbalanced weight (306).

The auxiliary proximal support ring (302), the auxiliary annular turbine (304) and the unbalanced weight (306) are configured and arranged in the annular bore (82) so that a fluid (not shown) may pass through the annular bore (82). Stated otherwise, the auxiliary proximal support ring (302), the auxiliary annular turbine (304) and the unbalanced weight (306) do not entirely block the annular bore (82).

The unbalanced turbine assembly (72) of the second exemplary embodiment further comprises an auxiliary distal support ring which is combined with the first proximal support ring (90) so that the first proximal support ring (90) in the second exemplary embodiment is comprised of a combined auxiliary intermediate support ring (308).

The unbalanced turbine assembly (72) of the second exemplary embodiment further comprises a proximal sleeve bearing (310) which is associated with the auxiliary proximal support ring (302), a distal sleeve bearing (312) which is associated with the third distal support ring (102), and an intermediate sleeve bearing (314) which is associated with the auxiliary intermediate support ring (308).

As depicted in FIG. 3, the proximal sleeve bearing (310) is incorporated into the auxiliary proximal support ring (302), the distal sleeve bearing (312) is incorporated into the third distal support ring (102), and the intermediate sleeve bearing (314) is incorporated into the auxiliary intermediate support ring (308).

As depicted in FIG. 3, the proximal sleeve bearing (310) is comprised of four races of rolling element bearings, the distal sleeve bearing (312) is comprised of three races of rolling element bearings, and the intermediate sleeve bearing (314) is comprised of two races of rolling element bearings. In other embodiments, the configuration of the sleeve bearings (310, 312, 314) may be different from the configuration depicted in FIG. 3. For example, in some particular embodiments, the sleeve bearings (310, 312, 314) may each be comprised of four races of rolling element bearings.

As depicted in FIGS. 3-6, the unbalanced weight (306) is contained in the annular bore (82) and is located axially between the third annular turbine (100) and the third distal support ring (102). As a result, as depicted in FIG. 3, the distal third turbine bearing (230) from the first exemplary embodiment is omitted in the second exemplary embodiment.

The unbalanced weight (306) is comprised of an annular structure having an outer surface (320) which is adjacent to the inner housing surface (70) and an inner surface (322) which is adjacent to the outer sleeve surface (76). The unbalanced weight (306) is provided with sufficient clearance with respect to the inner housing surface (70) to permit the unbalanced weight (306) to rotate relatively freely within the annular bore (82) relative to the housing (22) and to permit a fluid (not shown) to pass through the annular bore (82) between the outer surface (320) of the unbalanced weight (306) and the inner housing surface (70). Depending upon the amount of clearance which is provided between the outer surface (320) of the unbalanced weight (306) and the inner housing surface (70), the unbalanced weight (306) may also define one or more passages therethrough for enabling a fluid (not shown) to pass through the unbalanced weight (306).

In the second exemplary embodiment of FIGS. 3-6, the unbalanced weight (306) is fixedly connected with the sleeve (74) by an interference fit between the inner surface (322) of the unbalanced weight (306) and the outer sleeve surface (76). More particularly, in the embodiment of the unbalanced weight (306) depicted in FIGS. 5-6, the unbalanced weight (306) is comprised of a split annular ring which is clamped to the outer sleeve surface (76) with a plurality of bolts (323).

The unbalanced weight (306) has an unbalanced weight rotation axis (324), an unbalanced weight length (326), and is unbalanced relative to the longitudinal tool axis (12). In the second exemplary embodiment of FIGS. 3-6, the unbalanced weight rotation axis (324) is substantially coincident with the longitudinal tool axis (12) and the unbalanced weight (306) is unbalanced relative to the longitudinal tool axis (12) by configuring the mass of the unbalanced weight so that the center of mass is offset from the unbalanced weight rotation axis (324). In the embodiment of the unbalanced weight (306) depicted in FIGS. 5-6, the unbalanced weight (306) is initially fabricated so that the center of mass is offset from the unbalanced weight rotation axis (324).

In the second exemplary embodiment of FIGS. 3-6, the first annular turbine (92), the second annular turbine (96), the third annular turbine (100) are all fixedly connected with the sleeve (74) so that rotation of the annular turbines (92, 96, 100) results in rotation of both the sleeve (74) and the unbalanced weight (306). As depicted in FIGS. 3-4, the annular turbines (92, 96, 100) are fixedly connected with the sleeve (74) with set screws (not shown) which extend between the inner surfaces (112, 142, 172) of the annular turbines (92, 96, 100) and the outer sleeve surface (76).

As a result, in the second exemplary embodiment, the sleeve (74) is rotatably supported in the housing (22) by the sleeve bearings (310, 312, 314) and the annular turbines (92, 96, 100), the unbalanced weight (306) and the sleeve (74) are configured to rotate together as a unit within the housing (22).

In the second exemplary embodiment, the support rings (302, 308, 94, 98, 102) are fixedly connected with the main housing (24) with one or more dowels (250) which extend through dowel bores (252) in the main housing (24) and into corresponding dowel bores (254) in the support rings (302, 308, 94, 98, 102), in a similar manner as in the first exemplary embodiment, so that the annular turbines (92, 96, 100), the unbalanced weight (306) and the sleeve (74) rotate together as a unit within the housing, relative to both the housing (22) and the support rings (302, 308, 94, 98, 102).

In the second exemplary embodiment of FIGS. 3-6, the annular turbines (92, 96, 100) are substantially balanced (i.e., are not deliberately unbalanced). In other embodiments, the annular turbines (92, 96, 100) may be unbalanced in order to enhance the vibrations provided by the vibration tool (20).

In the second exemplary embodiment of FIGS. 3-6, the turbine lengths (116, 146, 176) of each of the annular turbines (92, 96, 100) are substantially the same and the turbine vane angles (118, 148, 178) of each of the annular turbines (92, 96, 100) are substantially the same. In other embodiments, the turbine lengths (116, 146, 176) and the turbine vane angles (118, 148, 178) of some or all of the annular turbines (92, 96, 100) may be different from each other, as long as the desired rotation characteristics of the unbalanced weight (306) can be achieved by the unbalanced turbine assembly (72).

The auxiliary annular turbine (304) is comprised of an annular structure having an outer surface (330) which is adjacent to the inner housing surface (70) and an inner surface (332) which is adjacent to the outer sleeve surface (76). The auxiliary annular turbine (304) is provided with sufficient clearance with respect to the inner housing surface (70) and the outer sleeve surface (76) to permit the auxiliary annular turbine (304) to rotate relatively freely within the annular bore (82). In addition, in the second exemplary embodiment of FIGS. 3-6, an auxiliary turbine sleeve bearing (333) is provided between the inner surface (332) of the auxiliary annular turbine (304) and the outer sleeve surface (76). As depicted in FIG. 3, the auxiliary turbine sleeve bearing (333) is comprised of four races of rolling element bearings. In other embodiments, the configuration of the auxiliary turbine sleeve bearing (333) may be different from the configuration depicted in FIG. 3.

As a result, in the second exemplary embodiment of FIGS. 3-6, the auxiliary annular turbine (304) is not fixedly connected with the sleeve (74), but is rotatably contained within the annular bore (82) so that it is capable of rotating relative to both the housing (22) and the sleeve (74).

In the second exemplary embodiment of FIGS. 3-6, a plurality of auxiliary turbine vanes (334) is located on the outer surface (330) of the auxiliary annular turbine (304). In the second exemplary embodiment of FIGS. 3-6, the auxiliary turbine vanes (334) are comprised of blades which extend along substantially the entire auxiliary turbine length (336) of the auxiliary annular turbine (304). The auxiliary turbine vanes (334) are arranged at an angle relative to the longitudinal tool axis (12) so that the auxiliary annular turbine (304) has an auxiliary turbine vane angle (338). The auxiliary turbine vanes (334) may be tapered adjacent to the auxiliary proximal support ring (302) in order to reduce turbulence and energy losses as a fluid (not shown) passes into the auxiliary annular turbine (304).

The auxiliary annular turbine (304) is rotatable about an auxiliary turbine rotation axis (340) and is unbalanced relative to the longitudinal tool axis (12). In the second exemplary embodiment of FIGS. 3-6, the auxiliary turbine rotation axis (340) is substantially coincident with the longitudinal tool axis (12) and the auxiliary annular turbine (304) is unbalanced by configuring the mass of the auxiliary annular turbine (304) so that the center of mass is offset from the auxiliary turbine rotation axis (340).

In the second exemplary embodiment of FIGS. 3-6, the auxiliary annular turbine (304) is initially fabricated so that the center of mass is substantially coincident with the auxiliary turbine rotation axis (340) and is subsequently modified by adding and/or removing mass asymmetrically from the auxiliary annular turbine (304). For example, in a similar manner as the unbalanced annular turbines (92, 96, 100) of the first exemplary embodiment, holes (not shown) may be drilled in one of the auxiliary turbine vanes (334) so that the center of mass of the auxiliary unbalanced turbine (304) is offset. These holes (not shown) may either be left as voids, or may be filled with a material which has a lesser or greater density than the material from which the auxiliary unbalanced turbine (304) is fabricated in order to provide that the auxiliary unbalanced turbine (304) is unbalanced.

In the second exemplary embodiment of FIGS. 3-6, a proximal auxiliary turbine bearing (342) is located between the auxiliary proximal support ring (302) and a proximal auxiliary turbine end (344) of the auxiliary annular turbine (304) and a distal auxiliary turbine bearing (346) is located between a distal auxiliary turbine end (348) of the auxiliary annular turbine (304) and the auxiliary intermediate support ring (308).

In the second exemplary embodiment of FIGS. 3-6, the auxiliary turbine length (336) of the auxiliary annular turbine (304) is greater than the turbine lengths (116, 146, 176) of the annular turbines (92, 96, 100). In the exemplary embodiment of FIGS. 3-6, the auxiliary turbine vane angle (338) of the auxiliary annular turbine (304) is in a direction opposite to the turbine vane angles (118, 148, 178) of the annular turbines (92, 96, 100) relative to the longitudinal tool axis (12) so that the auxiliary annular turbine (304) and the annular turbines (92, 96, 100) are configured to rotate in opposite directions.

In the second exemplary embodiment of FIGS. 3-6, the auxiliary proximal support ring (302) is comprised of an annular structure having an outer surface (350) which is adjacent to the inner housing surface (70) and an inner surface (352) which is adjacent to the outer sleeve surface (76).

In the second exemplary embodiment of FIGS. 3-6, a plurality of auxiliary diverter vanes (354) is located on the outer surface (350) of the auxiliary proximal support ring (302). In the second exemplary embodiment of FIGS. 3-6, the auxiliary diverter vanes (354) are comprised of blades which extend along the length of the auxiliary proximal support ring (302). The auxiliary diverter vanes (354) are arranged to have an auxiliary diverter vane angle (356) relative to the longitudinal tool axis (12).

The auxiliary diverter vane angle (356) is in a direction relative to the longitudinal tool axis (12) which is opposite to the auxiliary turbine vane angle (338). This configuration of the auxiliary diverter vane angle (356) and the auxiliary turbine vane angle (338) enables a fluid (not shown) passing through the annular bore (82) to impact the auxiliary turbine vanes (334) at a lower angle of incidence than if the auxiliary diverter vane angle (356) were parallel to the longitudinal tool axis (12) or in the same direction as the auxiliary turbine vane angle (338) relative to the longitudinal tool axis (12), thus potentially increasing the rotational energy which is imparted to the auxiliary annular turbine (304) by the fluid (not shown).

In the second exemplary embodiment of FIGS. 3-6, the auxiliary diverter vane angle (356) may be minimized in order to minimize turbulence at the interface between the auxiliary proximal support ring (302) and the auxiliary annular turbine (304). Similarly, as depicted in FIG. 4, the first diverter vane angle (136) may be minimized in order to minimize turbulence at the interface between the auxiliary intermediate support ring (308) and the first annular turbine (90).

In the second exemplary embodiment of FIGS. 3-6, the retrievable plug (300) is associated with the inlet (244) as a flow control device so that a fluid (not shown) may be selectively directed through the annular bore (82) by blocking the sleeve bore (80). As depicted in FIGS. 3-4, the retrievable plug (300) is in the form of a retrievable nose cone. The retrievable plug (300) may be removably connected with the proximal sleeve end (240) with one or more shear pins (360) in order to block the sleeve bore (80). As depicted in FIGS. 3-4, the retrievable plug (300) is comprised of a fishing neck (362) for facilitating retrieval of the retrievable plug (300) with an appropriate retrieval tool in order to un-block the sleeve bore (80).

In summary, the unbalanced turbine assembly (72) of the second exemplary embodiment provides separate vibrations from rotation of the unbalanced weight (306) and from rotation of the auxiliary annular turbine (304). In the second exemplary embodiment, rotation of the unbalanced weight (306) results from rotation of the annular turbines (92, 96, 100). In the second exemplary embodiment, the annular turbines (92, 96, 100) do not need to be unbalanced, but the auxiliary annular turbine (304) is unbalanced. In the second exemplary embodiment, the unbalanced weight (306) and the auxiliary annular turbine (304) may be configured to rotate in opposite directions.

An exemplary configuration for the vibration tool (10) in the second exemplary embodiment of FIGS. 3-6 is as follows.

The nominal outer diameter of the vibration tool (10) may be 5.25 inches (about 13.3 centimeters). The nominal inner diameter of the pipe string (not shown) may be 2.25 inches (about 5.7 centimeters). In the exemplary configuration, the vibration tool (10) may be configured to be used in a pipe string (not shown) which includes a positive displacement drilling motor having a nominal outer diameter of 4.75 inches (about 12.1 centimeters) and which is designed for a maximum fluid flow rate of about 275 U.S. gallons per minute (about 1040 liters per minute).

The nominal inner diameter (54) of the proximal sub (26) may be about 3.25 inches (about 8.3 centimeters). The nominal inner diameter (56) of the distal sub (28) may be about 2.75 inches (about 7.0 centimeters). The inner diameter (60) of the main housing (24) may be about 3.83 inches (about 9.7 centimeters). The sleeve bore diameter (262) may be about 2.25 inches (about 5.7 centimeters). The diameter of the outer sleeve surface (76) may be about 2.50 inches (about 6.4 centimeters).

The vibration tool (10) may have an overall length of about 80 inches (about 203 centimeters). The length of the auxiliary proximal support ring (302) may be about 3.75 inches (about 9.5 centimeters). The auxiliary turbine length (336) may be about 6.5 inches (about 16.5 centimeters). The length of the auxiliary intermediate support ring (308) may be about 3.75 inches (about 9.5 centimeters). The first turbine length (116) may be about 2.5 inches (about 6.4 centimeters). The length of the first intermediate support ring (94) may be about 3.5 inches (about 8.9 centimeters). The second turbine length (146) may be about 2.5 inches (about 6.4 centimeters). The length of the second intermediate support ring (98) may be about 3.5 inches (about 8.9 centimeters). The third turbine length (176) may be about 2.5 inches (about 6.4 centimeters). The length of the unbalanced weight (306) may be about 4.38 inches (about 11.1 centimeters). The length of the third distal support ring (102) may be about 2.75 inches (about 7.0 centimeters).

The auxiliary proximal support ring (302) may be comprised of six auxiliary diverter vanes (354). The auxiliary annular turbine (304) may be comprised of ten auxiliary turbine vanes (334). The auxiliary intermediate support ring (308) may be comprised of three first diverter vanes (134). The first annular turbine (92) may be comprised of nine first turbine vanes (114). The first intermediate support ring (94) may be comprised of six second diverter vanes (164). The second annular turbine (96) may be comprised of nine second turbine vanes (144). The second intermediate support ring (98) may be comprised of six third diverter vanes (194). The third annular turbine (100) may be comprised of nine third turbine vanes (174). The third distal support ring (102) may be comprised of three distal diverter vanes (204).

The auxiliary diverter vane angle (356) may be about 48 degrees. The auxiliary turbine vane angle (338) may be about 38 degrees. The first diverter vane angle (136) may be about 0 degrees. The first turbine vane angle (118) may be about 68 degrees. The second diverter vane angle (166) may be about 48 degrees. The second turbine vane angle (148) may be about 68 degrees. The third diverter vane angle (196) may be about 48 degrees. The third turbine vane angle (178) may be about 68 degrees. The distal diverter vane angle (206) may be about 0 degrees.

In this exemplary configuration for the vibration tool (10), the annular turbines (304, 92, 96, 100) may be configured so that a progressively higher restriction to fluid flow is provided from the auxiliary annular turbine (304) to the first annular turbine (92), from the first annular turbine (92) to the second annular turbine (96), and from the second annular turbine (96) to the third annular turbine (100). This configuration may be achieved by adjusting the number of turbine vanes (334, 114, 144, 174), the turbine vane angles (338, 118, 148, 178), and the turbine lengths (336, 116, 146, 176) amongst the annular turbines (304, 92, 96, 100).

In this exemplary configuration for the vibration tool (10), the diverter vane angles (356, 136, 166, 196, 206) are minimized in order to minimize turbulence at the interfaces between the support rings (302, 308, 94, 98, 102) and the annular turbines (304, 92, 96, 100).

An exemplary procedure for using the vibration tool (10) in the second exemplary embodiment of FIGS. 3-6 is as follows.

First, the vibration tool (10) is assembled. The vibration tool (10) is assembled by assembling the unbalanced turbine assembly (72), inserting the unbalanced turbine assembly (72) into the main housing (24), and securing the unbalanced turbine assembly (72) to the main housing (24) with the dowels (250) and pipe plugs (256). One of the proximal sub (26) and the distal sub (28) may be threaded onto the main housing (24) before the unbalanced turbine assembly (72) is inserted into the main housing (24), or both of the subs (26, 28) may be threaded onto the main housing (24) after the unbalanced turbine assembly (72) is inserted into the main housing (24).

The unbalanced turbine assembly (72) is assembled by sliding the annular turbines (304, 92, 96, 100), the support rings (302, 308, 94, 98, 102) and the unbalanced weight (306)

onto the sleeve (74) from the distal sleeve end (242) in sequence, beginning with the auxiliary proximal support ring (304).

In assembling the unbalanced turbine assembly (72), the annular turbines (304, 92, 96, 100) and the support rings (302, 308, 94, 98, 102) may be configured to provide desired vibration frequencies of the unbalanced weight (306) and the auxiliary annular turbine (304) by selecting annular turbines (304, 92, 96, 100) with appropriate turbine vane angles (338, 118, 148, 178) and by selecting support rings (302, 308, 94, 98) with appropriate diverter vane angles (356, 136, 166, 196).

In assembling the unbalanced turbine assembly (72), the annular turbines (304, 92, 96, 100) may also be configured to provide desired vibration amplitudes of the unbalanced weight (306) and the auxiliary annular turbine (304) by selecting annular turbines (304, 92, 96, 100) having appropriate turbine lengths (336, 116, 146, 176), by selecting an unbalanced weight having an appropriate unbalanced weight length (326), and by selecting an unbalanced weight (306) and an auxiliary annular turbine (304) having appropriate magnitudes of imbalance. If necessary, spacers (not shown) may be included in the unbalanced turbine assembly (72) to accommodate the selected turbine lengths (336, 116, 146, 176) and the selected unbalanced weight length (326) in order to ensure that the dowels (250) line up with the dowel bores (252) in the main housing (24) and the dowel bores (254) in the support rings (302, 308, 94, 98, 102). Alternatively or additionally, support rings (302, 308, 94, 98, 102) having varying lengths may be provided to accommodate the selected turbine lengths (336, 116, 146, 176) and the selected unbalanced weight length (326) in order to ensure that the dowels (250) line up with the dowel bores (252) in the main housing (24) and the dowel bores (254) in the support rings (302, 308, 94, 98, 102). Alternatively or additionally, the main housing (24) may be provided with extra dowel bores (252) and corresponding pipe plugs (256) to accommodate different turbine lengths (336, 116, 146, 176) and different unbalanced weight lengths (326) which may be selected.

Second, the vibration tool (10) is incorporated into a pipe string (not shown) using the proximal threaded connector (50) on the proximal sub (26) and the distal threaded connector (52) on the distal sub (28).

Third, the pipe string (not shown) is lowered into a borehole (not shown).

Fourth, a fluid (not shown) is circulated through the pipe string (not shown) so that the fluid (not shown) passes through the vibration tool (10). The fluid (not shown) passes through the proximal sub (26) to the inlet (244).

If the vibration tool (10) does not include the retrievable plug (300) or some other form of flow control device, the fluid (not shown) is introduced into both the sleeve bore (80) and the annular bore (82) at the inlet (244). If the vibration tool (10) includes the retrievable plug (300) as a flow control device, the fluid (not shown) is selectively introduced only into the annular bore (82) because of the blocking of the sleeve bore (80) by the retrievable plug (300).

Fifth, the fluid (not shown) which is introduced into the annular bore (82) passes through the annular bore (82), impacts upon the turbine vanes (334, 114, 144, 174), and causes the unbalanced weight (306) and the auxiliary annular turbine (304) to rotate. The imbalance of the unbalanced weight (306) and the auxiliary annular turbine (304) causes the vibration tool (10) to vibrate as the annular turbines (304, 92, 96, 100) rotate. The vibration of the vibration tool (10) is transmitted to the pipe string (not shown) via the subs (26, 28).

The retrievable plug (300) may be left connected with the proximal sleeve end (240) as long as a relatively large amount of vibration is desired.

If, however, a smaller amount of vibration becomes desirable while the vibration tool (10) is deployed in the borehole (not shown), a suitable retrieval tool (not shown) may be lowered into the pipe string (not shown), be engaged with the fishing neck (362) on the retrievable plug (300), and be withdrawn in order to shear the shear pins (360) which connect the retrievable plug (300) with the proximal sleeve end (240) and thereby retrieve the retrievable plug (300). Retrieval of the retrievable plug (300) will un-block the sleeve bore (80) and permit a portion of the fluid (not shown) which is circulating through the vibration tool (10) to be diverted from the annular bore (82) and into the sleeve bore (80), thereby reducing the amount of fluid energy which is provided to the annular turbines (304, 92, 96, 100).

The vibration frequencies and the vibration amplitudes of the unbalanced weight (306) and the auxiliary annular turbine (304) will be dependent upon many factors, including the selected configuration of the annular turbines (304, 92, 96, 100) and the support rings (302, 308, 94, 98, 102), the fluid energy which is provided to the vibration tool (10), and the actuation state of the retrievable plug (300) or any other flow control device which is included in the vibration tool (10). The vibrations provided by the vibration tool (10) to the pipe string (not shown) may serve to reduce the likelihood of the pipe string (not shown) becoming stuck in the borehole (not shown), cause the pipe string (not shown) to become unstuck, and/or cancel unwanted vibrations in the pipe string (not shown).

If more than one vibration tool (10) is incorporated into the pipe string (not shown), the vibration tools (10) may be spaced along the pipe string (not shown) to allow for vibration of extended lengths of the pipe string (not shown), and/or may be positioned within the pipe string (not shown) in close proximity to sections of the pipe string (not shown) which may be particularly vulnerable to becoming stuck or which may be particularly prone to experiencing unwanted vibrations.

The third exemplary embodiment of the downhole vibration tool is now described with reference to FIG. 7.

In the description of the third exemplary embodiment, parts, components and features of the third exemplary embodiment which are generally equivalent to parts, components and features of the first exemplary embodiment and/or the second exemplary embodiment are assigned the same reference numbers as in the above description of the previous exemplary embodiments.

In addition, the differences between the third exemplary embodiment and the previous exemplary embodiments consist essentially of differences in the unbalanced turbine assembly (72). As a result, the following description of the third exemplary embodiment is limited to a description of the unbalanced turbine assembly (72) of the third exemplary embodiment, and the description provided above with respect to the first exemplary embodiment is applicable to parts, components and features of the third exemplary embodiment other than the unbalanced turbine assembly (72) and the description provided above with respect to the previous exemplary embodiments is applicable to parts, components and features of the unbalanced turbine assembly (72) which are common to both the third exemplary embodiment and the previous exemplary embodiments.

The third exemplary embodiment includes features of both the first exemplary embodiment and the second exemplary embodiment.

Referring to FIG. 7, the unbalanced turbine assembly (72) of the third exemplary embodiment is comprised of a sleeve (74), a first proximal support ring (90), a first annular turbine (92), a first intermediate support ring (94), a second annular turbine (96), a second intermediate support ring (98), a third annular turbine (100), and a third distal support ring (102), all of which are also included in the unbalanced turbine assembly (72) of the first exemplary embodiment.

The unbalanced turbine assembly (72) of the third exemplary embodiment further comprises an unbalanced weight (306), which is also included in the unbalanced turbine assembly (72) of the second exemplary embodiment, and a lower support ring (380), which is not included in the unbalanced turbine assembly (72) of the previous exemplary embodiments.

The unbalanced turbine assembly (72) of the third exemplary embodiment does not include the auxiliary annular turbine (304) which is included in the second exemplary embodiment, or any of the features which are associated with the auxiliary annular turbine (304) in the second exemplary embodiment.

Furthermore, in the unbalanced turbine assembly (72) of the third exemplary embodiment, the sleeve (74) is comprised of a solid rod. As a result, the sleeve (74) in the third exemplary embodiment does not include an inner sleeve surface which defines a sleeve bore as in the previous exemplary embodiments, and the unbalanced turbine assembly (72) of the third exemplary embodiment also does not include the retrievable plug (300) which is included in the second exemplary embodiment.

An advantage of providing a sleeve (74) without a sleeve bore is that all fluid (not shown) passing through the vibration tool (10) will pass through the annular bore (82) and will therefore be available to drive the annular turbines (92, 96, 100). A disadvantage of providing a sleeve (74) without a sleeve bore is that tools and other equipment may not as easily be passed through the vibration tool (10) in comparison with embodiments in which the sleeve (74) does include a sleeve bore.

The unbalanced weight (306) and the lower support ring (380) are configured and arranged in the annular bore (82) so that a fluid (not shown) may pass through the annular bore (82). Stated otherwise, the unbalanced weight (306) and the lower support ring (380) do not entirely block the annular bore (82).

The unbalanced turbine assembly (72) of the third exemplary embodiment further comprises a proximal sleeve bearing (not shown in FIG. 7) which is associated with the first proximal support ring (90), a distal sleeve bearing (not shown in FIG. 7) which is associated with the second intermediate support ring (98), and an intermediate sleeve bearing (not shown in FIG. 7) which is associated with the first intermediate support ring (94).

In the third exemplary embodiment of FIG. 7, the proximal sleeve bearing is incorporated into the first proximal support ring (90), the distal sleeve bearing is incorporated into the second intermediate support ring (98), and the intermediate sleeve bearing is incorporated into the first intermediate support ring (94).

In the third exemplary embodiment of FIG. 7, the sleeve bearings are each comprised of four races of rolling element bearings.

Referring to FIG. 7, the unbalanced weight (306) is contained in the annular bore (82) and is located axially between the third distal support ring (102) and the lower support ring (380). As a result, the distal third turbine bearing (not shown in FIG. 7) from the first exemplary embodiment (which was omitted in the second exemplary embodiment) is included in the third exemplary embodiment.

In the third exemplary embodiment of FIG. 7, the unbalanced weight (306) is comprised of the structure depicted in FIGS. 5-6. More particularly, the unbalanced weight is an annular structure having an outer surface (320) which is adjacent to the inner housing surface (70) and an inner surface (322) which is adjacent to the outer sleeve surface (76). The unbalanced weight (306) is provided with sufficient clearance with respect to the inner housing surface (70) to permit the unbalanced weight (306) to rotate relatively freely within the annular bore (82) relative to the housing (22) and to permit a fluid (not shown) to pass through the annular bore (82) between the outer surface (320) of the unbalanced weight (306) and the inner housing surface (70). Depending upon the amount of clearance which is provided between the outer surface (320) of the unbalanced weight (306) and the inner housing surface (70), the unbalanced weight (306) may also define one or more passages therethrough for enabling a fluid (not shown) to pass through the unbalanced weight (306).

In the third exemplary embodiment of FIG. 7, the unbalanced weight (306) is fixedly connected with the sleeve (74) by an interference fit between the inner surface (322) of the unbalanced weight (306) and the outer sleeve surface (76). More particularly, in the embodiment of the unbalanced weight (306) depicted in FIGS. 5-6, the unbalanced weight (306) is comprised of a split annular ring which is clamped to the outer sleeve surface (76) with a plurality of bolts (323).

The unbalanced weight (306) has an unbalanced weight rotation axis (324), an unbalanced weight length (326), and is unbalanced relative to the longitudinal tool axis (12). In the third exemplary embodiment of FIG. 7, the unbalanced weight rotation axis (324) is substantially coincident with the longitudinal tool axis (12) and the unbalanced weight (306) is unbalanced relative to the longitudinal tool axis (12) by configuring the mass of the unbalanced weight so that the center of mass is offset from the unbalanced weight rotation axis (324). In the embodiment of the unbalanced weight (306) depicted in FIGS. 5-6, the unbalanced weight (306) is initially fabricated so that the center of mass is offset from the unbalanced weight rotation axis (324).

In the third exemplary embodiment of FIG. 7, the first annular turbine (92), the second annular turbine (96), the third annular turbine (100) are all fixedly connected with the sleeve (74) so that rotation of the annular turbines (92, 96, 100) results in rotation of both the sleeve (74) and the unbalanced weight (306). As in the second exemplary embodiment depicted in FIGS. 3-4, the annular turbines (92, 96, 100) are fixedly connected with the sleeve (74) with set screws (not shown) which extend between the inner surfaces (not shown in FIG. 7) of the annular turbines (92, 96, 100) and the outer sleeve surface (76).

As a result, in the third exemplary embodiment as in the second exemplary embodiment, the sleeve (74) is rotatably supported in the housing (22) by the sleeve bearings (310, 312, 314) and the annular turbines (92, 96, 100), the unbalanced weight (306) and the sleeve (74) are configured to rotate together as a unit within the housing (22).

In the third exemplary embodiment, the support rings (90, 94, 98, 102, 380) are fixedly connected with the main housing (24) with one or more dowels (not shown in FIG. 7) which extend through dowel bores (not shown in FIG. 7) in the main housing (24) and into corresponding dowel bores (not shown in FIG. 7) in the support rings (90, 94, 98, 102, 380), in a similar manner as in the previous exemplary embodiments, so that the annular turbines (92, 96, 100), the unbalanced weight (306) and the sleeve (74) rotate together as a unit within the housing, relative to both the housing (22) and the support rings (90, 94, 98, 102, 380).

In the third exemplary embodiment of FIG. 7, the annular turbines (92, 96, 100) are substantially balanced (i.e., are not deliberately unbalanced). In other embodiments, the annular turbines (92, 96, 100) may be unbalanced in order to enhance the vibrations provided by the vibration tool (20).

In the third exemplary embodiment of FIG. 7, the turbine lengths (116, 146, 176) of each of the annular turbines (92, 96, 100) are substantially the same and the turbine vane angles (118, 148, 178) of each of the annular turbines (92, 96, 100) are substantially the same. In other embodiments, the turbine lengths (116, 146, 176) and the turbine vane angles (118, 148, 178) of some or all of the annular turbines (92, 96, 100) may be different from each other, as long as the desired rotation characteristics of the unbalanced weight (306) can be achieved by the unbalanced turbine assembly (72).

In summary, in the third exemplary embodiment, rotation of the unbalanced weight (306) results from rotation of the annular turbines (92, 96, 100). In the third exemplary embodiment, the annular turbines (92, 96, 100) do not need to be unbalanced.

An exemplary configuration for the vibration tool (10) in the third exemplary embodiment of FIG. 7 is as follows.

The nominal outer diameter of the vibration tool (10) may be 5.25 inches (about 13.3 centimeters). The nominal inner diameter of the pipe string (not shown) may be 2.25 inches (about 5.7 centimeters). In the exemplary configuration, the vibration tool (10) may be configured to be used in a pipe string (not shown) which includes a positive displacement drilling motor having a nominal outer diameter of 4.75 inches (about 12.1 centimeters) and which is designed for a maximum fluid flow rate of about 275 U.S. gallons per minute (about 1040 liters per minute).

The nominal inner diameter (54) of the proximal sub (26) may be about 3.25 inches (about 8.3 centimeters). The nominal inner diameter (56) of the distal sub (28) may be about 2.75 inches (about 7.0 centimeters). The inner diameter (60) of the main housing (24) may be about 3.93 inches (about 10 centimeters). The diameter of the outer sleeve surface (76) may be about 2.50 inches (about 6.4 centimeters).

The vibration tool (10) may have an overall length of about 65 inches (about 165 centimeters). The length of the first proximal support ring (90) may be about 2.25 inches (about 5.7 centimeters). The first turbine length (92) may be about 2.0 inches (about 5 centimeters). The length of the first intermediate support ring (94) may be about 2.25 inches (about 5.7 centimeters). The second turbine length (96) may be about 2.0 inches (about 5 centimeters). The length of the second intermediate support ring (98) may be about 2.25 inches (about 5.7 centimeters). The third turbine length (100) may be about 2.0 inches (about 5 centimeters). The length of the third distal support ring (102) may be about 3.25 inches (about 8.3 centimeters). The length of the unbalanced weight (306) may be about 4.75 inches (about 12.1 centimeters). The length of the lower support ring (380) may be about 3.25 inches (about 8.3 centimeters).

The first proximal support ring (90) may be comprised of six first diverter vanes (134). The first annular turbine (92) may be comprised of ten first turbine vanes (114). The first intermediate support ring (308) may be comprised of six second diverter vanes (134). The second annular turbine (96) may be comprised of ten second turbine vanes (144). The second intermediate support ring (98) may be comprised of six third diverter vanes (194). The third annular turbine (100) may be comprised of ten third turbine vanes (174). The third distal support ring (102) may be comprised of three distal diverter vanes (204). The lower support ring (380) may be comprised of three lower diverter vanes (382).

The first diverter vane angle (136) may be between about 42 degrees and about 50 degrees. The first turbine vane angle (118) may be about 60 degrees. The second diverter vane angle (166) may be between about 42 degrees and about 50 degrees. The second turbine vane angle (148) may be about 60 degrees. The third diverter vane angle (196) may be between about 42 degrees and about 50 degrees. The third turbine vane angle (178) may be about 60 degrees. The distal diverter vane angle (206) may be about 0 degrees. The lower diverter vane angle (384) may be about 0 degrees.

In this exemplary configuration for the vibration tool (10), the annular turbines (92, 96, 100) may be configured so that a progressively higher restriction to fluid flow is provided from the first annular turbine (92) to the second annular turbine (96), and from the second annular turbine (96) to the third annular turbine (100). This configuration may be achieved by adjusting the number of turbine vanes (114, 144, 174), the turbine vane angles (118, 148, 178), and the turbine lengths (116, 146, 176) amongst the annular turbines (92, 96, 100).

In this exemplary configuration for the vibration tool (10), the diverter vane angles (206, 384) are minimized in order to minimize turbulence at the interfaces between the support rings (102, 380) and the unbalanced weight (306).

An exemplary procedure for using the vibration tool (10) in the third exemplary embodiment of FIG. 7 is as follows.

First, the vibration tool (10) is assembled. The vibration tool (10) is assembled by assembling the unbalanced turbine assembly (72), inserting the unbalanced turbine assembly (72) into the main housing (24), and securing the unbalanced turbine assembly (72) to the main housing (24) with the dowels (not shown in FIG. 7) and pipe plugs (not shown in FIG. 7). One of the proximal sub (26) and the distal sub (28) may be threaded onto the main housing (24) before the unbalanced turbine assembly (72) is inserted into the main housing (24), or both of the subs (26, 28) may be threaded onto the main housing (24) after the unbalanced turbine assembly (72) is inserted into the main housing (24).

The unbalanced turbine assembly (72) is assembled by sliding the annular turbines (92, 96, 100), the support rings (90, 94, 98, 102, 380) and the unbalanced weight (306) onto the sleeve (74) from the distal sleeve end (242) in sequence, beginning with the first proximal support ring (90).

In assembling the unbalanced turbine assembly (72), the annular turbines (92, 96, 100) and the support rings (90, 94, 98, 102, 380) may be configured to provide desired vibration frequencies of the unbalanced weight (306) by selecting annular turbines (92, 96, 100) with appropriate turbine vane angles (118, 148, 178) and by selecting support rings (90, 94, 98) with appropriate diverter vane angles (136, 166, 196).

In assembling the unbalanced turbine assembly (72), the annular turbines (92, 96, 100) may also be configured to provide desired vibration amplitudes of the unbalanced weight (306) by selecting annular turbines (92, 96, 100) having appropriate turbine lengths (116, 146, 176), by selecting an unbalanced weight having an appropriate unbalanced weight length (326), and by selecting an unbalanced weight (306) having an appropriate magnitude of imbalance. If necessary, spacers (not shown) may be included in the unbalanced turbine assembly (72) to accommodate the selected turbine lengths (116, 146, 176) and the selected unbalanced weight length (326) in order to ensure that the dowels line up with the dowel bores in the main housing (24) and the dowel bores in the support rings (90, 94, 98, 102, 380). Alternatively or additionally, support rings (90, 94, 98, 102, 380) having varying lengths may be provided to accommodate the selected turbine lengths (116, 146, 176) and the selected unbalanced weight length (326) in order to ensure that the dowels (250) line up with the dowel bores in the main housing (24) and the dowel bores in the support rings (90, 94, 98, 102, 380). Alternatively or additionally, the main housing (24) may be provided with extra dowel bores and corresponding pipe plugs to accommodate different turbine lengths (116, 146, 176) and different unbalanced weight lengths (326) which may be selected.

Second, the vibration tool (10) is incorporated into a pipe string (not shown) using the proximal threaded connector (50) on the proximal sub (26) and the distal threaded connector (52) on the distal sub (28).

Third, the pipe string (not shown) is lowered into a borehole (not shown).

Fourth, a fluid (not shown) is circulated through the pipe string (not shown) so that the fluid (not shown) passes through the vibration tool (10). The fluid (not shown) passes through the proximal sub (26) to the inlet (244).

If the vibration tool (10) does not include the retrievable plug (300) or some other form of flow control device, the fluid (not shown) is introduced into both the sleeve bore (80) and the annular bore (82) at the inlet (244). The fluid (not shown) is introduced only into the annular bore (82) because the sleeve (74) is solid and therefore does not include a sleeve bore.

Fifth, the fluid (not shown) which is introduced into the annular bore (82) passes through the annular bore (82), impacts upon the turbine vanes (114, 144, 174), and causes the unbalanced weight (306) to rotate. The imbalance of the unbalanced weight (306) causes the vibration tool (10) to vibrate as the annular turbines (92, 96, 100) rotate. The vibration of the vibration tool (10) is transmitted to the pipe string (not shown) via the subs (26, 28).

The vibration frequencies and the vibration amplitudes of the unbalanced weight (306) will be dependent upon many factors, including the selected configuration of the annular turbines (92, 96, 100) and the support rings (90, 94, 98, 102, 380), and the fluid energy which is provided to the vibration tool (10). The vibrations provided by the vibration tool (10) to the pipe string (not shown) may serve to reduce the likelihood of the pipe string (not shown) becoming stuck in the borehole (not shown), cause the pipe string (not shown) to become unstuck, and/or cancel unwanted vibrations in the pipe string (not shown).

If more than one vibration tool (10) is incorporated into the pipe string (not shown), the vibration tools (10) may be spaced along the pipe string (not shown) to allow for vibration of extended lengths of the pipe string (not shown), and/or may be positioned within the pipe string (not shown) in close proximity to sections of the pipe string (not shown) which may be particularly vulnerable to becoming stuck or which may be particularly prone to experiencing unwanted vibrations.

Other exemplary embodiments of the invention (not shown) may combine and/or expand upon features of the first exemplary embodiment, the second exemplary embodiment and the third exemplary embodiment.

As non-limiting examples, the unbalanced turbine assembly (72) may be comprised of any practical number of unbalanced turbines and/or any practical number of unbalanced weights, turbines may be configured to be the same or different from each other, unbalanced weights may be configured to be the same or different from each other, an unbalanced weight may be rotated or driven by one or more turbines, unbalanced turbines and/or unbalanced weights may be configured to rotate in the same or opposite directions, and unbalanced turbines and/or unbalanced weights may be configured to generate the same or different torque, vibration frequency, and/or vibration amplitude.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A downhole vibration tool for connection with a pipe string, comprising:

(a) a housing, the housing having an inner housing surface;

(b) an unbalanced turbine assembly contained within the housing, wherein the vibration tool has a longitudinal tool axis, wherein the unbalanced turbine assembly is unbalanced relative to the longitudinal tool axis, and wherein the unbalanced turbine assembly comprises:

(i) a sleeve, the sleeve having an outer sleeve surface, wherein the inner housing surface and the outer sleeve surface define an annular bore extending through the housing;

(ii) a first annular turbine rotatably contained within the annular bore, wherein the first annular turbine is unbalanced relative to the longitudinal tool axis, and wherein the first annular turbine has a proximal first turbine end and a distal first turbine end; and (iii) a first proximal support ring contained within the annular bore adjacent to the proximal first turbine end and a first distal support ring contained within the annular bore adjacent to the distal first turbine end;

(c) an inlet for introducing a fluid into the annular bore; and (d) an outlet for discharging the fluid from the annular bore.

2. The vibration tool as claimed in claim 1 wherein the unbalanced turbine assembly further comprises a proximal first turbine bearing located between the first proximal support ring and the proximal first turbine end and a distal first turbine bearing located between the distal first turbine end and the first distal support ring.

3. The vibration tool as claimed in claim 1 wherein the first proximal support ring and the first distal support ring are fixedly connected with the housing.

4. The vibration tool as claimed in claim 1 wherein the sleeve is supported within the housing by the first proximal support ring.

5. The vibration tool as claimed in claim 4 wherein the sleeve has a proximal sleeve end and wherein the proximal sleeve end is comprised of a projection for engaging with the first proximal support ring in order to limit the movement of the sleeve relative to the first proximal support ring.

6. The vibration tool as claimed in claim 1 wherein the unbalanced turbine assembly further comprises a second annular turbine rotatably contained within the annular bore, wherein the second annular turbine is unbalanced relative to the longitudinal tool axis.

7. The vibration tool as claimed in claim 6 wherein the second annular turbine has a proximal second turbine end and a distal second turbine end and wherein the unbalanced turbine assembly further comprises a second proximal support ring contained within the annular bore adjacent to the proximal second turbine end and a second distal support ring contained within the annular bore adjacent to the distal second turbine end.

8. The vibration tool as claimed in claim 7 wherein the first distal support ring and the second proximal support ring are comprised of a combined first intermediate support ring.

9. The vibration tool as claimed in claim 7 wherein the unbalanced turbine assembly further comprises a proximal second turbine bearing located between the second proximal support ring and the proximal second turbine end and a distal second turbine bearing located between the distal second turbine end and the second distal support ring.

10. The vibration tool as claimed in claim 9 wherein the unbalanced turbine assembly further comprises a proximal first turbine bearing located between the first proximal support ring and the proximal first turbine end and a distal first turbine bearing located between the distal first turbine end and the first distal support ring.

11. The vibration tool as claimed in claim 7 wherein the second proximal support ring and the second distal support ring are fixedly connected with the housing.

12. The vibration tool as claimed in claim 11 wherein the first proximal support ring and the first distal support ring are fixedly connected with the housing.

13. The vibration tool as claimed in claim 12 wherein the first distal support ring and the second proximal support ring are comprised of a combined first intermediate support ring.

14. The vibration tool as claimed in claim 7 wherein the second annular turbine has a second turbine vane angle, wherein the second proximal support ring defines a plurality of second diverter vanes for directing the fluid through the second proximal support ring, wherein the plurality of second diverter vanes have a second diverter vane angle, and wherein the second diverter vane angle is in a direction opposite to the second turbine vane angle relative to the longitudinal tool axis.

15. The vibration tool as claimed in claim 6 wherein the first annular turbine is configured to rotate at a first turbine rotation rate at a design fluid energy, wherein the second annular turbine is configured to rotate at a second turbine rotation rate at the design fluid energy, and wherein the first turbine rotation rate is different from the second turbine rotation rate.

16. The vibration tool as claimed in claim 6 wherein the first annular turbine has a first turbine vane angle, wherein the second annular turbine has a second turbine vane angle, and wherein the first turbine vane angle is different from the second turbine vane angle.

17. The vibration tool as claimed in claim 6 wherein the first annular turbine is configured to generate a first turbine torque at a design fluid energy, wherein the second annular turbine is configured to generate a second turbine torque at the design fluid energy, and wherein the first turbine torque is different from the second turbine torque.

18. The vibration tool as claimed in claim 6 wherein the first annular turbine has a first turbine length, wherein the second annular turbine has a second turbine length, and wherein the first turbine length is different from the second turbine length.

19. The vibration tool as claimed in claim 6 wherein the unbalanced turbine assembly further comprises a third annular turbine rotatably contained within the annular bore, wherein the third annular turbine is unbalanced relative to the longitudinal tool axis.

20. The vibration tool as claimed in claim 19 wherein the second annular turbine has a proximal second turbine end and a distal second turbine end and wherein the unbalanced turbine assembly further comprises a second proximal support ring contained within the annular bore adjacent to the proximal second turbine end and a second distal support ring contained within the annular bore adjacent to the distal second turbine end.

21. The vibration tool as claimed in claim 20 wherein the third annular turbine has a proximal third turbine end and a distal third turbine end and wherein the unbalanced turbine assembly further comprises a third proximal support ring contained within the annular bore adjacent to the proximal third turbine end and a third distal support ring contained within the annular bore adjacent to the distal third turbine end.

22. The vibration tool as claimed in claim 21 wherein the first distal support ring and the second proximal support ring are comprised of a combined first intermediate support ring.

23. The vibration tool as claimed in claim 22 wherein the second distal support ring and the third proximal support ring are comprised of a combined second intermediate support ring.

24. The vibration tool as claimed in claim 21 wherein the unbalanced turbine assembly further comprises a proximal third turbine bearing located between the third proximal support ring and the proximal third turbine end and a distal third turbine bearing located between the distal third turbine end and the third distal support ring.

25. The vibration tool as claimed in claim 24 wherein the unbalanced turbine assembly further comprises a proximal first turbine bearing located between the first proximal support ring and the proximal first turbine end and a distal first turbine bearing located between the distal first turbine end and the first distal support ring.

26. The vibration tool as claimed in claim 25 wherein the unbalanced turbine assembly further comprises a proximal second turbine bearing located between the second proximal support ring and the proximal second turbine end and a distal second turbine bearing located between the distal second turbine end and the second distal support ring.

27. The vibration tool as claimed in claim 21 wherein the third proximal support ring and the third distal support ring are fixedly connected with the housing.

28. The vibration tool as claimed in claim 27 wherein the first proximal support ring and the first distal support ring are fixedly connected with the housing.

29. The vibration tool as claimed in claim 28 wherein the second proximal support ring and the second distal support ring are fixedly connected with the housing.

30. The vibration tool as claimed in claim 29 wherein the first distal support ring and the second proximal support ring are comprised of a combined first intermediate support ring.

31. The vibration tool as claimed in claim 30 wherein the second distal support ring and the third proximal support ring are comprised of a combined second intermediate support ring.

32. The vibration tool as claimed in claim 19 wherein the first annular turbine is configured to rotate at a first turbine rotation rate at a design fluid energy, wherein the second annular turbine is configured to rotate at a second turbine rotation rate at the design fluid energy, wherein the third annular turbine is configured to rotate at a third turbine rotation rate at the design fluid energy, and wherein the first turbine rotation rate, the second turbine rotation rate and the third turbine rotation rate are all different from each other.

33. The vibration tool as claimed in claim 19 wherein the first annular turbine has a first turbine vane angle, wherein the second annular turbine has a second turbine vane angle, wherein the third annular turbine has a third turbine vane angle, and wherein the first turbine vane angle, the second turbine vane angle and the third turbine vane angle are all different from each other.

34. The vibration tool as claimed in claim 21 wherein the third annular turbine has a third turbine vane angle, wherein the third proximal support ring defines a plurality of third diverter vanes for directing the fluid through the third proximal support ring, wherein the plurality of third diverter vanes have a third diverter vane angle, and wherein the third diverter vane angle is in a direction opposite to the third turbine vane angle relative to the longitudinal tool axis.

35. The vibration tool as claimed in claim 1 wherein the first annular turbine has a first turbine vane angle, wherein the first proximal support ring defines a plurality of first diverter vanes for directing the fluid through the first proximal support ring, wherein the plurality of first diverter vanes have a first diverter vane angle, and wherein the first diverter vane angle is in a direction opposite to the first turbine vane angle relative to the longitudinal tool axis.

36. The vibration tool as claimed in claim 1 wherein the sleeve has an inner sleeve surface and wherein the inner sleeve surface defines a sleeve bore extending through the housing.

37. The vibration tool as claimed in claim 36 wherein the vibration tool is adapted to be connected with the pipe string, wherein the pipe string has a nominal inner diameter, wherein the sleeve bore has a sleeve bore diameter, and wherein a ratio of the sleeve bore diameter to the nominal inner diameter of the pipe string is at least 0.5:1.

38. A downhole vibration tool for connection with a pipe string, comprising:

(a) a housing, the housing having an inner housing surface;

(b) an unbalanced turbine assembly contained within the housing, wherein the vibration tool has a longitudinal tool axis. wherein the unbalanced turbine assembly is unbalanced relative to the longitudinal tool axis, and wherein the unbalanced turbine assembly comprises:

(i) a sleeve, the sleeve having an outer sleeve surface, wherein the inner housing surface and the outer sleeve surface define an annular bore extending through the housing;

(ii) a first annular turbine rotatably contained within the annular bore, wherein the first annular turbine has a proximal first turbine end and a distal first turbine end;

(iii) an annular unbalanced weight rotatably contained within the annular bore, wherein the unbalanced weight is rotatably connected with the first annular turbine so that rotation of the first annular turbine results in rotation of the unbalanced weight;

(iv) a first proximal support ring contained within the annular bore adjacent to the proximal first turbine end; and (c) an inlet for introducing a fluid into the annular bore; and (d) an outlet for discharging the fluid from the annular bore.

39. The vibration tool as claimed in claim 38 wherein the first annular turbine and the unbalanced weight are fixedly connected with the sleeve so that rotation of the first annular turbine results in rotation of both the sleeve and the unbalanced weight.

40. The vibration tool as claimed in claim 39 wherein the unbalanced turbine assembly further comprises a proximal sleeve bearing located between the inner housing surface and the outer sleeve surface and a distal sleeve bearing located between the inner housing surface and the outer sleeve surface, for rotatably supporting the sleeve in the housing.

41. The vibration tool as claimed in claim 38 wherein the unbalanced turbine assembly further comprises a proximal first turbine bearing located between the first proximal support ring and the proximal first turbine end.

42. The vibration tool as claimed in claim 38 wherein the first proximal support ring is fixedly connected with the housing.

43. The vibration tool as claimed in claim 38 wherein the first proximal support ring defines a plurality of first diverter vanes for directing the fluid through the first proximal support ring.

44. A downhole vibration tool for connection with a pipe string, comprising:

(a) a housing, the housing having an inner housing surface;

(b) an unbalanced turbine assembly contained within the housing, wherein the vibration tool has a longitudinal tool axis, wherein the unbalanced turbine assembly is unbalanced relative to the longitudinal tool axis, and wherein the unbalanced turbine assembly comprises:

(i) a sleeve, the sleeve having an outer sleeve surface, wherein the inner housing surface and the outer sleeve surface define an annular bore extending through the housing;

(ii) a first annular turbine rotatably contained within the annular bore;

(iii) an annular unbalanced weight rotatably contained within the annular bore, wherein the unbalanced weight is rotatably connected with the first annular turbine so that rotation of the first annular turbine results in rotation of the unbalanced weight; and (iv) a second annular turbine rotatably contained within the annular bore, wherein the unbalanced weight is rotatably connected with the second annular turbine so that rotation of the second annular turbine results in rotation of the unbalanced weight;

(c) an inlet for introducing a fluid into the annular bore; and (d) an outlet for discharging the fluid from the annular bore.

45. The vibration tool as claimed in claim 44 wherein the first annular turbine, the second annular turbine and the unbalanced weight are fixedly connected with the sleeve so that rotation of the first annular turbine and the second annular turbine results in rotation of both the sleeve and the unbalanced weight.

46. The vibration tool as claimed in claim 45 wherein the unbalanced turbine assembly further comprises a. proximal sleeve bearing located between the inner housing surface and the outer sleeve surface and a distal sleeve bearing located between the inner housing surface and the outer sleeve surface, for rotatably supporting the sleeve in the housing.

47. The vibration tool as claimed in claim 44 wherein the first annular turbine has a proximal first turbine end and a distal first turbine end and wherein the unbalanced turbine assembly further comprises a first proximal support ring contained within the annular bore adjacent to the proximal first turbine end.

48. The vibration tool as claimed in claim 47 wherein the second annular turbine has a proximal second turbine end and a distal second turbine end and wherein the unbalanced turbine assembly further comprises a second proximal support ring contained within the annular bore adjacent to the proximal second turbine end.

49. The vibration tool as claimed in claim 48 wherein the unbalanced turbine assembly further comprises a proximal second turbine bearing located between the second proximal support ring and the proximal second turbine end.

50. The vibration tool as claimed in claim 49 wherein the unbalanced turbine assembly further comprises a proximal first turbine bearing located between the first proximal support ring and the proximal first turbine end.

51. The vibration tool as claimed in claim 48 wherein the second proximal support ring is fixedly connected with the housing.

52. The vibration tool as claimed in claim 51 wherein the first proximal support ring is fixedly connected with the housing.

53. The vibration tool as claimed in claim 48 wherein the second proximal support ring defines a plurality of second diverter vanes for directing the fluid through the second proximal support ring.

54. The vibration tool as claimed in claim 44 wherein the first annular turbine has a first turbine vane angle, wherein the second annular turbine has a second turbine vane angle, and wherein the first turbine vane angle is the same as the second turbine vane angle.

55. The vibration tool as claimed in claim 44 wherein the first annular turbine has a first turbine length, wherein the second annular turbine has a second turbine length, and wherein the first turbine length is the same as the second turbine length.

56. The vibration tool as claimed in claim 44 wherein the unbalanced turbine assembly further comprises a third annular turbine rotatably contained within the annular bore and wherein the unbalanced weight is rotatably connected with the third annular turbine so that rotation of the third annular turbine results in rotation of the unbalanced weight.

57. The vibration tool as claimed in claim 56 wherein the first annular turbine, the second annular turbine, the third annular turbine and the unbalanced weight are fixedly connected with the sleeve so that rotation of the first annular turbine, the second annular turbine and the third annular turbine results in rotation of both the sleeve and the unbalanced weight.

58. The vibration tool as claimed in claim 57 wherein the unbalanced turbine assembly further comprises a proximal sleeve bearing located between the inner housing surface and the outer sleeve surface and a distal sleeve bearing located between the inner housing surface and the outer sleeve surface, for rotatably supporting the sleeve in the housing.

59. The vibration tool as claimed in claim 57 wherein the first annular turbine has a proximal first turbine end and a distal first turbine end and wherein the unbalanced turbine assembly further comprises a first proximal support ring contained within the annular bore adjacent to the proximal first turbine end.

60. The vibration tool as claimed in claim 59 wherein the second annular turbine has a proximal second turbine end and a distal second turbine end and wherein the unbalanced turbine assembly further comprises a second proximal support ring contained within the annular bore adjacent to the proximal second turbine end.

61. The vibration tool as claimed in claim 60 wherein the third annular turbine has a proximal third turbine end and a distal third turbine end and wherein the unbalanced turbine assembly further comprises a third proximal support ring contained within the annular bore adjacent to the proximal third turbine end.

62. The vibration tool as claimed in claim 61 wherein the unbalanced turbine assembly further comprises a proximal third turbine bearing located between the third proximal support ring and the proximal third turbine end.

63. The vibration tool as claimed in claim 62 wherein the unbalanced turbine assembly further comprises a proximal first turbine bearing located between the first proximal support ring and the proximal first turbine end and a distal first turbine bearing located between the distal first turbine end and the first distal support ring.

64. The vibration tool as claimed in claim 63 wherein the unbalanced turbine assembly further comprises a proximal second turbine bearing located between the second proximal support ring and the proximal second turbine end and a distal second turbine bearing located between the distal second turbine end and the second distal support ring.

65. The vibration tool as claimed in claim 61 wherein the third proximal support ring is fixedly connected with the housing.

66. The vibration tool as claimed in claim 65 wherein the first proximal support ring is fixedly connected with the housing.

67. The vibration tool as claimed in claim 66 wherein the second proximal support ring is fixedly connected with the housing.

68. The vibration tool as claimed in claim 61 wherein the third proximal support ring defines a plurality of third diverter vanes for directing the fluid through the third proximal support ring.

69. The vibration tool as claimed in claim 56 wherein the first annular turbine has a first turbine vane angle, wherein the second annular turbine has a second turbine vane angle, wherein the third annular turbine has a third turbine vane angle, and wherein the first turbine vane angle, the second turbine vane angle and the third turbine vane angle are all the same.

70. A downhole vibration tool for connection with a pipe string, comprising:

(a) a housing, the housing having an inner housing surface;

(b) an unbalanced turbine assembly contained within the housing, wherein the vibration tool has a longitudinal tool axis, wherein the unbalanced turbine assembly is unbalanced relative to the longitudinal tool axis, and wherein the unbalanced turbine assembly comprises:

(i) a sleeve, the sleeve having an outer sleeve surface, wherein the inner housing surface and the outer sleeve surface define an annular bore extending through the housing;

(ii) a first annular turbine rotatably contained within the annular bore;

(iii) an annular unbalanced weight rotatably contained within the annular bore, wherein the unbalanced weight is rotatably connected with the first annular turbine so that rotation of the first annular turbine results in rotation of the unbalanced weight, wherein the first annular turbine and the unbalanced weight are fixedly connected with the sleeve so that rotation of the first annular turbine results in rotation of both the sleeve a id the unbalanced weight;

(iv) a proximal sleeve bearing located between the inner housing surface and the outer sleeve surface and a distal sleeve bearing located between the inner housing surface and the outer sleeve surface, for rotatably supporting the sleeve in the housing;

(v) an auxiliary annular turbine rotatably contained within the annular bore, wherein the auxiliary annular turbine is unbalanced relative to the longitudinal tool axis, and wherein the auxiliary annular turbine is rotatable independently of the first annular turbine, wherein the auxiliary annular turbine has a proximal auxiliary turbine end and a distal auxiliary turbine end; and (vi) an auxiliary proximal support ring contained within the annular bore adjacent to the proximal auxiliary turbine end;

(c) an inlet for introducing a fluid into the annular bore; and (d) an outlet for discharging the fluid from the annular bore.

71. The vibration tool as claimed in claim 70 wherein the unbalanced turbine assembly further comprises a proximal auxiliary turbine bearing located between the auxiliary proximal support ring and the proximal auxiliary turbine end.

72. The vibration tool as claimed in claim 70 wherein the auxiliary proximal support ring is fixedly connected with the housing.

73. The vibration tool as claimed in claim 70 wherein the auxiliary proximal support ring defines a plurality of auxiliary diverter vanes for directing the fluid through the auxiliary proximal support ring.

74. The vibration tool as claimed in claim 70 wherein the first annular turbine has a first turbine vane angle, wherein the auxiliary annular turbine has an auxiliary turbine vane angle, and wherein the auxiliary turbine vane angle is in a direction opposite to the first turbine vane angle relative to the longitudinal tool axis so that the auxiliary annular turbine and the first annular turbine are configured to rotate in opposite directions.

75. The vibration tool as claimed in claim 70 wherein the first annular turbine has a first turbine length, wherein the auxiliary annular turbine has an auxiliary turbine length, and wherein the auxiliary turbine length is greater than the first turbine length.

76. A downhole vibration tool for connection with a pipe string, comprising:

(a) a housing, the housing having an inner housing surface;

(b) an unbalanced turbine assembly contained within the housing, wherein the vibration tool has a longitudinal tool axis, wherein the unbalanced turbine assembly is unbalanced relative to the longitudinal tool axis, and wherein the unbalanced turbine assembly comprises:

(i) a sleeve, the sleeve having an outer sleeve surface, wherein the inner housing surface and the outer sleeve surface define an annular bore extending through the housing, wherein the sleeve has an inner sleeve surface and wherein the inner sleeve surface defines a sleeve bore extending through the housing;

(ii) a first annular turbine rotatably contained within the annular bore;

(iii) an annular unbalanced weight rotatably contained within the annular bore wherein the unbalanced weight is rotatably connected with the first annular turbine so that rotation of the first annular turbine results in rotation of the unbalanced weight;

(c) an inlet for introducing a fluid into the annular bore; and (d) an outlet for discharging the fluid from the annular bore.

77. The vibration tool as claimed in claim 76 wherein the vibration tool is adapted to be connected with the pipe string, wherein the pipe string has a nominal inner diameter, wherein the sleeve bore has a sleeve bore diameter, and wherein a ratio of the sleeve bore diameter to the nominal inner diameter of the pipe string is at least 0.5:1.

* * * * *